US008632157B2

(12) United States Patent
Uraki et al.

(10) Patent No.: US 8,632,157 B2
(45) Date of Patent: Jan. 21, 2014

(54) INKJET RECORDING DEVICE

(75) Inventors: Shingo Uraki, Tachikawa (JP); Kumiko Furuno, Shiki (JP)

(73) Assignee: Konica Minolta Holdings, Inc. (JP)

( * ) Notice: Subject to any disclaimer, the term of this patent is extended or adjusted under 35 U.S.C. 154(b) by 147 days.

(21) Appl. No.: 13/320,361

(22) PCT Filed: May 18, 2010

(86) PCT No.: PCT/JP2010/058344

§ 371 (c)(1),
(2), (4) Date: Nov. 14, 2011

(87) PCT Pub. No.: WO2010/137491

PCT Pub. Date: Dec. 2, 2010

(65) Prior Publication Data

US 2012/0062640 A1 Mar. 15, 2012

(30) Foreign Application Priority Data

May 29, 2009 (JP) ..... 2009-130968
May 29, 2009 (JP) ..... 2009-130986
May 29, 2009 (JP) ..... 2009-130995
May 29, 2009 (JP) ..... 2009-131019

(51) Int. Cl.
*B41J 29/377* (2006.01)

(52) U.S. Cl.
USPC ..... 347/18

(58) Field of Classification Search
USPC ..... 347/17, 18, 37, 40, 102
See application file for complete search history.

(56) References Cited

U.S. PATENT DOCUMENTS 5,500,658 A 3/1996 Hattori et al.
6,196,672 B1 3/2001 Ito et al.
7,538,299 B2 * 5/2009 Spence et al. ..... 219/388
8,197,024 B2 * 6/2012 Kovacs et al. ..... 347/18

FOREIGN PATENT DOCUMENTS

| | | | |
|---|---|---|---|
| EP | 0494693 | A1 | 7/1992 |
| EP | 1518689 | A1 | 3/2005 |
| JP | 1-157860 | A | 6/1989 |
| JP | 3-147850 | A | 6/1991 |
| JP | 6-64159 | A | 3/1994 |
| JP | 2005-138463 | A | 6/2005 |
| JP | 2005-212323 | A | 8/2005 |

OTHER PUBLICATIONS

International Search Report for International Application No. PCT/JP2010/058344 mailed Jun. 22, 2010 with English translation.
Extended European Search Report for Application No./Patent No. 10780446.0-1251/2436519, dated Nov. 8, 2012, with English translation.

* cited by examiner

*Primary Examiner* — An Do
(74) *Attorney, Agent, or Firm* — Cantor Colburn LLP

(57) ABSTRACT

An inkjet recording device for ejecting ink onto a recording medium to form an image on the recording medium while a recording head is moved with relative movement to the recording medium in a direction along an upper surface of the recording medium, including: a recording head for ejecting ink onto a recording medium; a heating device for heating the recording medium; a conveyance device for conveying the recording medium having been heated by the heating device to under the recording head; and a cooling device which is provided in a state of insulation from the recording head, and has a cooling surface which is cooled to a temperature lower than a temperature of a nozzle surface of the recording head, wherein the cooling surface and the nozzle surface of the recording head are disposed along a direction of the relative movement and to face the recording medium.

23 Claims, 31 Drawing Sheets

INKJET RECORDING DEVICE

CROSS REFERENCE TO RELATED APPLICATIONS

This is a U.S. national stage of application No. PCT/JP2010/058344, filed on May 18, 2010. Priority under 35 U.S.C. §119(a) and 35 U.S.C. §365(b) is claimed from Japanese Application Nos. 2009-130968, filed May 29, 2009; 2009-130986, filed May 29, 2009; 2009-130995, filed May 29, 2009; and 2009-131019, filed May 29, 2009, the disclosures of which is also incorporated herein by reference.

TECHNICAL FIELD

The present invention relates to an inkjet recording device.

BACKGROUND TECHNOLOGY

As a recording device which is capable of printing on various recording media such as a plain paper sheet and plastic thin plate, there is an inkjet recording device. As the inkjet recording device, there are a scanning type inkjet device and a line type inkjet device.

In the scanning type inkjet recording device, the recording medium is conveyed in a prescribed direction by a conveyance device, and a recording head for ejecting ink scans along a surface of the recording medium in a direction perpendicular to the recording medium conveyance direction to form an image on the recording medium.

In the line type inkjet device, with a condition that the recording head for ejecting ink is fixed, the recording medium is conveyed in a prescribed direction by the conveyance device, and the recording head ejects ink toward the recording medium conveyed under the recording head to form an image on the recording medium.

In recent years, in order to improve the throughput of inkjet recording device, speed-up technologies gather attentions, and from a view point of realizing quick fixing of liquid ink, an inkjet recording device, which is installed with a heater on the recording medium conveyance device, is required. However, in cases of executing a heat fixing of the ink ejected on the recording medium, a problem is known that a low-boiling point component vaporizes from the ink on the recording medium to cause humidity increase inside the recording device and to generate dew condensation, which causes various problems. In order to solve the problems, some technologies are proposed with regard to collection of the vaporized solvent component (or dehumidification).

For example, a liquid ejection recording device is disclosed in which a heat radiating metal plate provided near an outer cover of a heat fixing unit liquidizes the vaporized component of ink for collection (refer to Patent Document 1, for example).

Further, an inkjet recording device is disclosed which detects the temperature and humidity in the chassis, and discharges the hot air in chassis with a fan (refer to Patent Document 2, for example).

Further, an inkjet recording device is disclosed in which vaporized organic solvent evaporated by a heater is collected with a fan to prevent the dew condensation in the device (refer to Patent Document 3, for example).

Furthermore, an inkjet recording device is disclosed in which air blowers are provided at both sides of a recording head to blow off the air, on the recording medium, including ink mists, at the time of printing (refer to Patent Document 4, for example).

PRIOR ART DOCUMENT

Patent Document

Patent Document 1: JP1991-147850A
Patent Document 2: JP2005-138463A
Patent Document 3: JP1994-64159A
Patent Document 4: JP2005-212323A

SUMMARY OF THE INVENTION

Problems to be Solved by the Invention

From the point of spreading behavior of ink dot on the recording medium, a configuration is desired where the ink is deposited on a heated recording medium. However, in cases where the distance between a nozzle surface of the recording head and the heater is short, local temperature rise is generated by the vapor vaporized from the ink on recording medium in the vicinity of the head. Accordingly, in cases where the nozzle surface temperature is lower than the heating device temperature, dew condensation tends to be generated on the nozzle surface due to the difference of saturated water vapor amount. Therefore, in order to prevent the dew condensation on the nozzle surface, it is important to effectively dehumidify the air in the vicinity of recording head.

However, in Patent Document 1, since the heat radiating metal plate is arranged somewhat distant from the surface position of recording medium so as not to directly receive heat energy, the heat radiating metal plate is not effective to prevent the dew condensation on the nozzle surface due to the local temperature rise near the recording head. Further, since the heat radiating metal plate works with natural cooling, it does not befit continuous usage.

Further, in Patent Document 2, since a dehumidifying mechanism is disposed apart from the recording head, it is not effective to prevent the dew condensation on the nozzle surface due to the local temperature rise near the recording head. In order to exert powerful dehumidification, it is required to increase suction power of the dehumidifying mechanism, however in that case, the air flow in the vicinity of recording head is disturbed, and the ink deposition onto the recording medium is disturbed, which causes degradation of print quality.

Further, in Patent Document 3, since the print quality is degraded due to disturbed air flow if the intake fan for collecting the ink vapor is disposed near the recording head, the heater cannot be disposed just under the recording head or in the upstream side of recording medium conveyance direction. And, incases where the heater is disposed at the position apart from the recording head in the downstream side of recording medium conveyance direction, when a recording medium of poor wetting property is used, the time from ink deposition onto the recording medium to the heat fixing becomes long, and image degradation such as uneven density is caused due to the spread behavior of the ink dot.

Further, according to Patent Document 4, degradation of print quality due to the disturbed air flow cannot be avoided. Further, since the blown vapor or mist is not collected, it may be condensed at other place in the device to make the device dirty.

Further, since the air flow generated by the fan accelerates meniscus drying on the nozzle surface, which may badly affect ink ejection property.

Therefore, more effective dehumidification in the vicinity of recording head has been required while solving these problems.

The present invention is achieved to solve the abovementioned problems, and objectives of the present invention is to provide an inkjet recording device which has a configuration being capable of printing on a heated recording medium, continuously prevents the dew condensation, on the nozzle surface of the recording head, having been generated by the local temperature rise due to the vapor evaporated from the ink on the recording medium, and capable of executing effective dehumidification in the vicinity of the recording head without causing the degradation of print quality or the meniscus drying on the surface of nozzle head due to the disturbed air flow generated by the fan.

Means for Solving the Problems

The invention described in claim 1 is an inkjet recording device including: a recording head for ejecting ink onto a recording medium; a heater for heating the recording medium; and a conveyance device for conveying the recording medium having been heated by the heater to under the recording head; for ejecting ink onto the recording medium to form an image on the recording medium while the recording head is moved with relative movement to the recording medium in a direction along an upper surface of the recording medium, and the inkjet recording device is characterized in further including:

a cooling device which is provided in a state of insulation from the recording head and has a cooling surface which is cooled to a temperature lower than temperature of a nozzle surface of the recording head, wherein the cooling surface and the nozzle surface of the recording head are disposed along the direction of the relative movement and face the recording medium.

The invention described in claim 2 is the inkjet recording device described in claim 1, wherein the direction of relative movement is a scanning direction of the recording head, and the cooling surface and the nozzle surface are disposed along the scanning direction of the recording head.

The invention described in claim 3 is the inkjet recording device described in claim 1, wherein the direction of relative movement is a conveyance direction of the recording medium, and the cooling surface and the nozzle surface are disposed along the conveyance direction of the recording medium.

The invention described in claim 4 is the inkjet recording device described in any one of claims 1 to 3, wherein a plurality of recording heads are disposed side by side along the direction of relative movement, and the cooling surface is disposed between adjacent recording heads.

The invention described in claim 5 is the inkjet recording device described in any one of claims 1 to 4 wherein a plurality of recording heads are disposed side by side along the direction of relative movement, and the cooling surface is disposed adjacent to an end of the plurality of recording heads disposed on the line.

The invention described in claim 6 is the inkjet recording device described in claim 2, wherein the cooling surface is disposed at a downstream side with respect to the recording head in the scanning direction.

The invention described in claim 7 is the inkjet recording device described in claim 3, wherein the cooling surface is disposed at a downstream side with respect to the recording head in the conveyance direction of the recording medium.

The invention described in claim 8 is the inkjet recording device described in claim 7, wherein a plurality of recording heads are disposed on side by side along the conveyance direction of the recording medium, and the cooling surface is disposed in parallel at the downstream side with respect to each of the plurality of recording heads in the conveyance direction of the recording medium.

The invention described in claim 9 is the inkjet recording device described in any one of claims 1 to 8 wherein a height of the nozzle surface of the recording head and a height of the cooling surface each from the recording medium are configured to be equal.

The invention described in claim 10 is the inkjet recording device described in any one of claims 1 to 9 wherein the cooling surface is applied with a lyophilic processing.

The invention described in claim 11 is the inkjet recording device described in any one of claims 1 to 10, further being provided with an absorption member to absorb the dew condensation attached on the cooling surface.

The invention described in claim 12 is the inkjet recording device described in any one of claims 1 to 10, further being provided with a dew condensation collecting mechanism disposed on the cooling device, wherein a groove connected to the dew condensation collecting mechanism is formed on the cooling surface.

The invention described in claim 13 is the inkjet recording device described in claim 2 or 6, further being provided with an absorption member to absorb dew condensation attached on the cooling surface, wherein a groove communicated with the dew condensation collecting mechanism is formed on the cooling surface, and wherein the dew condensation collecting mechanism is disposed at an end portion of the recording head in the scanning direction.

The invention described in claim 14 is the inkjet recording device described in claim 13, wherein the groove is formed to be elongated along the scanning direction of the recording head.

The invention described in claim 15 is the inkjet recording device described in any one of claims 12 to 14, wherein the cooling surface is a slant surface being slanted with respect a horizontal plane, and wherein the dew condensation collecting mechanism is disposed below the lowest position of the cooling surface.

The invention described in claim 16 is the inkjet recording device described in any one of claims 12 to 14, wherein a slanting mechanism is provided which slants the cooling surface with respect to a horizontal plane such that the dew condensation mechanism is positioned below the cooling surface.

The invention described in claim 17 is the inkjet recording device described in any one of claims 12 to 16, wherein the dew condensation mechanism is provided with an absorption member to absorb collected dew condensation.

The invention described in claim 18 is the inkjet recording device described in claim 11, wherein the cooling device is provided with a cooling section on which the cooling surface is formed, and wherein the absorption member and a hole communicating from the cooling surface to the absorption member is formed on the cooling section The invention described in claim 19 is the inkjet recording device described in claim 18, wherein the cooling device is provided with:

a holding member which holds the absorption member by sandwiching the absorption member between the holding member and the cooling section;

a connecting member which connects the cooling section with the holding member, and a cooling body which cools the cooling section to a lower temperature than a temperature of the nozzle surface of the recording head.

The invention described in claim 20 is the inkjet recording device described in claim 19, wherein the absorption member is elastically deformable, and a distance between the cooling section and the holding member is configured to be variable.

The invention described in claim 21 is the inkjet recording device described in claim 19 or 20, wherein the cooling body is provided to contact the holding member, and wherein at least one of the holding member and the connecting member, and the absorption member are thermally-conductive.

The invention described in claim 22 is the inkjet recording device described in claim 19 or 20, wherein the cooling body is provided to contact the holding member and the holding member is thermally-conductive.

The invention described in claim 23 is the inkjet recording device described in claim 19 or 20, wherein the cooling body is provided to contact the cooling section, and the connecting member thermally insulates between the cooling section and the holding member, and wherein the holding member has a heat radiation section to contact the cooling body and release heat of the cooling body.

Effects of the Invention

According to the invention described in claim 1, by cooling the cooling surface to a temperature lower than temperature of the nozzle surface of the recording head, since vapor of the ink is generated on the cooling surface which being lower temperature than the nozzle surface of the recording head, dew condensation is not generated on the nozzle surface of the recording head.

Further, since the cooling surface is cooled by the cooling device (or a cooler) not by natural heat radiation, dew condensation is continuously prevented while the cooling device is driven.

Further, since dehumidification near the recording head is performed without using the conventionally used fan, disturbance of air flow is not caused, and print quality is not deteriorated. Further, meniscus drying on the nozzle surface of the recording head is not generated.

Further, since the cooling surface and the nozzle surface of the recording head are disposed along the direction of relative movement of the recording head and the recording medium, and ink vapor which moves along with the air flow generated by the relative movement is condensed and collected in at least one of front and backside of the recording head, which enables effective dehumidification in the vicinity of the recording head.

According to the invention described in claim 2, by disposing the cooling surface of the cooling device along the scanning direction of the recording head, ink vapor which moves along with the air flow generated by the movement of the recording head is condensed and collected in at least one of front and backside of the recording head, which enables effective dehumidification in the vicinity of the recording head.

According to the invention described in claim 3, by disposing the cooling surface of the cooling device along the along the conveyance direction of the recording medium, ink vapor which moves along with the air flow generated by the movement of the recording head is condensed and collected in at least one of front and backside of the recording head, which enables effective dehumidification in the vicinity of the recording head.

According to the invention described in claim 4, although in recording heads adjacent in the relative movement direction, the nozzle surface of a recording head which ejects ink later tends to be dew-condensed due to ink vapor from the ink ejected by another recording head which has previously ejected the ink, by disposing the cooling surface of the cooling device between the adjacent heads, dew condensation is caused on the cooling surface, which enables to prevent the generation of dew condensation on the nozzle surface of the adjacent nozzle head.

According to the invention described in claim 5, by disposing the cooling surfaces adjacent to the both ends of the recording heads arranged on the line, the inkjet recording device is capable of coping with a case where the recording head or the recording medium reciprocates. In this case, since the dew condensation can be generated before and after the ink ejection, efficiency of humidification can be improved.

According to the invention described in claim 6, by disposing the cooling surface of the cooling device at the downstream side in the scanning direction with respect to the recording head, the dew condensation can be performed before the recording head enters into a high density area of ink vapor, and the generation of dew condensation on the nozzle surface of the recording head can be prevented.

According to the invention described in claim 7, by disposing the cooling surface of the cooling device at the downstream side in the conveyance direction of the recording medium with respect to the recording head, dew condensation can be performed before the ink vapor scatters in the periphery, and the generation of dew condensation on the nozzle surface of the recording head can be prevented.

According to the invention described in claim 8, by directing the ink vapor, generated in the periphery of each recording head and will be scattered around, toward the cooling surface adjacent to downstream side of the recording head, with the air flow generated by the conveyance of recording media, the ink vapor can be condensed on the cooling surface and collected. Thus, the ink vapor can be dew condensed and removed before being scattered.

According to the invention described in claim 9, since in cases where the cooling surface is disposed nearer to the recording media than the nozzle surface of the recording head, condensed dew may contact the recording media to pollute it, and in cases where the cooling surface is disposed farther from the recording media than the nozzle surface of the recording head, since the dehumidification effect in the periphery of the recording head is reduced, therefore, by configuring heights of the nozzle surface and the cooling surface from the recording medium to be equal, the dehumidification effect can be exerted while pollution of the recording media is prevented.

According to the invention described in claim 10, by applying the lyophilic processing on the cooling surface, since the dew condensation (or condensed dew) becomes wet and easy to spread, the dew condensation on the cooling surface can be prevented from trailing down or dropping from the cooling surface, which enables to make the distance from the recording media and the recording head short to improve the image quality.

According to the invention described in claim 11, since the dew condensation generated on the cooling surface can be absorbed with the absorption member, a number of times of maintenance for the cooling surface can be reduced. Further, since the dew condensation generated on the cooling surface is absorbed by the absorption member before dropping on the recording media, pollution of the recording media can be prevented.

According to the invention described in claims 12 and 13, since a groove is formed on the cooling surface, the dew condensation generated on the cooling surface moves with capillary action along the groove, and is collected in the dew condensation collecting mechanism. Thus, the ink vapor in the vicinity of recording head is made to be liquid by the cooling surface, and the liquid is collected through the groove into the dew condensation collecting mechanism communicated with the groove.

Therefore, since the ink vapor floating in the vicinity of the recording head is discharged to outside by the cooling device having the cooling surface formed with the groove and dew condensation collecting mechanism, the dehumidification near the recording head can be effectively performed. Further, since the dew condensation is collected through the groove into the dew condensation collecting mechanism, few dew condensation remains on the cooling surface, and the maintenance (wiping and the like) of the cooling surface can be made unnecessary, or the number of times of maintenance for the cooling surface can be decreased compared to a case of not forming the grove on the cooling surface.

Further, by forming the groove on the cooling surface, since the surface area of cooling surface becomes large, the dehumidification efficiency near the recording head can be improved.

According to the invention described in claim 13, since the dew condensation collecting mechanism is disposed at an end portion of the recording head in the scanning direction, due to the movement of the recording head, an inertial force along the moving direction of the recording head is exerted to the dew condensation attached on the cooling surface. Due to this, the dew condensation is collected into the dew condensation collecting mechanism by moving along the groove. Thus, the dew condensation can be quickly and easily collected.

According to the invention described in claim 14, since the groove is formed along the scanning direction of the recording head, the direction of inertial force caused by the movement of the recording head and the direction of forming the groove coincide with each other, and the dew condensation easily moves along the groove. Thus, the dew condensation can be quickly and easily collected.

According to the invention described in claim 15, since the cooling surface is configured to be a slant surface, the dew condensation moves downward due to a gravity force, and is collected into the dew condensation mechanism positioned below the lowest position of the cooling surface. Thus, the dew condensation can be quickly and easily collected.

According to the invention described in claim 16, since the cooling surface can be made slanted by the slanting mechanism, the dew condensation moves downward due to a gravity force, and is collected into the dew condensation mechanism positioned below the lowest position of the cooling surface. Thus, the dew condensation can be quickly and easily collected.

According to the invention described in claim 17, since the absorption member can absorb the dew condensation generated on the cooling surface, a number of times of maintenance for the cooling surface can be decreased. Further, since the dew condensation generated on the cooling surface is absorbed by the absorption member before dropping on the recording media, pollution of the recording media can be prevented.

According to the invention described in claim 18, since the cooling device is formed of a hole which communicates from the cooling surface to the absorption member, the dew condensation generated on the cooling surface moves through the inner surface of the hole with a capillary force, and is absorbed by the absorption member communicated with this hole. Thus, the ink vapor in the vicinity of recording head is liquidized by the cooling surface, and the liquid is absorbed by the absorption member through the hole. By this, the dew condensation is made hardly drop onto the recording media.

Therefore, since the ink vapor floating in the vicinity of the recording head is discharged to outside by the cooling device having the cooling surface formed with the hole and the absorption member, the dehumidification near the recording head can be effectively performed. Further, since the dew condensation is collected through the hole into the absorption member, few dew condensation remains on the cooling surface, and the maintenance (wiping and the like) of the cooling surface can be made unnecessary, or the number of times of maintenance for the cooling surface can be decreased compared to a case of not forming the hole on the cooling surface.

Further, by forming the hole on the cooling surface, since the surface area of cooling surface becomes large, the dehumidification efficiency near the recording head can be improved.

According to the invention described in claim 19, by holding the absorption member with use of the holding member, cooling section and the connecting member, adhesiveness between the absorption member and the cooling section is enhanced, and the dew condensation on the cooling surface is made easy to be absorbed.

According to the invention described in claim 20, by moving any one of the cooling section and the holding member, the absorption member is elastically deformed and the dew condensation absorbed in the absorption member flows out. Thus, the absorption member is enabled to absorb the dew condensation again, which makes exchange of the absorption member unnecessary to make the maintenance easy.

According to the invention described in claim 21, the cooling body is able to cool the holding member, and through one or both of the connecting member and the absorption member, able to cool the cooling section.

Namely, the cooling body is able to indirectly cool the cooling section, and since the cooling section is enabled to be disposed beneath the cooling body, space saving of the cooling device can be achieved without enlarging in lateral direction (or horizontal direction).

According to the invention described in claim 22, since the cooling body is able to cool both the holding member and the cooling section, temperature of the cooling surface can be effectively lowered, and cooling efficiency is improved.

According to the invention described in claim 23, since the holding member can release the heat accumulated in the cooling body, another member for releasing heat is not required, and a number of parts can be reduced.

Further, since the connecting member thermally insulates between the cooling section and the holding member, heat is prevented from transferring to the cooling section from the holding member warmed by the heat release.

DESCRIPTION OF THE PREFERRED EMBODIMENT

Figure 1:
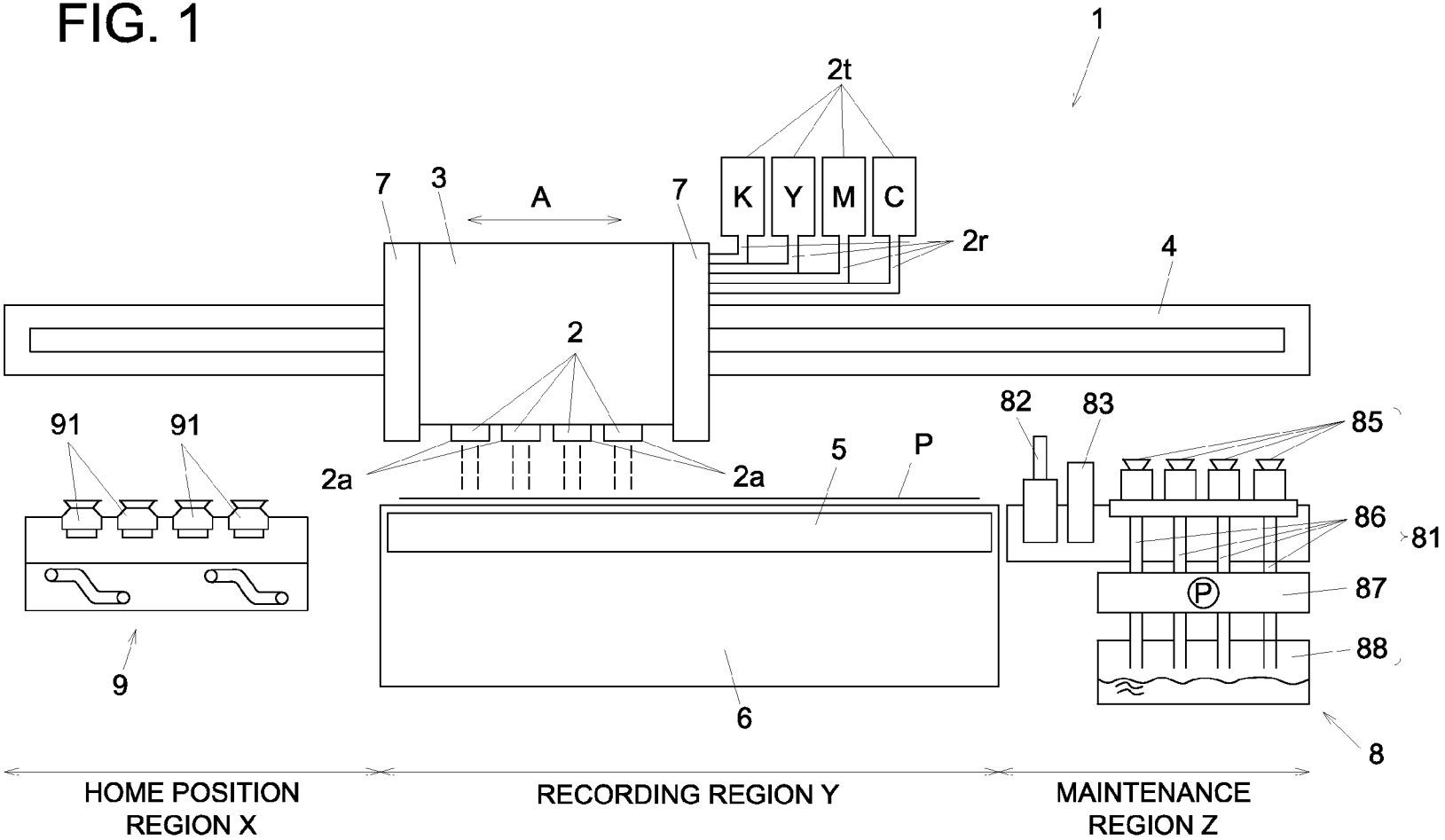
FIG. 1 is a drawing illustrating an outline structure of a scanning type inkjet recording device.

Hereinafter, an inkjet recording device will be described referring to the drawings.

In the inkjet recording devices, there are a scanning type inkjet recording device and a line type inkjet recording device.

First Embodiment

<Structure of Scanning Type Inkjet Recording Device>

<Overall Structure>

As shown in FIG. 1, inkjet recording device 1 is a scanning type inkjet printer which ejects ink from a recording head onto a recording medium to form an image on the recording medium.

Inkjet recording device 1 is provided with recording head 2 which ejects ink to recording medium P, carriage 3 to hold recording head 2, guide rail 4 to support carriage 3 movably in a scanning direction, heating device 5 to heat recording medium P, conveyance device 6 to convey the heated recording medium P, cooling device 7 to cool an ink component vaporized at above recording medium P, maintenance unit 8 to clean the nozzle surface of recording head 2, and moisturizing unit 8 to moisturize the nozzle surface of recording unit 2.

(Recording Head, Carriage, Guide Rail)

As shown in FIG. 1, recording head 2 is mounted on carriage 3. Recording head 2 is formed in a shape of rectangular solid, and on its bottom end surface, a nozzle plate having a nozzle hole is provided. By ejecting ink from the nozzle hole, an image is formed on recording medium P.

In inkjet recording device 1, in order to eject ink of four colors: Black (K), Yellow (Y), Magenta (M), and Cyan (C), four recording heads 2 in total are installed on carriage 3. Four recording heads 2 is arranged in one row in scanning direction of the recording head A. Namely, carriage 3 functions as a head supporting member. The ink to be used in inkjet recording device 1 is not restricted to the above, for example, other colors such as Light Yellow (LY), Light Magenta (LM), Light Cyan (LC) can be used. In this case, recording head 2 corresponding to each color is installed on carriage 3.

To each recording head 2, ink tank 2*t* to reserve each color ink of Black, Yellow, Magenta, and Cyan is connected via ink flow path 2*r* such as an ink supply pipe. Namely, the ink in ink tank 2*t* is configured to be supplied into each recording head 2 through ink flow path 2*r*.

Carriage 3 supporting these recording heads 2 is movably mounted on guide rail 4. Carriage 3 is moved by carriage drive mechanism 31 (see FIG. 4) along guide rail 4.

Guide rail 4 is formed so as to extend along scanning direction A of recording head 2. Guide rail 4 is formed such that recording head 2 can move through home position X which being an initial waiting position of recording head 2, recording region Y where recording head 2 executes recording on recording medium P, and maintenance region Z where maintenance of recording head 2 is executed.

(Heating Device)

As shown in FIG. 1, heating device 5 is, for example, a heater to be heated by electric power supply, and provided on conveyance device 6. Conveyance device 6 is provided in recording region Y. Heating device 5 is arranged just under the recording medium P which being conveyed, and heats the recording medium P having been conveyed by conveyance device 6. Due to previous heating of recording medium P, wetting property of the recording medium P is improved and a dot diameter of the ink is properly expanded by wetting, thus an image without uneven image quality can be obtained.

Heating device 5 is provided just under the recording head 2, or at upstream side of just under the recording head 2 in conveyance direction of recording medium P. Namely, heating device 5 is arranged at a position where recording medium P can be heated no later than being conveyed to an ink ejecting position by recording head 2. In the present embodiment heating device 5 is provided at just under the recording head 2.

Recording medium P is preferably heated by heating device 5 to be not less than 40° C. and not more than 100° C. In case of lower than 40° C., wetting property is not sufficiently improved, and in case of higher than 100° C., recording medium P may be deformed by the heat to cause a failure of conveyance property of recording medium P.

Although the heating of recording medium P is performed before being printed with ink, the heating may be subsequently conducted after the printing. Further, as heating device 5, not being restricted to the abovementioned plate heater, may be for example, a heater fan, a heat roller, a heat belt, a halogen heater, or a far-infrared heater, and these heater can be used by proper selection or in combination.

(Conveyance Device)

Figure 4:
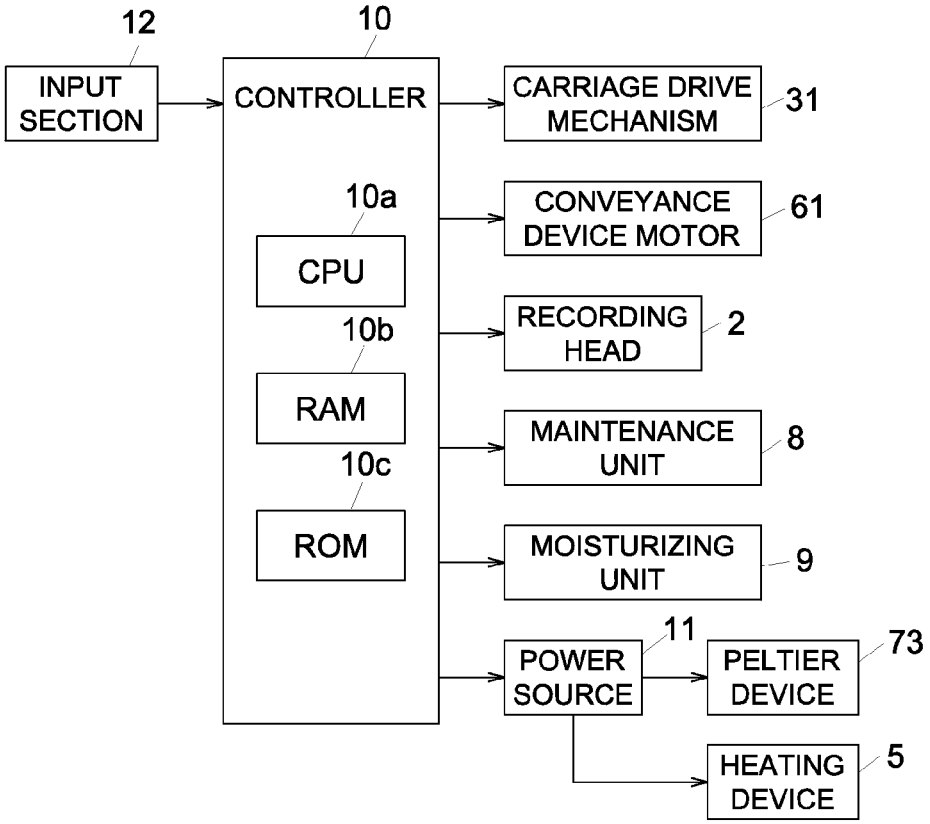
FIG. 4 is a block diagram showing a controller and each composition connected to the controller.

As shown in FIG. 1, conveyance roller 6 is provided with an unillustrated drive roller, a driven roller, a conveyance belt suspended between the drive roller and driven roller, and motor 61 to rotate the drive roller 61 (see FIG. 4).

When the drive roller is rotated by drive of motor 61, the conveyance belt moves around the drive roller and the driven roller and conveys recording medium P placed thereon along the conveyance direction, and when the drive roller stops, the conveyance belt stops to move around the rollers and stops to convey recording medium P.

The conveyance direction of recording medium P is configured to be parallel to the plane direction of recording medium P as well as perpendicular to scanning direction A.

(Cooling Device)

Figure 2A:
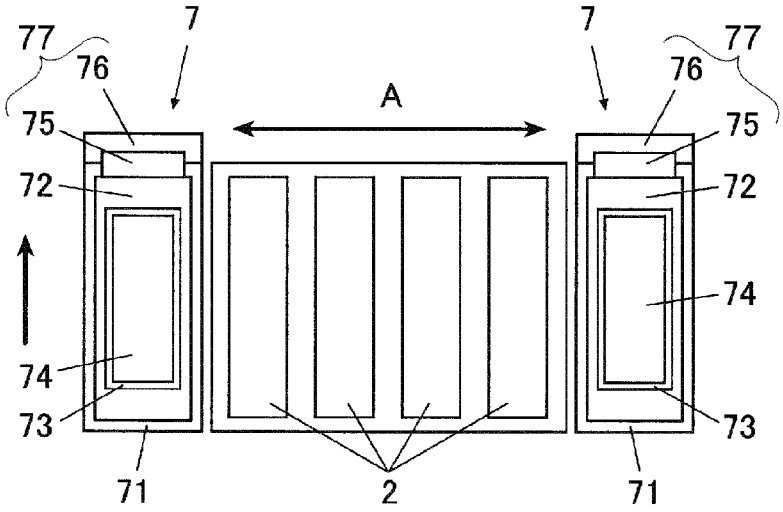
FIG. 2*a* is a plan view illustrating an arrangement of a recording head and a cooling device.
Figure 2B:
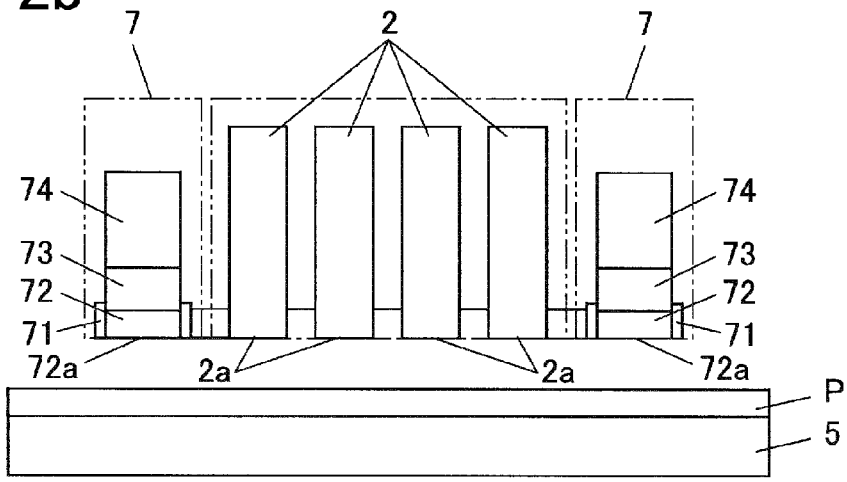
FIG. 2*b* is an elevation view illustrating an arrangement of a recording bead and a cooling device.
Figure 3:
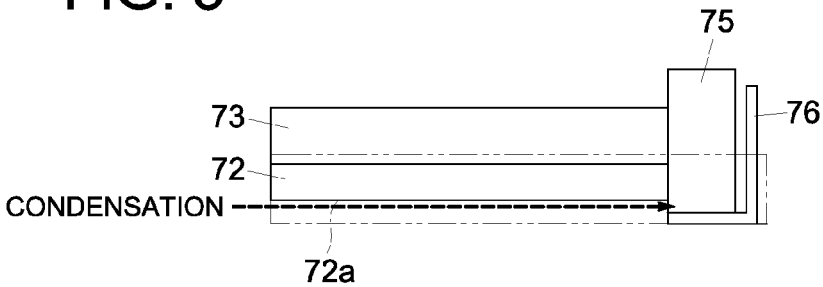
FIG. 3 is a side view of the cooling device viewing from a scanning direction of the recording head.

As shown in FIGS. 2*a*, 2*b*, and 3, cooling device 7 has supporting section 71 provided on carriage 3, and cooling section 72 is provided on said supporting section 71.

Cooling section 72 is, for example, formed with a metal plate. Specifically, by forming cooling section 72 with a high thermal conductivity metal plate such as stainless steel (SUS), aluminum, copper, iron and the like, cooling efficiency around recording head 2 can be enhanced. Further, by utilizing a compact and low-cost metal plate, cost reduction can be achieved.

Cooling section 72 is installed on supporting section 71 in the state of heat insulation from recording head 2. Since cooling section 72 is installed on supporting section 71, only supporting section 71 is required to be a heat insulation material.

As the heat insulation material, materials of inorganic fiber, foamed plastic, natural fiber and the like are preferable. Further it is preferable to dispose nozzle surface 2*a* of recording head 2 and cooling surface 72*a* so as not be thermally affected with each other.

Cooling section 72 is disposed such that its bottom surface faces recording medium P. The bottom surface of cooling section is made to be cooling surface 72*a* which cools air containing vapor of ink component in the vicinity of recording head 2.

Cooling section 72 is disposed such that said cooing surface 72*a* is arranged side by side with nozzle surface 2*a* of recording head 2 along the scanning direction of recording head 2. Specifically, as shown in FIGS. 2*a* and 2*b*, cooling devices 72 are disposed at both end sides in the arranged direction of four recording heads 2 arranged side by side.

Cooing section 72 is provided with recording head 2 such that a height of the cooling surface 72*a* and a height of the nozzle surface 2*a* of the recording head 2 each from the upper surface of recording medium P are made to be equal.

The cooling surface 72*a* is applied with a lyophilic processing. This is a measure to make the dew condensation on cooling surface 72*a* hardly drops on recording medium P. As the lyophilic processing, coating of commercially available organic or inorganic hydrophilic coating material, photocatalytic titanium-oxide coating material, and application of plasma processing can be cited.

In the present embodiment, a stainless steel plate is used as cooling section, and a commercially available inorganic hydrophilic coating material is coated.

On an upper surface of the cooling section 72, Peltier device 73 is provided in contact state with cooling section 72 as a cooling body for cooling said cooling section 72. Here, Peltier device 73 is a plate shaped semiconductor device which utilizes Peltier effect where heat moves from one metal to another metal when elects c current flows through a junction area of two types of metals. When Peltier device 73 is supplied with electric current by power source 11 (see FIG. 4), bottom end part of Peltier device 73 contacting to cooling section 72 becomes low temperature and heat is radiated from the upper end.

On the upper surface of Peltier device 73, heat radiation section 74 to release heat accumulated at the upper end area of Peltier device 73 is provided in contact state with Peltier device 73. Heat radiation section 74 is configured with a metal heatsink. Further, the upper end portion of Peltier device 73 may be exposed to outer air for natural heat radiation, or may be enhanced of cooling by exposing to the wind of a radiator fan.

Cooling section 72 and Peltier device 73 may be formed in one body. Namely, the cooling surface of Peltier device 73 may be made as the surface for attaching the dew condensation. As the cooling body, a water-cooling system for cooling the cooling surface with cooled water, or an air-cooling system for cooling the cooling surface with cooled air may be applicable, however, the cooling system for cooling said cooling surface 72*a* with Peltier device 73 is preferable. By using Peltier device 73 as the cooling body, a compact inkjet recording device with reduced cost can be realized. By a control of voltage to be applied to Peltier device 73, temperature control of cooling surface 72*a* is possible, and further, by using a plurality of stacked Peltier device 73, the cooling ability can be remarkably enhanced.

At an end of cooling section 72 and Peltier device 73 in the conveyance direction of recording medium P, provided is absorption member 75 for absorbing the dew condensation attached and accumulated on cooling surface 72*a*. As absorption member 75, a sponge material such as a porous material, a fiber material of felt and the like, or a material blended with high molecular polymer can be utilized.

Absorption member 75 is provided on liquid collection tray 76 fixed on recording head 2, and the waste liquid, which being gathering of the dew condensation absorbed by absorption member 75, can be collected from waste liquid collection tray 76.

As described above, dew condensation collecting mechanism 77 provided at the end of recording medium conveyance direction for collecting the dew condensation attached and accumulated on cooling surface 72*a* is configured with absorption member 75 for absorbing the dew condensation accumulated on cooling surface 72*a* and waste liquid collection tray 76 for reserving the dew condensation collected by absorption member 75.

In order to absorb the dew condensation accumulated on cooling surface 72*a*, absorption member 75 is disposed to protrude at lower side (the side of recording medium P) than cooling surface 72*a*. The dew condensation absorbed by absorption member 75 may be evaporated from absorption member by natural drying, or may be sucked by a pump from waste liquid collection tray 76.

(Maintenance Unit)

As shown in FIG. 1, at an end of outside the recording region Y where conveyance device 6 is provided, maintenance region Z is formed. In said maintenance region Z, maintenance unit 8 for executing head maintenance of recording head 2 is provided. On this maintenance unit 8, provided are suction device 81 for sucking the ink from nozzle surface 2*a* of recording head 2, cleaning blade 82, ink acceptor 83 and the like.

On suction device 81 provided are maintenance cap 85 for covering nozzle surface 2*a* with four pieces corresponding to the number of recording heads 2. Further, on bottom face of maintenance cap 85, provided is ejection pipe 86 communicated with inside of maintenance cap 85. At midstream of said discharge pipe 86, pump 87 is provided, and at the bottom end of discharge pipe 86, waste ink tank 88 for receiving the sucked ink is provided.

Near one end of maintenance cap 85, ink acceptor 83 for receiving the ejected ink in cases where ink is ejected in blank from nozzle surface 2*a* of recording head 2, and adjacently to ink receptor 83, blade 82 for wiping the ink attacked on nozzle surface 2*a* is provided.

Pump 87 is configured of a cylinder pump or a tube pump, and when activated in a state where absorption cap 81*a* covers nozzle surface 2*a*, suction force is generated for sucking the ink in recording head 2 together with foreign materials and air bubbles, from nozzle surface 2*a*.

(Moisturizing Unit)

As shown in FIG. 1, at another end in the moving area of carriage 3 against maintenance region Z across conveyance device 6, home position region X is formed. In home position region X, moisturizing unit 9 for moisturizing said recording head 2 is provided. On moisturizing unit 9, four pieces of moisturizing cap 91 is provided for moisturizing the ink in recording head 2 by covering nozzle surface 2*a* when recording head 2 us in a waiting state. These four pieces of moisturizing cap 91 are arranged, corresponding to the alignment of recording heads 2, to be able to concurrently cover nozzle surface 2*a* of four recording heads 2.

(Controller)

As shown in FIG. 4, in inkjet recording device 1, controller 10 is provided which controls the movement of carriage drive mechanism 31, motor 61 of conveyance device 6, recording head 2, heating device 5, maintenance unit 8, moisturizing unit 9, and power source 11. Controller 10 is provided with CPU10*a*, RAM10*b*, and ROM10*c*, and is connected via an interface (not illustrated) with carriage drive mechanism 31, motor 61 of conveyance device 6, recording head 2, heating device 5, maintenance unit 8, moisturizing unit 9, and power source 11.

Controller 10 controls carriage drive mechanism 31 and motor 61 of conveyance device 6 such that in addition to reciprocally moving carriage 3 in scanning direction 3, conveyance and stoppage of recording medium P are repeated to intermittently convey the recording medium in the conveyance direction in accordance with the movement of carriage 3.

Controller 10 controls to heat recording medium P by controlling power supply from power source 11 to heating device 5.

Controller 10 controls to cool cooling surface 72*a* in cooling device 70 to be the temperature lower than nozzle surface 2*a* of recording head 2, by controlling the power supply from power source 11 to Peltier device 73. Although it is possible to control the temperature of cooling surface to be a prescribed temperature by providing a temperature sensor on cooling surface 72*a* and controlling the power supply from power source 11, since by simply cooling said cooling surface 72*a*, the temperature of cooling surface can be lowered to be lower than a room temperature or the temperature of recording head 2, from the view point of generating the dew condensation of the ink vapor component, the temperature control is not necessarily required. When cooling surface 72*a* is cooled to the lower temperature, the dew condensation becomes the easier as the saturated vapor pressure decreases, which causes a large effect.

Controller 10 is connected with a host computer and a scanner to input image information, input section 12 configured with a key board to input an image recording condition and the like, and recording head 2. Controller 10 operates recording head 2 based on prescribed signals inputted from input section 12, and allows to eject ink on recording medium P to record a prescribed image.

In case of prescribed maintenance start conditions being fulfilled, at every time when a prescribed time period elapsed from power ON, or by a manual operation, controller 10 activates maintenance unit 8 to execute the head maintenance.

In case of waiting state being not the time of image formation or the time of maintenance, controller 10 controls moisturizing unit 9 to execute moisturizing operation by moisturizing cap 91.

<Recording Medium>

As recording medium P, various media such as paper, plastic, metal, cloth, and gum can be used. Among these media, preferable one as the inkjet recording media for forming a common image is paper or a plastic film. In the present embodiment, plastic film, resin coated paper, and synthetic paper exert good effects.

As the paper, plain paper, non-coated paper, and coated paper are usable. As the plastic commonly used films are usable. For example although there are polyester film, polyolefin film, polyvinyl chloride film, polyvinylidene chloride film, and the like, particularly preferable one is the polyvinyl chloride film. The resin coated paper is the one coated with resin layers on both sides of a paper base material. As a commonly known resin coated paper, there is a resin coated paper for photography which is coated on both surfaces of paper with polyethylene resin. As the synthetic paper, there are YUPO™ paper made by YUPO CORPORATION, CLISPER™ made by TOYOBO CO., LTD and the like.

Depending on the type of recording medium, there is a case where ink wetting property is bad. Specifically, the ink wetting property is bad with respect to plastic film, resin coated paper, and synthetic paper. In the present embodiment, the wetting property with respect to the ink is improved by preliminarily heating the recording medium to change its surface state.

Improvement of ink wetting property of recording medium is effectively performed for the plastic film, resin coated film and synthetic film. Particularly, polyvinyl chloride film is greatly improved in the wetting property.

In case of using the recording medium of polyvinyl chloride film having low ink absorption property as the recording medium P, the ink wetting property with respect to the surface of recording medium is improved by raising the surface temperature. Depending on the bland of recording medium made of polyvinyl chloride, there may be caused a difference in the wetting property or drying property of ink, and the surface temperature may be properly controlled according to the properties of recording medium.

AS specific examples of the recording media made of polyvinyl chloride, there are: SOL-371G, SOL-373M, SOL-4701 (up to here, made by BIGteQnos Corporation), gross vinyl chloride (made by System Graphi CO., LTD), KMS-VS, KMS-VST, KMS-VT (up to here, made by KIMOTO CO., LTD), J-CAL-HGX, J-CAL-YHG, J-CAL-WWWG (up to here, made by KYOSHO CO., LID), BUS MARK V400 F vinyl, LITEcal V-600F vinyl (up to here, made by FlEXcon CO., LTD), FR2 (made by HaNWHA JAPAN CO., LTD), LLBAU13713, LLSP20133 (up to here, made by SAKURAI CO., LTD), P370B, P400M (up to here, KANBOPRAS CO., LTD), S02P, S12P, S13P, S14P, S0022P, S24P, S34P, S27P (up to here, made by GRAFITYP LTD), P223RW, P224RW, P249ZW, P248LP (up to here, made by Ring Techs CO., LTD), LKG-19, LPA-70, LPE-248, LPM-45, LTG-11, Ltg-21 (up to here, made by SHINSEISHA CO., LTD), PM13023 (made by TOYO CORPORATION CO., LTD), NAPOLEONGROSS gross vinyl chloride (made by NIKI Inc.), JV-610, Y-111 (up to here, made by IKC CO., LID), NIJ-CAPVC, NIJ-SPVCGT (up to here, made by NITIE CO., LTD), 3101/H12/P4, 3104/H12/P4, 3104/H12/P4S, 9800/H12/P4, 3100H12/R2, 3101/H12/R2, 3104/H12/R2, 1445/H14/P3, 1438/One Way Vision (up to here, made by INTERCOAT CO., LTD), JT5129PM, JT5728P, JT5822P, JT5829P, JT5829R, JT5829PM, JT5829RM, JT5929PM (up to here, made by MACtac CO., LTD), MP11005, MP11900, MP12000, MP12001, MP11002, MP13000, MP13021, MP13500, MP13501 (up to here, made by AVERY CO., LTD), AM101G, AM501G, (up to here, made by GINICHI CO., LTD), FR2 (made by HANWHA JAPAN CO., LTD), AY-15P, AY-60P, AY-80P, DBSP137GGH, DBSP137GGL, (up to here, made by INSIGHT CO., LTD), SJT-V200, SJT-V400F-1 (up to here, made by HIRAOKA & CO., LTD), SpS-98, SPSM-98, SPSH-98, SVGL-137, SVGS-137, MD#-200, MD5-100, MD5-101M, MD5-105 (up to here, made by METAMARK CO., LTD), 640M, 641G, 641M, 3105M, 3105SG, 3162G, 3164G, 3164M, 3164XG, 3164XM, 3165G, 3165M, 3151SG, 3551G, 3551M, 3631, 3641M, 3651G, 3651M, 3651SG, 3951G, 3641M (up to here, made by ORAFOL CO., LTD), SVTL-HQ130 (made by LAMI CORPORATION INC.), SP300GWF, SPCLEARD vinyl (up to here, made by CATALINA CO., LTD), RM-SJR (made by RYOYO CO., LTD), Hi Lucky, New Lucky PVC (up to here, made by LG Electronics Inc.), SIY-110, SIY-310, SIY-320 (up to here, made by SEKISUI CHEMICAL CO., LTD), PRINT MI Frontlit, PRINT XL Light weight banner (up to here, made by Endutex CO., LTD), RIJET 100, RIJET 145, REJET 165 (up to here, made by RITRANA CO., LID), NM-SG, NM-SM (made by NICHIEI KAKOU CO., LTD), LTO3GS (made by LUKIO CO., LTD), Easy Print 80, Performance Print 80 (up to here, made by JetGraph CO., LTD), DSE 550, DSB 550, DSE 800G, DSE 802/137, V250WG, V300WG, V350VG (up to here, made by Hexis CO., LTD), Digital White 6005PE, 6010PE (up to here, made by Mutifix CO., LTD).

<Dehumidifying Operation by Cooling Device>

Next, an operation will be described in a case where the air in vicinity of recording head 2 is dehumidified by the use of cooling device 7.

In case of conveying recording medium P to just under recording head 2, controller 10 controls power source 11 to energize heating device 5 to heat recording medium being conveyed. Further, controller 10 controls power source 11 to energize Peltier device 73 to cool cooling section 72.

When recording medium P is conveyed to just under recording head 2, controller 10 allows recording head 2 to eject an ink droplet. The ink droplet ejected from nozzle surface 2*a* lands onto recording medium P to execute printing.

Here, since recording medium P has been heated, the volatile component of the ink vaporizes and drifts in vicinity of recording head 2. At this time, since cooling surface 72*a* of cooling device 70 has been cooled, the saturated vapor pressure is lower at cooling surface 72*a* of cooling device 70 than at nozzle surface 2*a* of recording head 2, the vapor of ink volatile component drifting near recording head 2 appears on cooling surface 72*a* as the dew condensation.

In this way, by allowing the vapor of ink volatile component drifting near recording head 2 to be dew condensed on cooling surface 72*a*, the air in vicinity of recording head 2 can be dehumidified. Further, since the temperature of cooling surface 72*a* is made lower than the temperature of nozzle surface 2*a* of recording head 2, the dew condensation is generated at cooling surface 72*a* of lower temperature, not being generated at nozzle surface 2*a* of recording head 2, which prevents clogging of nozzle surface 2*a* of recording head 2.

The dew condensation generated on cooling surface 72*a* is absorbed by absorption member 75, and is dried naturally or is externally ejected by being sucked by a pump.

<Function Effect>

As described above, according to inkjet recording device 1, by cooling the cooling surface 72*a* of cooling section 72 to be lower temperature than nozzle surface 2*a* of recording head 2, since the ink vapor is dew condensed onto cooling surface 72*a* that being in low temperature, the dew condensation is not generated on nozzle surface 2*a* of recording head 2.

Further, since cooling surface 72*a* is cooled not by natural heat release but by the effect of Peltier device 73, the dew generation on nozzle surface can be continuously prevented while Peltier device is energized.

Further, since the dehumidification near the recording head 2 can be performed without using a fan which has been conventionally used, disturbance of air flow is not generated, and degradation of print quality is not caused. Further, since cooling surface 72*a* is adjacent to recording head 2, heating device can be provided just under recording head 2, which makes the image quality degradation less likely. Furthermore, the drying of meniscus at nozzle surface 2*a* of recording head 2 is not caused.

Further, since cooling surface 72*a* of cooling device 72 is provided side by side with nozzle surface 2*a* of recording head 2 along scanning direction A (relative movement direction) of recording head 2, ink vapor which moves along with the air flow generated by the movement of the recording head is condensed and collected in at least one of before and after printing of the recording head 2, which enables effective dehumidification in the vicinity of the recording head.

Further, by disposing cooling surface 72*a* of cooling device 72 at downstream side in the scanning direction of recording head 2, the dew condensation is generated on cooling surface 72*a* before recording head 2 enters into the high humidity area of the ink vapor, thus generation of dew condensation on nozzle surface 2*a* of recording head 2 can be prevented. Since in the scanning type inkjet recording device, differently from the line type inkjet recording device where recording head 2 is fixed, the dew condensation is likely to be generated even at the leading recording head 2, in case of ejecting ink under a high humidity circumstance, vapor the volatile component of ink is likely to be dew condensed on nozzle surface 2*a*. In such case, the above mentioned alignment is preferable.

Further, by disposing the cooling devices 7 adjacent to the both ends of the side by side arrangement of the recording heads 2, the inkjet recording device is capable of coping with a case where the recording head 2 bi-directionally reciprocates. In this case, since the dew condensation can be generated on cooling surface 72*a* before and after the ink ejection, efficiency of humidification can be improved.

Further, in cases where the cooling surface 72*a* is disposed nearer to recording media P than the nozzle surface 2*a* of the recording head 2, the dew condensation may contact the recording media to pollute it, and in cases where the cooling surface 72*a* is disposed farther from the recording media P than the nozzle surface 2*a* of the recording head 2, since the dehumidification effect in vicinity of the recording head 2 is decreased, by configuring heights of the nozzle surface 2*a* of recording head 2 and the cooling surface 72*a* each from the recording medium P to be equal, the dehumidification effect can be exerted while pollution of the recording media P is prevented.

Further, by applying the lyophilic processing on the cooling surface 72*a*, since the dew condensation becomes wet and easy to spread on cooling surface 72*a*, the dew condensation can be prevented from trailing down or dropping from the cooling surface 72*a*, which enables to make the distance from the recording media P and the recording head 2 short to improve the image quality.

Further, by providing absorption member 75, since the dew condensation generated on the cooling surface 72*a* can be absorbed with the absorption member 75, a number of times of maintenance for the cooling surface 72*a* can be decreased. Further, since the dew condensation generated on the cooling surface 72*a* is absorbed by the absorption member 75 before dropping on the recording media P, pollution of the recording media P can be prevented.

Variant Example 1

Figure 5:
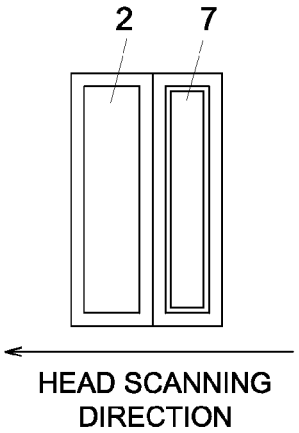
FIG. 5 is a plan view showing an example of arranging the cooling device at an upstream side with respect to a single recording head in the scanning direction of a recording head.

Alignment of the cooling device and a number of the provided cooling devices are not restricted to those of the above described embodiment. For example, as shown in FIG. 5, cooling device 7 may be arranged side by side with a single recording head 2 at upstream side in the scanning direction. In this case, the vapor of the volatile component of the ink generated from the landed ink on recording medium P can be dew condensed on cooling surface 72*a*, before scattering to the periphery of the landed ink position. In this case, only the peripheral area of the landed ink position being in high humidity, cooling surface 72*a* can easily generate the dew condensation.

Figure 6A:
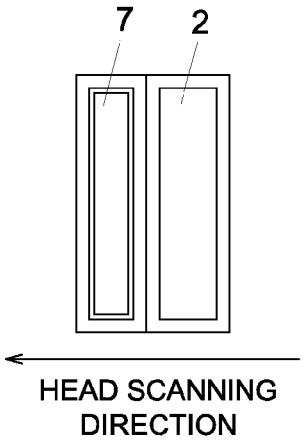
FIG. 6*a* is a plan view showing an example of arranging the cooling device at downstream side with respect to a single recording head in the scanning direction of a recording head.

As shown in FIG. 6*a*, cooling device 7 may be arranged side by side with a single recording head 2 at downstream side in the scanning direction.

In this case, before recording head 2 enters into the high humidity area of ink vapor, the dew condensation is generated on cooling surface 72*a*, thus generation of dew condensation on recording head 2 can be prevented.

Figure 6B:
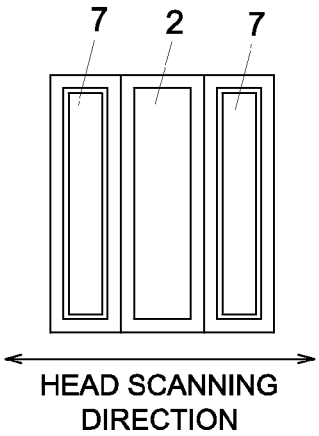
FIG. 6*b* is a plan view showing an example of arranging the cooling devices at downstream side and upstream side with respect to a single recording head in the scanning direction of a recording head.
Figure 6C:
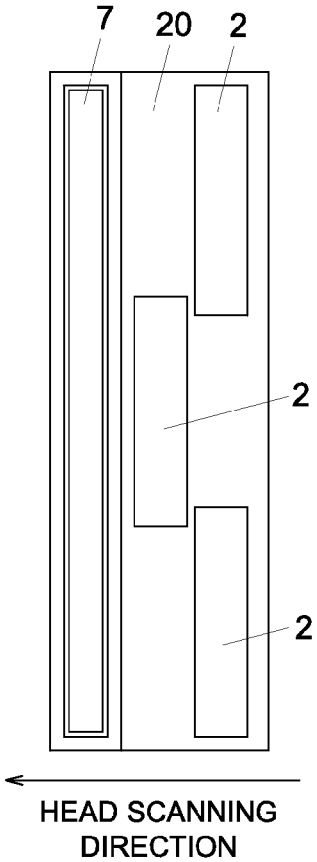
FIG. 6*c* is a plan view showing an example of arranging the cooling device at downstream side in the scanning direction of a recording head with respect to a head unit arranged with a plurality of recording head in zigzag alignment, and FIG. 6*d* a plan view showing an example of arranging the cooling devices at downstream side and upstream side in the scanning direction of a recording head with respect to a head unit arranged with a plurality of recording head in zigzag alignment.
Figure 6D:
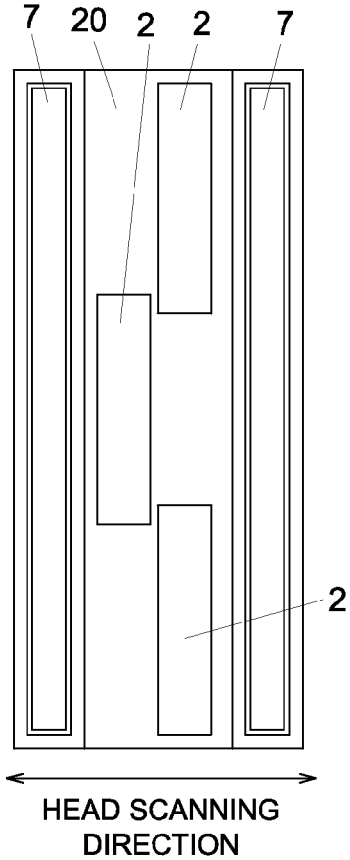

Further, as shown in FIG. 6*b*, cooling devices 7 may be arranged at both upstream and downstream sides in parallel to a single recording head 2 in the scanning direction.

In this case, by disposing the cooling devices 7 at both sides of the recording heads 2, the inkjet recording device is capable of coping with a case where the recording head 2 bi-directionally reciprocates. In this case, since the dew condensation can be generated on cooling surface 72*a* before and after the ink ejection, efficiency of humidification can be improved.

Further, as shown in FIGS. 6*a* and 6*b*, in cases where cooling device 7 is arranged with respect to head unit 20 arranged with a plurality of recording head in zigzag alignment, cooling device 7 may be provided at downstream side in the scanning direction. Similarly, cooling devices 7 may be provided at both upstream and downstream sides of head unit 20.

Figure 7A:
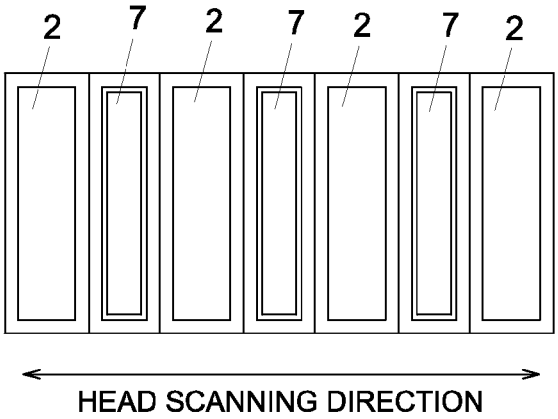
FIG. 7*a* is a plan view showing an example of arranging the cooling devices between adjacent recording heads with respect to a plurality of recording heads.

Further, as shown in FIG. 7*a*, in case of providing a plurality of recording heads 2, the cooling devices 7 may be arranged between adjacent recording heads 2.

In this case, although in the arranged recording heads 2, the head arranged at the upstream in the scanning direction tends to generate dew condensation due to ink vapor from the recording head 2 arranged at down stream in the scanning direction, by disposing the cooling surface 72*a* of the cooling device 2 between the adjacent heads, dew condensation is generated on said cooling surface 72*a*, which enables to prevent the generation of dew condensation on the nozzle surface 2*a* of the adjacent nozzle head 2.

Figure 7B:
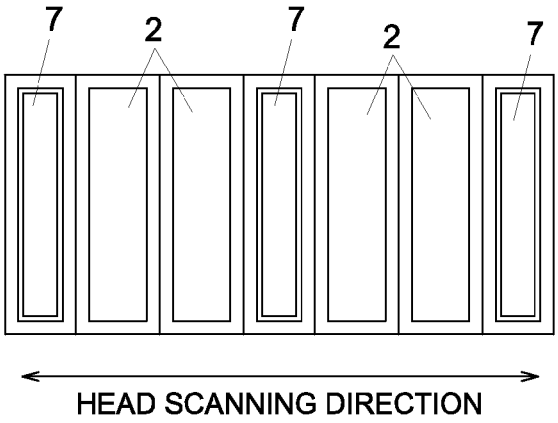
FIG. 7*b* is a plan view showing an example of arranging the cooling devices between adjacent recording heads and at both ends of a plurality of recording heads arranged on a line.

In this case, it is not necessary to arrange cooling device 7 at every space between the two adjacent recording heads 2. As shown in FIG. 7*b*, cooling device 7 may be arranged at every several recording heads.

Figure 8:
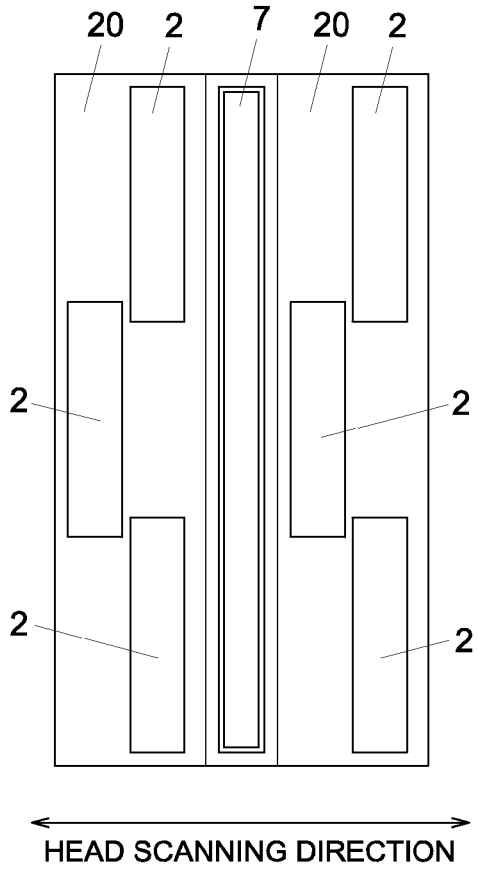
FIG. 8 a plan view showing an example of arranging a cooling device between adjacent recording head units with respect to a plurality of head units.

Further, as shown in FIG. 8, even incases where head units 20, each arranged with a plurality of recording heads 2 in zigzag arrangement, are disposed side by side in the scanning direction, cooling device 7 may be arranged between the adjacent head units 20.

Figure 9A:
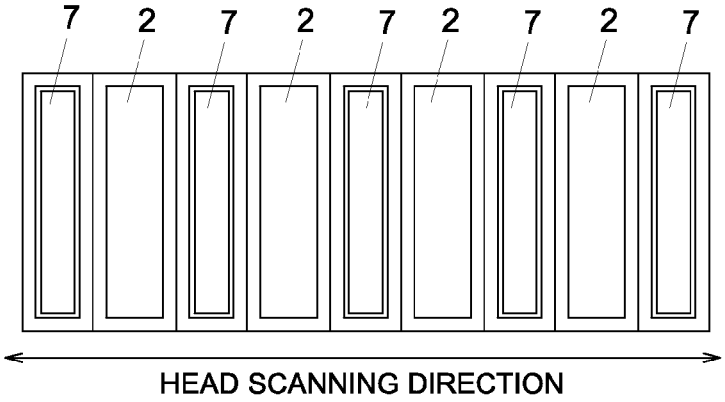
FIG. 9*a* is a plan view showing an example of arranging the cooling devices between adjacent recording heads and at both ends of recording heads arranged in line with respect to a plurality of recording heads.

Further, as shown in FIG. 9*a*, in cases where a plurality of recording heads 2 are arranged side by side in the scanning direction, cooling device 7 may be arranged between the adjacent recording heads 2 and at both ends of recording heads 2.

Figure 9B:
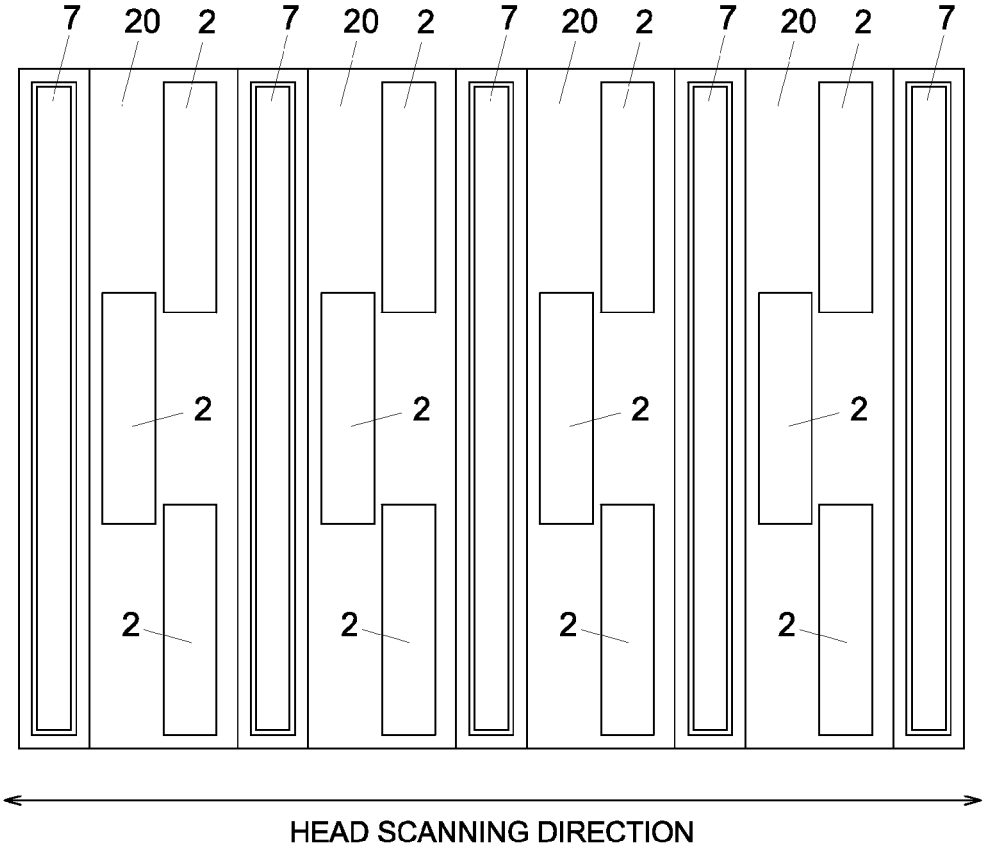
FIG. 9*b* is a plan view showing an example of arranging the cooling devices between adjacent head units and at both ends of head units with respect to a plurality of head units arranged on a line.

Further, as shown in FIG. 9*b*, even incases where head units 20, each arranged with a plurality of recording heads 2 in zigzag arrangement, are disposed side by side in the scanning direction, cooling device 7 may be arranged between the adjacent head units 20 and at both ends of head units in the parallel arranged direction.

Figure 10A:
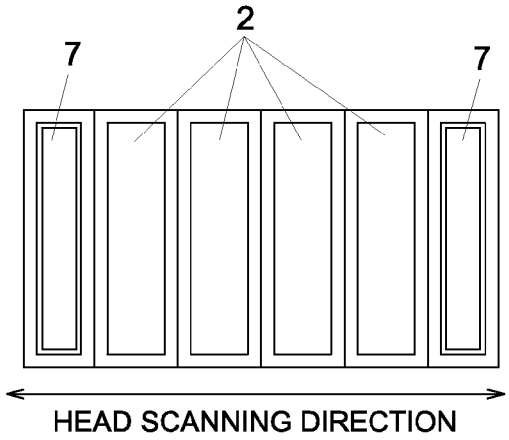
FIG. 10*a* is a plan view showing an example of arranging the cooling devices at both ends of recording heads with respect to a plurality of recording heads arranged on a line.

Further, as shown in FIG. 10*a*, in cases where a plurality of recording heads 2 are arranged side by side in the scanning direction, the cooling devices 7 may be arranged at both ends of recording heads 2 in the side by side arrangement direction.

Figure 10B:
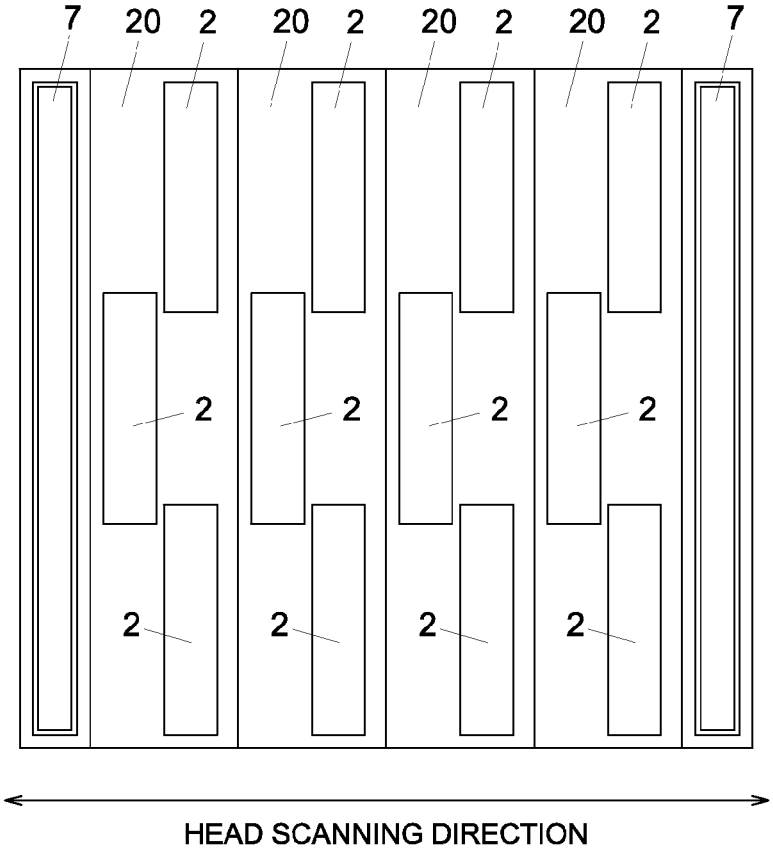
FIG. 10*b* is a plan view showing an example of arranging the cooling devices at both ends of head units in the parallel arranged direction with respect to a plurality of head units arranged on a line.

Further, as shown in FIG. 10*b*, in case where even incases where head units 20, each arranged with a plurality of recording heads 2 in zigzag arrangement, are disposed side by side in the scanning direction, cooling device 7 may be arranged at both ends of head units in the side by side arrangement direction.

Variant Example 2

In inkjet recording device 1, cooling device 7 is not restricted to the configuration of above mentioned first embodiment. For example, cooling device 7A shown in FIGS. 11 and 12 is also applicable.

Figure 12:
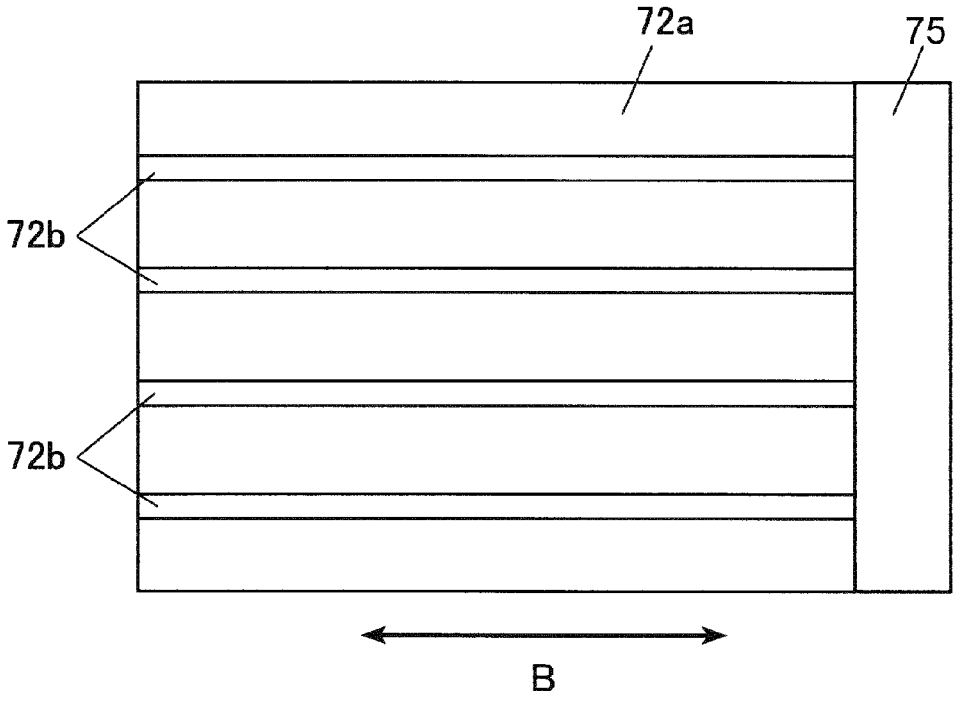
FIG. 12 is a bottom view of the cooling surface of the cooling device.

As shown in FIG. 12, on cooling surface 72*a*, a groove 72*b* is formed extending from one end toward the another end of cooling device 72 in the conveyance direction of recording medium P. A plurality of grooves 72*b* is formed parallel with each other, having a semicircular shape in cross-section view.

Figure 11:
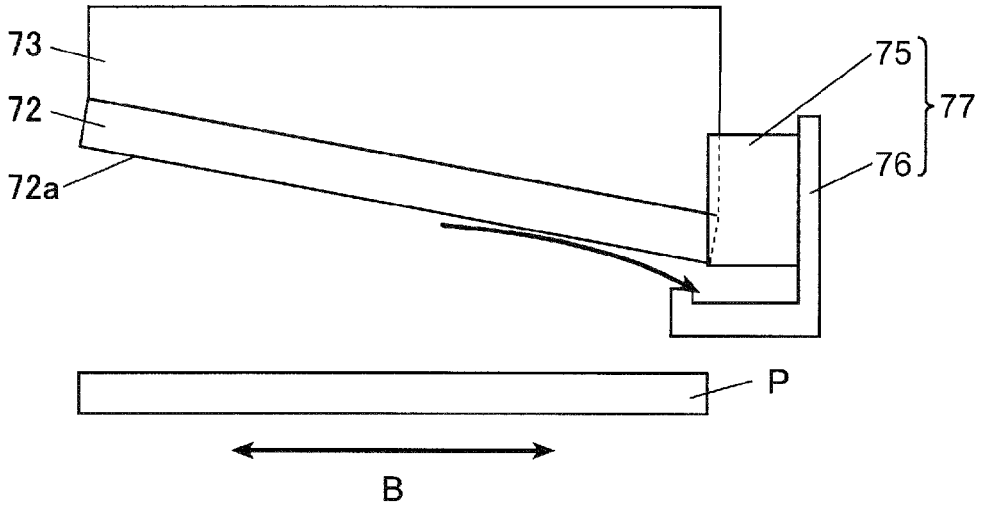
FIG. 11 is a side view of the cooling device viewing from a scanning direction of the recording head.

As shown in FIG. 11, Peltier device 73 is formed such that a surface contacting with cooling section 72 is slanted to be a slant surface to the horizontal surface. The slant surface is slanted downward (toward recording medium P) from one end of Peltier device 73 to another end in the conveyance direction of recording medium P.

Accordingly, cooling surface 72*b* of cooling section 72 contacting the bottom surface of Peltier device 73 becomes also a slant surface with respect to the horizontal surface.

A dew condensation collecting mechanism 77 is disposed down below the lowest position of the slant cooling surface 72*a*. Absorption member 75 is disposed so as to contact the end portion of groove 72*b*. Namely groove 72*b* is communicated with absorption member 75 of dew condensation collecting mechanism 77.

In order to be capable of absorbing the dew condensation accumulated on cooling surface 72*a*, absorption member 75 is disposed with protruding down below (side of recording medium P) the cooling surface 72*a*. Dew condensation absorbed by absorption member 75 may be dried with natural drying from absorption member 75, or may be dropped onto waste liquid collection tray 76 by squeezing, and waste liquid collection tray 76 is removed to be externally ejected.

Dew condensation generated on the cooling surface 72*a* moves with capillary action along the groove 72*b*, and by receiving gravity action, moves toward lower position to be collected in the dew condensation collecting mechanism 77 communicated with said groove 72*b*.

As described above, according to inkjet recording device 1 of variant example 2, since groove 72*b* is formed on cooling surface 72*a*, dew condensation generated on the cooling surface 72*a* moves with capillary action along the groove 72*b*, and is collected in the dew condensation collecting mechanism 77 communicated with groove 72*b*. Thus, the ink vapor in the vicinity of recording head 2 is liquidized by the cooling surface 72*a*, and the liquid is collected through the groove 72*b* into the dew condensation collecting mechanism 77.

Therefore, since the ink vapor floating in the vicinity of the recording head 2 is discharged to outside by the cooling device 7 having the cooling surface 72*a* formed with the groove 72*b* and dew condensation collecting mechanism 77, the dehumidification near the recording head 2 can be effectively performed. Further, since the dew condensation on cooling surface 72*a* is collected through the groove 72*b* of cooling surface 72*a* into the dew condensation collecting mechanism 77, few dew condensation remains on the cooling surface 72*b*, and the maintenance (wiping and the like) of the cooling surface 72*a* can be made unnecessary, or the number of times of maintenance for the cooling surface 72*a* can be reduced compared to a case of not forming the grove 72*b* on the cooling surface 72*a*.

Further, by forming the groove 72*b* on the cooling surface 72*a*, since the surface area of cooling surface 72*a* becomes large, the dehumidification efficiency near the recording head 2 can be improved.

Further, since the cooling surface 72*a* is configured to be an slant surface, the dew condensation moves downward due to a gravity force, and is collected into the dew condensation mechanism 77 positioned below the lowest position of the cooling surface. Thus, the dew condensation can be quickly and easily collected.

Further, by applying the lyophilic processing on the cooling surface 72*a*, since the condensed dew becomes wet and easy to spread on cooling surface 72*a*, the condensed dew can be prevented from trailing down or dropping from the cooling surface 72*a*, which enables to make the distance from the recording media P and the recording head 2 short to improve the image quality.

Further, since the dew condensation generated on the cooling surface 72*a* can be absorbed with the absorption member 75, a number of times of maintenance for the cooling surface 72*a* can be reduced. Further, since the dew condensation generated on the cooling surface 72*a* is absorbed by the absorption member 75 before dropping on the recording media, pollution of the recording media can be prevented.

Figure 18:
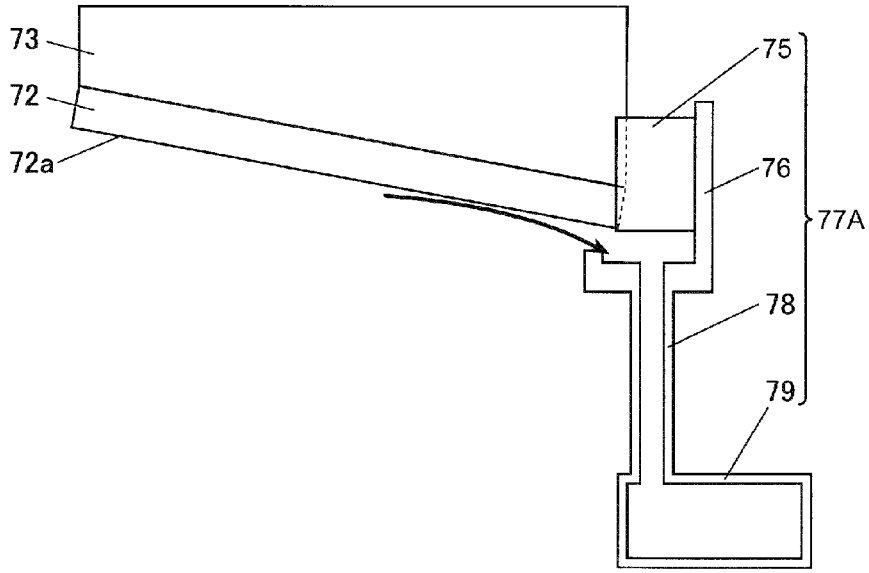
FIG. 18 is a side view of a variant example of dew condensation collecting mechanism viewing from the scanning direction of the recording head.
Figure 19:
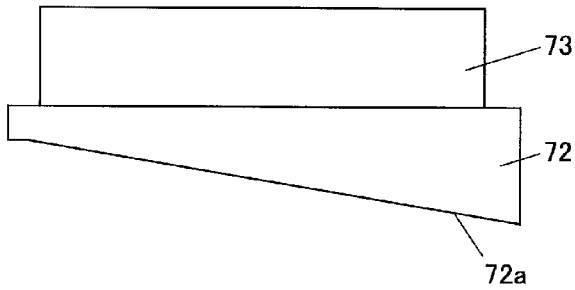
FIG. 19 is a side view of variant example of the dew condensation collecting mechanism viewing from the scanning direction of the recording head.

Although, in the above FIG. 11, dew condensation collecting mechanism 77 is provided with absorption member 75 and waste liquid collecting tray 76, as shown in FIG. 18, by providing discharge pipe 78 communicating with dew condensation collecting mechanism 77 at a bottom part of waste liquid collecting tray 76, the dew condensation collected from discharge pipe 78 may be directed to waste liquid tank 79 to be reserved. In this case, dew condensation collecting mechanism 77A is configured with absorption member 75, waste liquid collecting tray 76, discharge pipe 78 and waste liquid tank 79.

Although in the abovementioned FIG. 11, in Peltier device 73, the contact surface with cooling section 72 is formed to be a slant surface against the horizontal surface, cooling surface 72*a* of cooling device 72 by itself may be made to be a slant surface against the horizontal surface.

Variant Example 3

Figure 13:
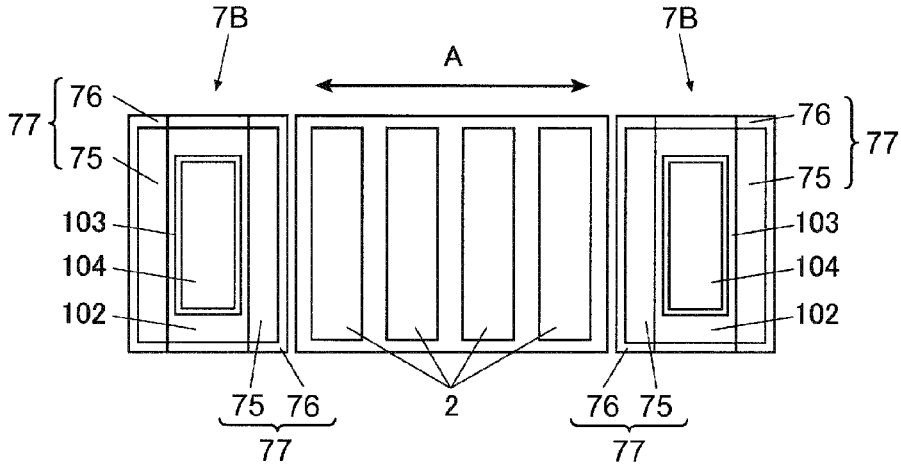
FIG. 13 is a plan view showing an example of arranging the cooling devices at both ends of the plurality of recording heads in the parallel arranged direction.
Figure 16:
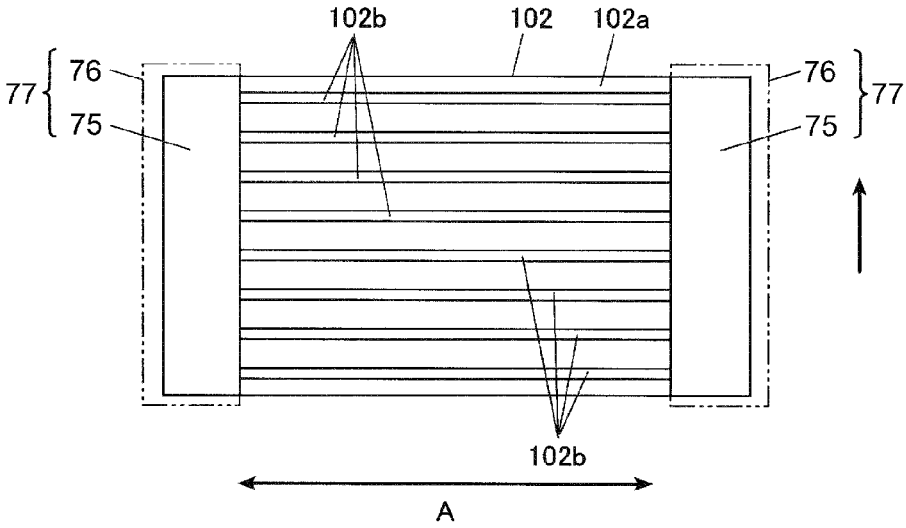
FIG. 16 is a bottom view of the cooling surface of the cooling device shown in FIG. 14.
Figure 17A:
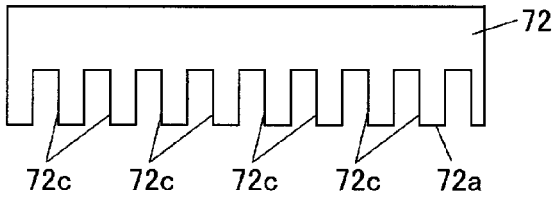
FIGS. 17*a*-17*c* are cross-section views of variant examples of grooves.
Figure 17B:
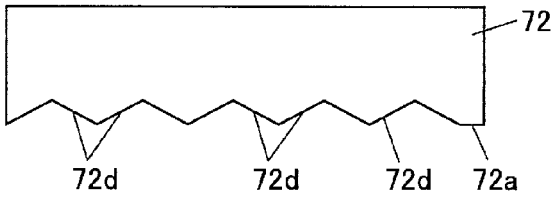
Figure 17C:
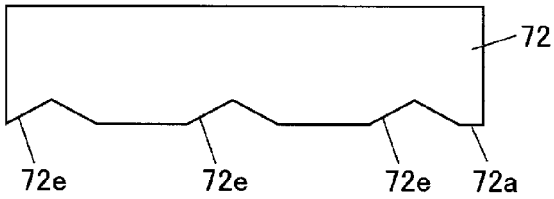

In inkjet recording device 1, cooling device 7 is not restricted to the configuration of above mentioned first embodiment. For example, cooling device 7B shown in FIGS. 13 and 16 is also applicable.

As shown in FIGS. 13-16, cooling device 7B is provided at both sides in scanning direction A of recording head 2. Cooling device 7B is provided with supporting section 101 which being a basis, and cooling section 102 is provided on said supporting section 101.

Cooling section 102 is, for example, made of a metal plate and the like. Specifically, by forming cooling section 102 with a high thermal conductivity metal plate such as stainless steel (SUS), aluminum, copper, iron and the like, cooling efficiency around recording head 2 can be enhanced. Further, by utilizing a compact and low-cost metal plate, cost reduction can be achieved.

Cooling section 102 is installed on supporting section 101 in the state of heat insulation from recording head 2. Since cooling section 102 is installed on supporting section 101, only supporting section 101 is required to be a heat insulation material.

As the heat insulation material, materials of inorganic fiber, foamed plastic, natural fiber and the like are preferable. Further it is preferable to dispose nozzle surface 2*a* of recording head 2 and cooling surface 102*a* so as not be thermally affected with each other.

Cooling section 102 is disposed such that its bottom surface faces recording medium P. The bottom surface of cooling section 102 is made to be cooling surface 102*a* which cools air containing vapor of ink component in the vicinity of recording head 2.

Figure 14:
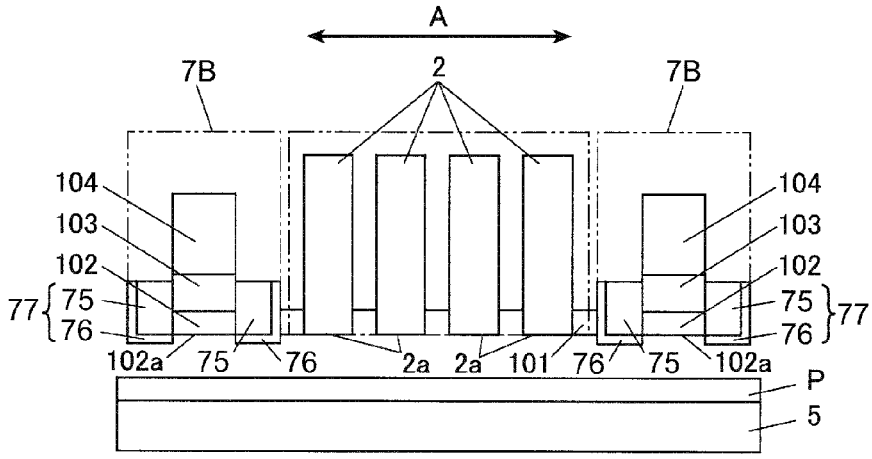
FIG. 14 is an elevation view showing an example of arranging the cooling devices at both ends of the plurality of recording heads in the parallel arranged direction.
Figure 15:
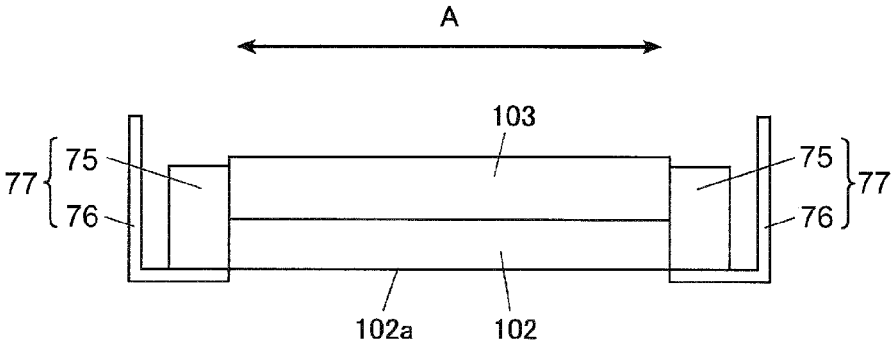
FIG. 15 is an elevation view of partly enlarged cooling device of FIG. 14.

Cooling section 102 is disposed such that said cooing surface 102*a* is arranged side by side with recording head 2 along the scanning direction A. Specifically, as shown in FIGS. 13 and 14, cooling device 7B is disposed at both end sides in the arranged direction of four recording heads 2 arranged side by side.

Cooing section 102 is provided with recording head 2 such that a height of the cooling surface 102*a* and a height of the nozzle surface 2*a* of the recording head 2 each from the upper surface of recording medium P are made to be equal.

On cooling surface 102*a*, a groove 102*b* is formed extending from one end toward another end in the scanning direction A of recording head 2. A plurality of grooves 102*b* is formed parallel with each other, and each end portion being communicated with dew condensation collecting mechanism 77 provided at one end and the other end in the scanning direction of recording head 2.

The cooling surface 102*a* is applied of a lyophilic processing. This is a measure to make the dew condensation on cooling surface 102*a* hardly drops on recording medium P. As the lyophilic processing, coating of commercially available organic or inorganic hydrophilic coating material, photocatalytic titanium-oxide coating material on cooling surface 102*a*, and application of plasma processing on cooling surface 102*a* can be cited.

In the present embodiment, a stainless steel plate is used as cooling section 102, and a commercially available inorganic hydrophilic coating material is coated on its cooling surface 102*a*.

On an upper surface of the cooling section 102, Peltier device 103 is provided in contact state with cooling section 102 as a cooling body for cooling said cooling section 102. Here, Peltier device 103 is applied with electric current by power source 11 (see FIG. 4), and bottom end part of Peltier device 103 contacting to cooling section 102 becomes low temperature and heat is radiated from the upper end portion.

On the upper surface of Peltier device 103, heat radiation section 104 to release heat accumulated at the upper end area of Peltier device 103 is provided in contact state with Peltier device 103. Heat radiation section 104 is configured with a metal heatsink. Further, the upper end portion of Peltier device 103 may be exposed to outer air for natural heat radiation, or may be enhanced of cooling by exposing to the wind of a radiator fan.

Cooling section 102 and Peltier device 103 may be formed in one body. Namely, the cooling surface of Peltier device 103 may be made as the surface for attaching the dew condensation. As the cooling body, a water-cooling system for cooling the cooling surface with cooled water, or an air-cooling system for cooling the cooling surface with cooled air may be applicable, however, the cooling system for cooling said cooling surface 102*a* with Peltier device 103 is preferable. By using Peltier device 103 as the cooling body, a compact inkjet recording device with reduced cost can be realized. By a control of voltage to be applied to Peltier device 103, temperature control of cooling surface 102*a* is possible, and further, by using a plurality of stacked Peltier device 103, the cooling ability can be remarkably enhanced.

On cooling section 102, dew condensation collecting mechanism 77 for collecting the dew condensation attached and accumulated on cooling surface 102*a* is provided at both ends in the scanning direction A of recording head 2.

Dew condensation collecting mechanism 77 is arranged along the scanning direction A of recording head 2 so as to sandwiching cooling section 102. Since recording head 2 moves by reciprocating in the scanning direction A of recording head 2, this alignment is adopted for collecting the dew condensation in either moving directions of recording head 2.

Dew condensation collecting mechanism 77 is provided with absorption member 75 for absorbing the dew condensation accumulated on cooling surface 102*a* and waste liquid collection tray 76 for reserving the dew condensation collected by absorption member 75.

As absorption member 75, a sponge material such as a porous material, a fiber material of felt and the like, or a material blended with high molecular polymer can be utilized.

Absorption member 75 is provided on liquid collection tray 76 fixed on cooling section 102, and the waste liquid, which being collection of the dew condensation absorbed by absorption member 75, can be collected from waste liquid collection tray 76.

In order to absorb the dew condensation accumulated on cooling surface 102*a*, absorption member 75 is disposed to protrude at lower side (the side of recording medium P) than cooling surface 102*a*. The dew condensation absorbed by absorption member 75 may be evaporated from absorption member by natural drying, or may be accumulated in waste liquid collection tray 76 by squeezing, and waste liquid collection tray 76 is removed to be externally ejected.

As described above, according to variant example 3 of inkjet recording device 1, since dew condensation collecting mechanism 77 is provided at both end portions in the scanning direction of recording head 2, the inertial force is exerted along the moving direction on recording head 2 also to the dew condensation attached on cooling surface 102*a*. Accordingly, the dew condensation is moved along groove 102*b* and collected by dew condensation collecting mechanism 77. Thus, the dew condensation can be quickly and easily collected.

Further, since groove 102*b* of cooling surface 102*a* is formed along the scanning direction A of recording head 2, the direction of inertial force caused by the movement of recording head and the forming direction of groove 102*b* coincide to enable easy movement of the dew condensation along groove 102*b*.

Further, since this is configured such that the dew condensation is allowed to be collected via groove 102*b* to dew condensation collecting mechanism 77, by use of the inertial force caused at the time of scanning of recording head 2, a height of cooling surface 102*a* of cooling section 102 and a height of nozzle surface 2*a* of recording head 2 can be made equal. Specifically, although if cooling surface 102*a* is nearer to recording medium P than nozzle surface 2*a* of recording head 2, the dew condensation may likely contact and pollute said recording medium P, and if cooling surface 102*a* is farther to recording medium P than nozzle surface 2*a* of recording head 2, the dehumidification effect near recording head 2 may be weakened, by making the heights of cooling surface 102*a* of cooling section 102 and nozzle surface 2*a* of recording head 2 identical, the pollution of recording medium P is prevented and also the dehumidification effect near recording head 2 can be ensured.

The shape of groove 72*b* is not restricted to the above described semicircle, but may be groove 72*c* of rectangular shape in cross-section, may be groove 72*d* of consecutive angle shape in cross-section, or may be groove 72*e* of intermittent angle shape in cross-section.

Variant Example 4

In inkjet recording device 1, cooling device 7 is not restricted to the configuration of above mentioned first embodiment. For example, cooling device 7C shown in FIGS. 20-23 is also applicable.

Figure 20:
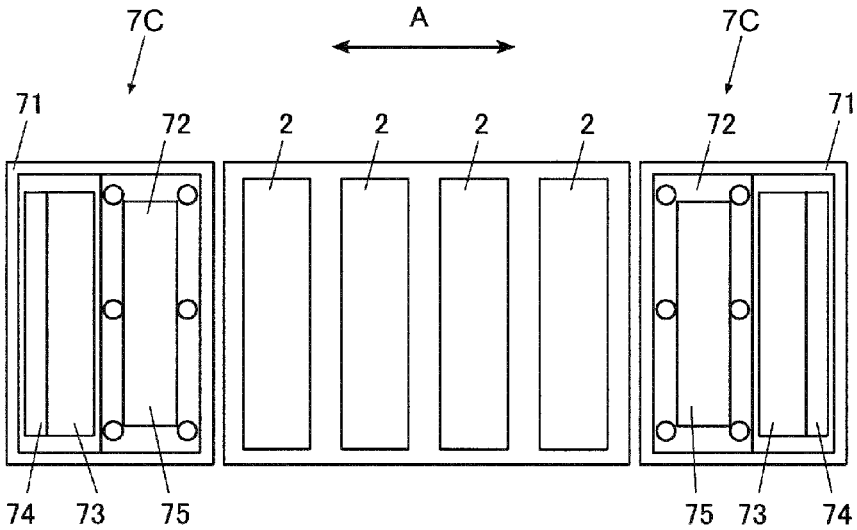
FIG. 20 is a plan view illustrating an arrangement of the recording head and the cooling device.
Figure 21:
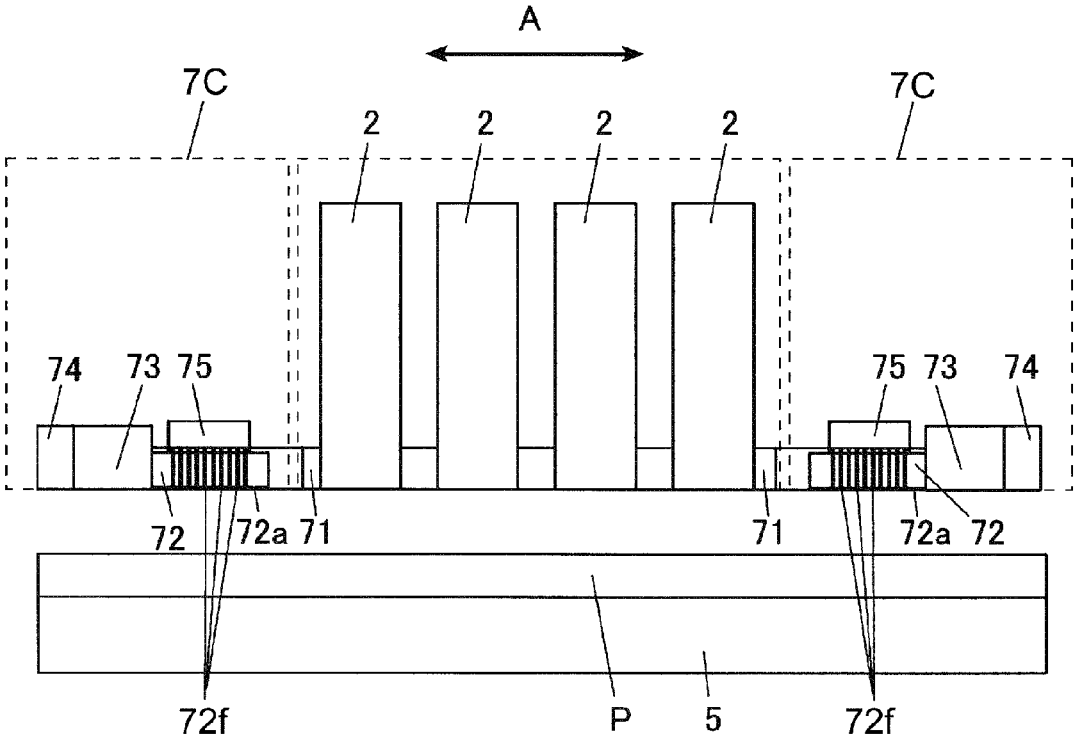
FIG. 21 is an elevation view illustrating an arrangement of the recording head and the cooling device.

As shown in FIGS. 20 and 21, cooling device 7C is provided with supporting section 71 which being a basis, and cooling section 72 is provided on said supporting section 71.

Cooling section 72 is, for example, made of a thermally conductive metal plate and the like. Specifically, by forming cooling section 102 with a high thermal conductivity metal plate such as stainless steel (SUS), aluminum, copper, iron and the like, cooling efficiency around recording head 2 can be enhanced. Further, by utilizing a compact and low-cost metal plate, cost reduction can be achieved.

Cooling section 72 is installed on supporting section 71 in the state of heat insulation from recording head 2. Since cooling section 72 is installed on supporting section 71, only supporting section 71 is required to be a heat insulation material.

As the heat insulation material, materials of inorganic fiber, foamed plastic, natural fiber and the like are preferable. Further it is preferable to dispose nozzle surface 2*a* of recording head 2 and cooling surface 72*a* so as not be thermally affected with each other.

Cooling section 102 is disposed such that its bottom surface faces recording medium P. The bottom surface of cooling section 72 is made to be cooling surface 72*a* which cools air containing vapor of ink component in the vicinity of recording head 2.

Cooling section 72 is disposed such that said cooing surface 72*a* is arranged in parallel with recording head 2 along the scanning direction A. Specifically, as shown in FIG. 20, cooling section 72 is disposed at both end sides in the arranged direction of four recording heads 2 arranged side by side. Cooling section 72 is formed in a plate shape, and a thickness of the plate is preferably at least more than 1 mm.

Figure 22:
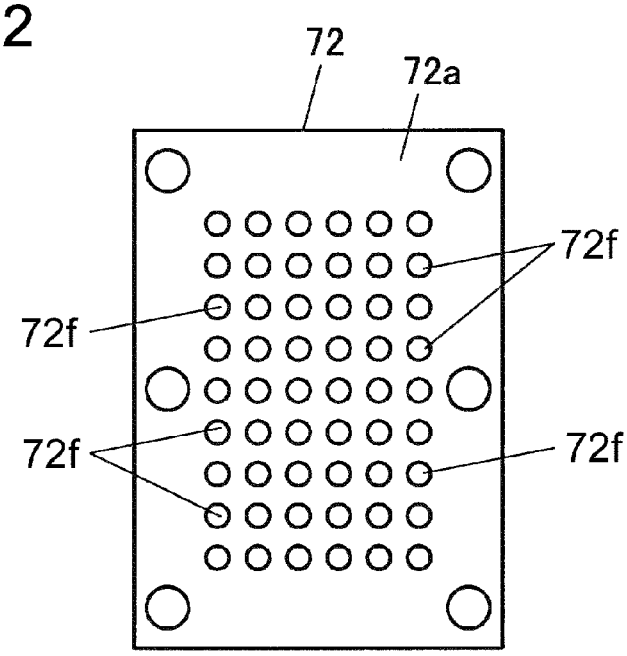
FIG. 22 is a bottom view of the cooling surface of the cooling device.
Figure 23:
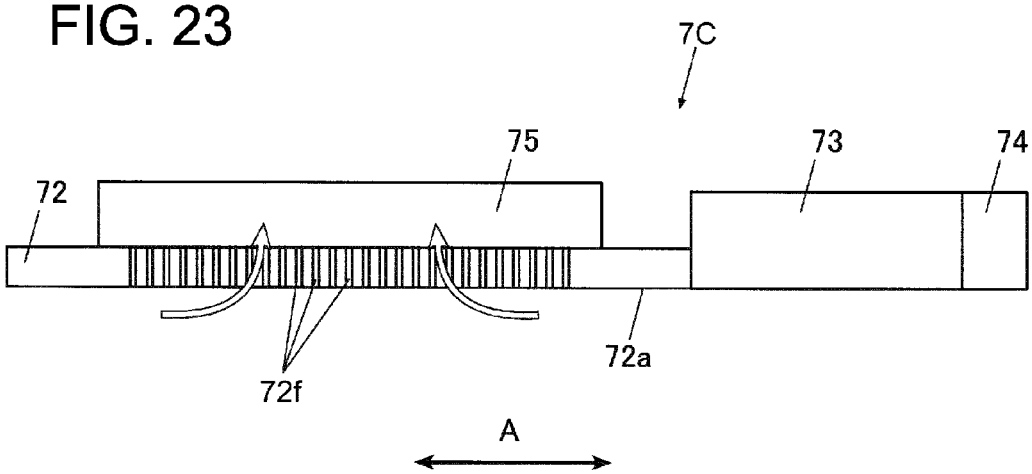
FIG. 23 is a side view of the cooling device viewing from the scanning direction of the recording head.

As shown in FIGS. 21 and 22, in cooling section 72, a plurality of holes 72*f* are formed penetrating from cooling surface 72*a* of a bottom surface to a top surface. As shown in FIG. 22, each of holes 72*f* is formed in equally-spaced rectangular arrangement. Each hole is formed in equal size to each other and having a circle at least more than 0.1 mm diameter in section. Holes 72*f* penetrate from cooling surface 72*a* to the top surface of cooling section 72 The hole to be formed in cooling section 72 is not restricted to be the plurality of holes, but may be a single hole having relatively a large diameter. However, in order to maximally utilize the effect of capillary action, forming the plurality of holes 72*f* as shown in FIG. 22 is more preferable.

Further, not only by forming the plurality of holes 72*f* on cooling surface 72*a*, the surface area of cooling surface 72*a* may be increased by forming the surface in reticulated structure. By increasing the surface area of cooling surface 72*a*, the dehumidification effect near recording head 2 can be improved.

Cooing section 72 is provided such that a height of the cooling surface 102*a* and a height of the nozzle surface 2*a* of the recording head 2 are made to be equal each from recording medium P conveyed by conveyance device 6.

The cooling surface 72*a* is applied of a lyophilic processing. This is a measure to make the dew condensation on cooling surface 72*a* hardly drops on recording medium P. As the lyophilic processing, coating of commercially available organic or inorganic hydrophilic coating material, photocatalytic titanium-oxide coating material on cooling surface 72*a*, and application of plasma processing on cooling surface 72*a* can be cited.

In the present embodiment, a stainless steel plate is used as cooling section 72, and a commercially available inorganic hydrophilic coating material is coated on its cooling surface 72*a*.

On an upper surface of the cooling section 72, Peltier device 73 is provided in contact state with cooling section 72 as a cooling body for cooling said cooling section 72. Peltier device 73 is provided side by side with cooling section 72 in the scanning direction A of recording head 2.

Peltier device 73 is applied with electric current by power source 11 (see FIG. 4), and contacting part of Peltier device 73 to cooling section 102 becomes low temperature and heat is radiated from the opposite end part to the contacting part.

On Peltier device 73 at the opposite end to the contacting part with cooling section 72, heat radiation section 74 to release heat accumulated in Peltier device 73 is provided in contact state with Peltier device 73. Heat radiation section 74 is configured with a metal heatsink. Further, the upper end portion of Peltier device 73 may be exposed to outer air for natural heat radiation, or may be enhanced of cooling by exposing heat radiation section 74 (heatsink) to the wind of a radiator fan.

Cooling section 72 and Peltier device 73 may be formed in one body. Namely, the cooling surface of Peltier device 73 may be made as the surface for attaching the dew condensation. As the cooling body, a water-cooling system for cooling the cooling surface with cooled water, or an air-cooling system for cooling the cooling surface with cooled air may be applicable, however, the cooling system for cooling said cooling surface 72*a* with Peltier device 73 is preferable. By using Peltier device 73 as the cooling body, a compact inkjet recording device with reduced cost can be realized. By a control of voltage to be applied to Peltier device 103, temperature control of cooling surface 72*a* is possible, and further, by using a plurality of stacked Peltier device 73, the cooling ability can be remarkably enhanced.

On upper end surface of cooling section 72, dew absorption member 75 for collecting the dew condensation attached and accumulated on cooling surface 72*a* is provided.

As absorption member 75, a sponge material such as a porous material, a fiber material of felt and the like, or a material blended with high molecular polymer can be utilized.

Absorption member 75 is provided so as to contact with an upper opening portion of holes 72*f* formed on cooling section 72. Namely by existence of holes 72*a*, penetration is established from cooling surface 72*a* of cooling section 72 to absorption member 75.

The dew condensation absorbed by absorption member 75 may be evaporated from absorption member 75 by natural drying, or may be dropped and accumulated in waste liquid collection tray (unillustrated) by squeezing, and the waste liquid collection tray is removed to be externally ejected.

The dew condensation generated on cooling surface 72*a* moves with the capillary force along walls of holes 72*f*, and is absorbed by absorption member 75 communicated with holes 72*f*.

<Function Effect>

As described above, according to inkjet recording device 1 provided with cooling device 7C, since on cooling section 72, holes 72*f* are formed penetrating from cooling surface 72*a* to absorption member 75, dew condensation generated on cooling surface 72*a* moves with the capillary force along inside walls of holes 72*f*, and is absorbed by absorption member 75 communicated with holes 72*f*. Thus, the ink vapor in the vicinity of recording head 2 is liquidized by the cooling surface 72*a*, and the liquid is absorbed through holes 72*f* into absorption member 75. By this, the dew condensation is made hardly drop onto the recording media P.

Therefore, since the ink vapor floating in the vicinity of the recording head is discharged to outside by the cooling device 72C having the cooling section 72 formed with the holes 72*f* and the absorption member 75, the dehumidification near the recording head 2 can be effectively performed. Further, since the dew condensation is collected through the hole 72*f* into the absorption member 75, few dew condensation remains on the cooling surface 72*a*, and the maintenance (wiping and the like) of the cooling surface 72*a* can be made unnecessary, or the number of times of maintenance for the cooling surface 72*a* can be decreased compared to a case of not forming the hole 72*f* on the cooling section 72.

Further, by forming the holes 72*f* on the cooling section 72, since the surface area of cooling surface 72*a* becomes large, the dehumidification efficiency near the recording head 2 can be improved.

Since if cooling surface 72*a* is nearer to recording medium P than nozzle surface 2*a* of recording head 2, the dew condensation may likely contact and pollute said recording medium P, and if cooling surface 72*a* is farther to recording medium P than nozzle surface 2*a* of recording head 2, the dehumidification effect near recording head 2 may be weakened, by making the heights of cooling surface 72*a* and nozzle surface 2*a* of recording head 2 identical, the pollution of recording medium P is prevented and also the dehumidification effect near recording head 2 can be ensured.

Further, by applying the lyophilic processing on the cooling surface 72*a*, the dew condensation can be prevented from trailing down or dropping from the cooling surface 72*a*, which enables to make the distance from the recording media P and the recording head 2 short to improve the image quality.

Variant Example 5

In inkjet recording device 1, cooling device 7 is not restricted to the configuration of above mentioned first embodiment. For example, cooling device 7D shown in FIGS. 24-28 is also applicable.

Figure 24:
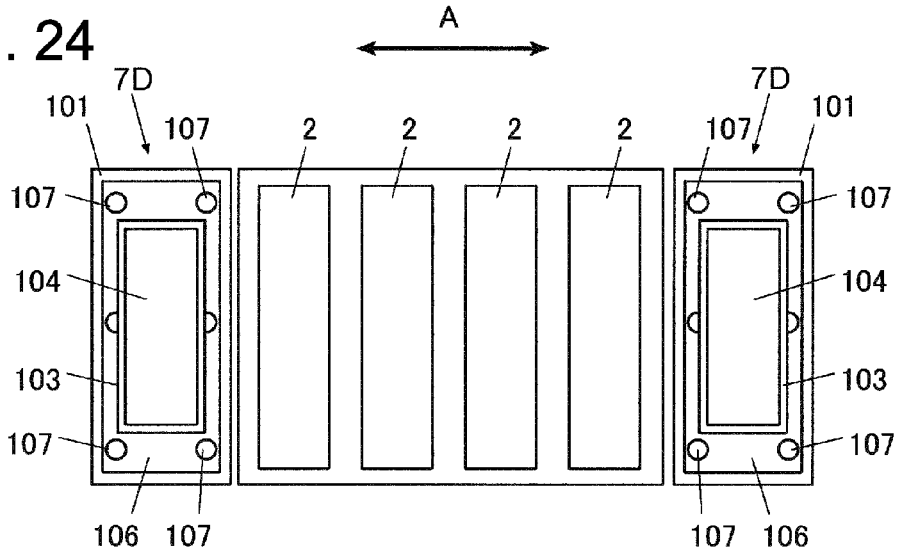
FIG. 24 is a plan view illustrating an example of arranging the cooling devices at both ends of the plurality of recording heads in the parallel arranged direction.
Figure 25:
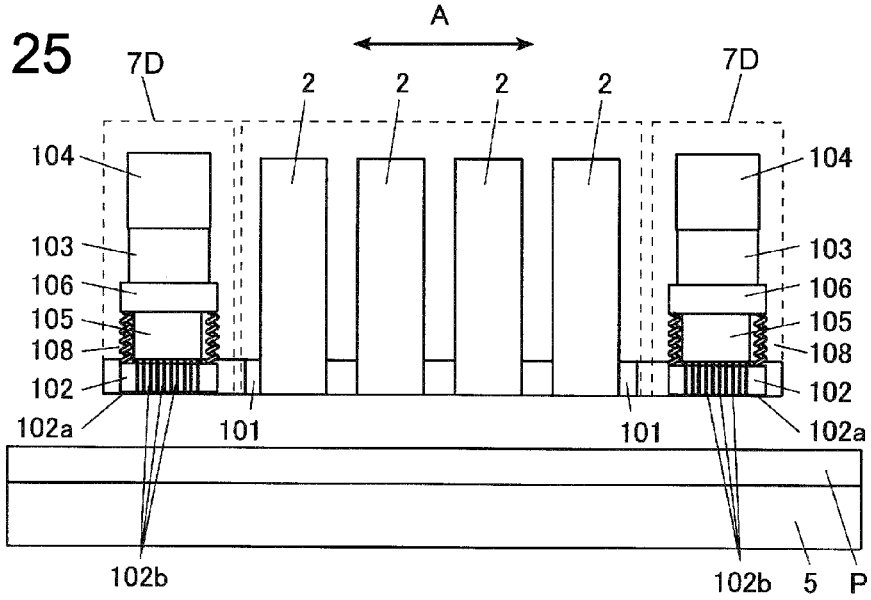
FIG. 25 is an elevation view illustrating an example of arranging the cooling devices at both ends of the plurality of recording heads in the parallel arranged direction.

As shown in FIGS. 24 and 25, cooling device 7D is provided with supporting section 101 which being a basis, and cooling section 102 is provided on said supporting section 101.

Cooling section 102 is, for example, made of a thermally conductive metal plate and the like. Specifically, by forming cooling section 102 with a high thermal conductivity metal plate such as stainless steel (SUS), aluminum, copper, iron and the like, cooling efficiency around recording head 2 can be enhanced. Further, by utilizing a compact and low-cost metal plate, cost reduction can be achieved.

Cooling section 102 is installed on supporting section 101 in the state of heat insulation from recording head 2. Since cooling section 102 is installed on supporting section 101, only supporting section 71 is required to be a heat insulation material.

As the heat insulation material, materials of inorganic fiber, foamed plastic, natural fiber and the like are preferable. Further it is preferable to dispose nozzle surface 2*a* of recording head 2 and cooling surface 102*a* so as not be thermally affected with each other.

Cooling section 102 is disposed such that its bottom surface faces recording medium P. The bottom surface of cooling section 102 is made to be cooling surface 102*a* which cools air containing vapor of ink component in the vicinity of recording head 2.

Cooling section 102 is disposed such that said cooing surface 102*a* is arranged side by side with recording head 2 along the scanning direction A. Specifically, as shown in FIG. 24, cooling section 102 is disposed at both end sides in the arranged direction of four recording heads 2 arranged side by side. Cooling section 102 is formed in a plate shape, and a thickness of the plate is preferably at least more than 1 mm.

As shown in FIG. 25, in cooling section 102, a plurality of holes 102*b* are formed penetrating from cooling surface 102*a* of a bottom surface to a top surface. Similarly to variant example 4 (see FIG. 22), each of holes 102*b* is formed in equally-spaced rectangular arrangement Each of holes 102*b* is formed in equal size to each other and having a circle at least more than 0.1 mm diameter in section. By holes 102*b* from cooling surface 102*a* to the top surface of cooling section 102 is penetrated. The hole to be formed in cooling section 102 is not restricted to be the plurality of holes, but may be a single hole having relatively a large diameter. However, in order to maximally utilize the effect of capillary action, forming the plurality of holes 102*b* is more preferable.

Further, not only forming the plurality of holes 102*b* on cooling surface 102*a*, the surface area of cooling surface 102*a* may be increased by forming the surface in reticulated structure. By increasing the surface area of cooling surface 102*a*, the dehumidification effect near recording head 2 can be improved.

Cooing section 72 is provided such that a height of the cooling surface 102*a* and a height of the nozzle surface 2*a* of the recording head 2 are made to be equal each from recording medium P conveyed by conveyance device 6.

The cooling surface 102*a* is performed of a lyophilic processing. This is a measure to make the dew condensation on cooling surface 102*a* hardly drops on recording medium P. As the lyophilic processing, coating of commercially available organic or inorganic hydrophilic coating material, photocatalytic titanium-oxide coating material on cooling surface 102*a*, and application of plasma processing on cooling surface 102*a* can be cited.

In the present embodiment, a stainless steel plate is used as cooling section 102, and a commercially available inorganic hydrophilic coating material is coated on its cooling surface 102*a*.

On upper end surface of cooling section 102, dew absorption member 105 for absorbing the dew condensation attached and accumulated on cooling surface 102*a* is provided.

As absorption member 105, a sponge material such as a porous material, a fiber material of felt and the like, or a material blended with high molecular polymer can be utilized. Absorption member 105 is provided so as to contact with an upper opening portion of holes 102*b* formed on cooling section 102. Namely by existence of holes 102*b*, penetration is established from cooling surface 102*a* of cooling section 102 to absorption member 105.

On upper end surface of absorption member 105, holding member 106 is provided which holds the absorption member 105 by sandwiching between the holding member 106 and the cooling section 102.

Holding member 106 is formed with a metal plate having relatively high thermal conductivity among thermal conductive materials such as stainless steel (SUS), aluminum, cupper, or iron.

Figure 26:
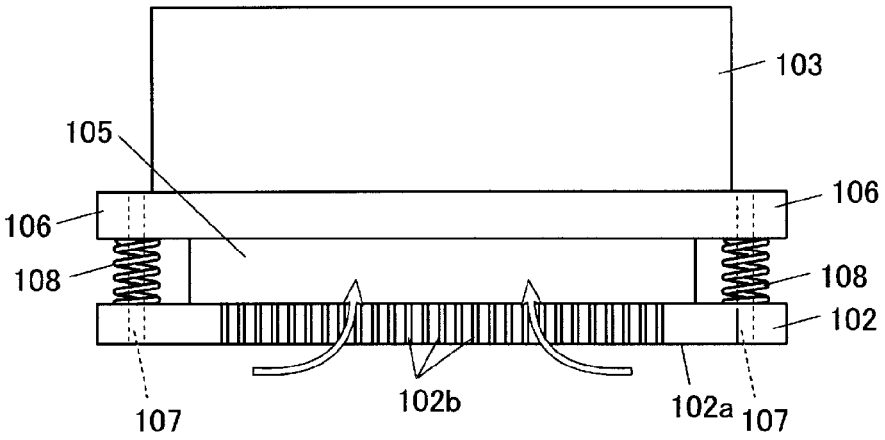
FIG. 26 is an elevation view illustrating the enlarged periphery of the cooling device of FIG. 25.

On holding member 106, six supporting rods 107 are fixed to extend downward in the periphery, as shown in FIG. 26.

On each supporting rod 107, coil spring 108 as an elastic member is coaxially mounted, the upper end of coil spring is connected to holding member 106, and the bottom end of coil spring 108 is connected to cooling section 102. Therefore, coil spring 108 functions as a connecting member.

Further, since cooling section 102 and holding member 106 are connected by coil spring 108 which expands and contracts with elastic deformation, the distance between cooling section 102 and holding member 106 is variable according to expansion/contraction amount of coil spring 108.

Supporting rod 107 and coil spring 108 are made of a metal plate having relatively high thermal conductivity among thermal conductive materials such as stainless steel (SUS), aluminum, cupper, or iron.

Cooling section 102 stays stable in position in a state where coil spring 108 is slightly extended from a natural length by the weight of cooling section 102. The bottom end of supporting rod is inserted in cooling section 102, and cooling section 102 is vertically freely movable. Thus, supporting rod 107 becomes a guide when cooling section 102 vertically moves.

Here, the distance between holding member 106 and cooling section 102 equals to the height of absorption member 105 when cooling section 102 is at a stable position in the state that coil spring 108 is expanded by the weight of cooling section 102. Namely, when holding member 106 and cooling section 102 is in this positional relation, the upper surface of cooling section 102 and bottom surface of absorption member 105 are in contact with absorption member 105.

The dew condensation absorbed by absorption member 105 may be evaporated with natural drying from absorption member 105, however, since the distance between cooling section 102 and holding member 106 is narrowed by lifting up the cooling section 102, the elastically deformable absorption member 105 contracts and the dew condensation of ink contained in absorption member can be squeezed out.

On upper surface of holding member 106, Peltier device 103, as a cooling body for cooling the cooling section 102 to lower temperature than nozzle surface 2*a* of recording head 2, is provided in a state of contacting the holding member 106.

When Peltier device 103 is applied with electric current by power source 11 (see FIG. 4), bottom end part of Peltier device 103 contacting the cooling section 102 becomes low temperature and heat is radiated from the upper end.

On the upper surface of Peltier device 103, heat radiation section 104 to release heat accumulated at the upper end area of Peltier device 103 is provided in contact state with Peltier device 103. Heat radiation section 104 is configured with a metal heatsink. Further, the upper end portion of Peltier device 103 may be exposed to outer air for natural heat radiation, or may be enhanced of cooling by exposing the heatsink 104 to the wind of a radiator fan.

Cooling section 102 and Peltier device 103 may be formed in one body. Namely, the cooling surface of Peltier device 103 may be made as the surface for attaching the dew condensation. As the cooling body, a water-cooling system for cooling the cooling surface with cooled water, or an air-cooling system for cooling the cooling surface with cooled air may be applicable, however, the cooling system for cooling said cooling surface 102*a* with Peltier device 103 is preferable. By using Peltier device 103 as the cooling body, a compact inkjet recording device with reduced cost can be realized. By a control of voltage to be applied to Peltier device 103, temperature control of cooling surface 102*a* is possible, and further, by using a plurality of stacked Peltier device 103, the cooling ability can be remarkably enhanced.

<Dehumidification Operation by Cooling Device and Maintenance Operation>

Next, the operation of dehumidifying the periphery of recording head 2 by using cooling device 7D, and the maintenance operation will be described.

In case of conveying recording medium P to just under recording head 2, controller 10 controls power source 11 to supply power to heating device 5, and heats recording medium P being conveyed. Further, controller 10 controls power source 11 to supply power to Peltier device 103, and cools holding member 106. When holding member 106 is cooled, through thermo-conductive supporting rod 107 and coil spring 108, cooling section 102 is indirectly cooled.

When recording medium P is conveyed just under recording head 2, controller 10 allows recording head 2 to eject ink droplet from recording head 2. Ink droplet ejected from nozzle surface 2*a* of recording head 2 lands on recording medium P to perform printing.

Here, since recording medium P has been heated, the volatile component of the ink vaporizes and drifts in vicinity of recording head 2. At this time, since cooling surface 102*a* of cooling section 102 has been cooled, the saturated vapor pressure is lower at cooling surface 102*a* of cooling section 102 than at nozzle surface 2*a* of recording head 2, the vapor of ink volatile component drifting near recording head 2 appears on cooling surface 102*a* as the dew condensation.

In this way, by allowing the vapor of ink volatile component drifting near recording head 2 to be dew condensed on cooling surface 102*a*, the air in vicinity of recording head 2 can be dehumidified. Further, since the temperature of cooling surface 102*a* is made lower than the temperature of nozzle surface 2*a* of recording head 2, the dew condensation is generated at cooling surface 102*a* of lower temperature, not being generated at nozzle surface 2*a* of recording head 2, which prevents clogging of nozzle surface 2*a* of recording head 2.

As shown in FIG. 26, the dew condensation generated on cooling surface 102*a* move along the holes 102*b* with capillary effect and is absorbed by absorption member 75 communicated with the holes 102*b*.

Figure 27:
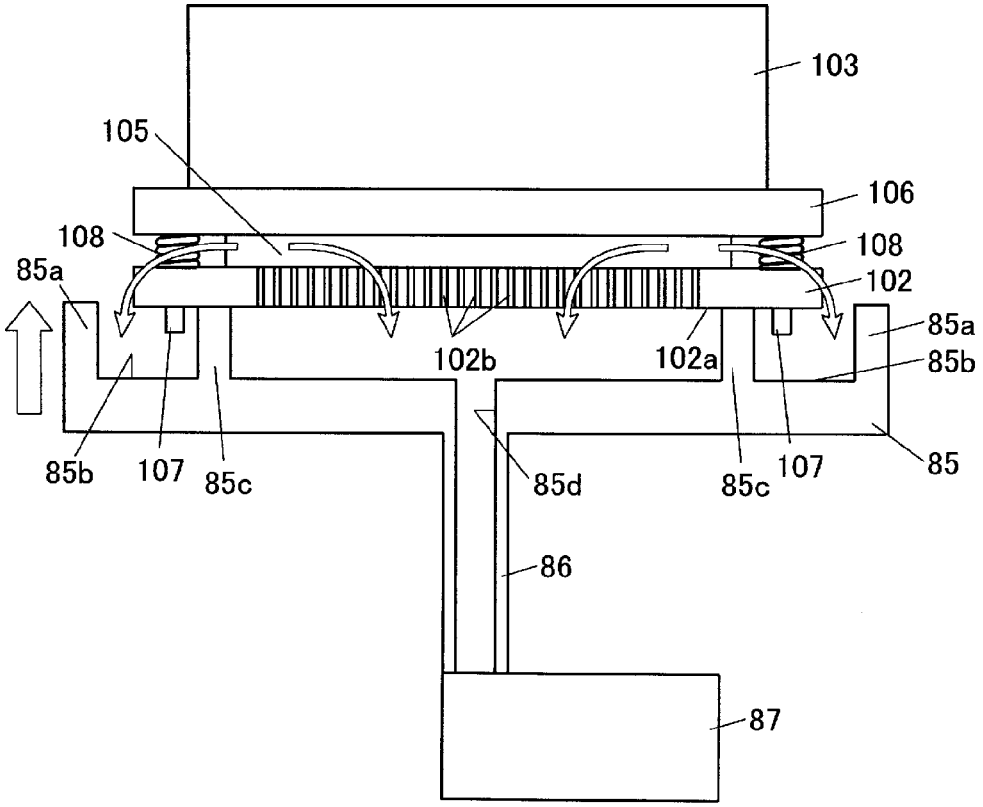
FIG. 27 is an elevation view illustrating a state of executing maintenance by squeezing the absorption member.

In case of conducting the maintenance operation by discharging the ink dew condensation absorbed in absorption member 105, as shown in FIG. 27, when carriage 3 enters into maintenance region Z (see FIG. 1), maintenance cap 85 for cooling device 7D moves upward to push up cooling section 102. By this, absorption member 105 is squeezed by being sandwiched between holding member 106 and cooling section 102.

Figure 28:
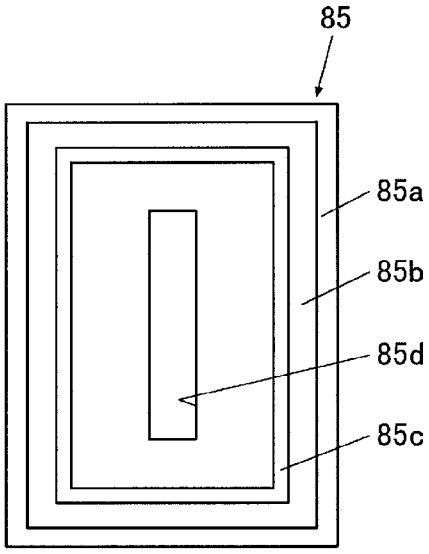
FIG. 28 is a plan view of a maintenance cap.
Figure 29:
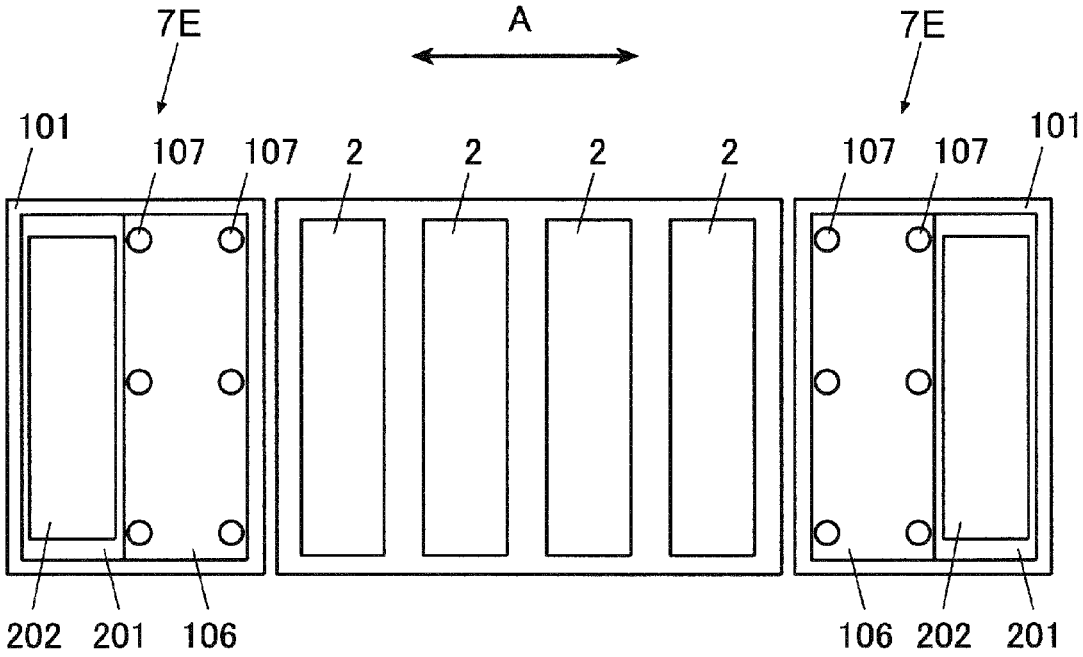
FIG. 29 is a plan view illustrating an arrangement of the recording head and the cooling device.
Figure 30:
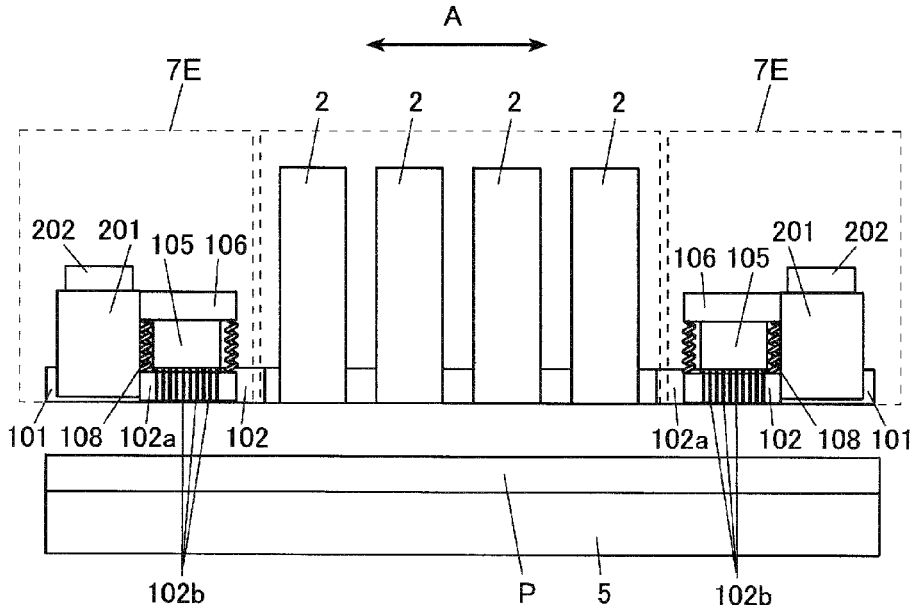
FIG. 30 is an elevation view illustrating an arrangement of the recording head and the cooling device.

As shown in FIG. 28, maintenance cap 85 is configured with outer wall 85 elected on the outer periphery, ink receiver 85*b* to receive the ink flown out from absorption member 105 in outer wall 85*a*, push-up section 85*c* to contact cooling section 102 and push up the cooling section 102 at the time of upward moving, and discharge spout 85*d* formed to penetrate from the upper surface to bottom surface of ink receiver 85*b*. On push-up section 85*c*, through holes (not illustrated) are provided at every prescribed interval, which is configured to allow the ink flowing from outside to inside of push-up section 85*c*. On discharge spout 85*d*, pump 87 is connected via discharge pipe 86.

Therefore, after maintenance cap 85 moved upward and squeezed the ink from absorption member 105, by activating pump 87, the ink in ink receiver 85*b* can be sucked. By this, the maintenance of absorption member 105 can be performed.

<Function Effect>

As described above, according to inkjet recording device 1 of variant example 5, in addition to exerting the similar effect of variant example 4, by sandwiching the absorption member 105 using holding member 106 and cooling section 102, contact between absorption member 105 and cooling section 102 is improved, which enables absorption member 105 to easily absorb the dew condensation on cooling surface 102*a*.

Further, by moving cooling section 102 toward holding member 106, absorption member 105 is elastically deformed, and the dew condensation absorbed in absorption member 105 flows out. By this, absorption member is enabled to absorb the dew condensation again, which makes exchange of absorption member 105 unnecessary and makes the maintenance easy.

Another configuration is possible where the position of cooling section 102 is fixed and holding member is made freely movable toward cooling section 102.

Peltier device 103 is capable of cooling holding member 106, and further cooling the cooling section 102 via coil spring 108, supporting rod 107, and absorption member 105.

Namely Peltier device 103 is capable of indirectly cooling the cooling section 102, and cooling section 102 can be arranged under the Peltier device 103, thus cooling device 7D needs not extend in lateral direction (horizontal direction) to achieve space saving.

Variant Example 6

In inkjet recording device 1, cooling device 7 is not restricted to the configuration of above mentioned first embodiment. For example, cooling device 7E shown in FIGS. 29-37 is also applicable.

Since the embodiment of variant example 6 is different from variant example 5 in the arrangement of Peltier device and heat radiation section, therefore, the cooling device will be described hereinafter, the other parts of same structures are attached with same signs, and the explanation will be omitted.

As shown in FIGS. 29-37, in cooling device 7E, Peltier device 201 is provided alongside the cooling section 102 and holding member 106 in the scanning direction A of recording head 2. Peltier device 201 is arranged to contact folding member 106 at the upper side, and contact cooling section 102 at the lower side.

When Peltier device 201 is applied with electric current by power source 11 (see FIG. 4), the parts of Peltier device 103 contacting to cooling section 102 and holding member 106 become low temperature and heat is radiated from the upper end.

On the upper surface of Peltier device 201, heat radiation section 202 to release heat accumulated at the upper end area of Peltier device 201 is provided in contact state with Peltier device 201. Heat radiation section 202 is configured with a metal heatsink.

<Dehumidification Operation by Cooling Device and Maintenance Operation>

Next, the operation of dehumidifying the periphery of recording head 2 by using cooling device 7E, and the maintenance operation will be described.

In case of conveying recording medium P to just under recording head 2, controller 10 controls power source 11 to supply power to heating device 5, and heats recording medium P being conveyed. Further, controller 10 controls power source 11 to supply power to Peltier device 201, and directly cools cooling section 102 and holding member 106.

When recording medium P is conveyed just under recording head 2, controller 10 allows ejecting ink droplet from recording head 2. Ink droplet ejected from nozzle surface 2*a* of recording head 2 lands on recording medium P to perform printing.

Here, since recording medium P has been heated, the volatile component of the ink vaporizes and drifts in vicinity of recording head 2. At this time, since cooling surface 102*a* of cooling section 102 has been cooled, the saturated vapor pressure is lower at cooling surface 102*a* of cooling section 102 than at nozzle surface 2*a* of recording head 2, the vapor of ink volatile component drifting near recording head 2 appears on cooling surface 102*a* as the dew condensation.

In this way, by allowing the vapor of ink volatile component drifting near recording head 2 to be dew condensed on cooling surface 102*a*, the air in vicinity of recording head 2 can be dehumidified. Further, since the temperature of cooling surface 102*a* is made lower than the temperature of nozzle surface 2*a* of recording head 2, the dew condensation is generated at cooling surface 102*a* of lower temperature, not being generated at nozzle surface 2*a* of recording head 2, which prevents clogging of nozzle surface 2*a* of recording head 2.

Figure 31:
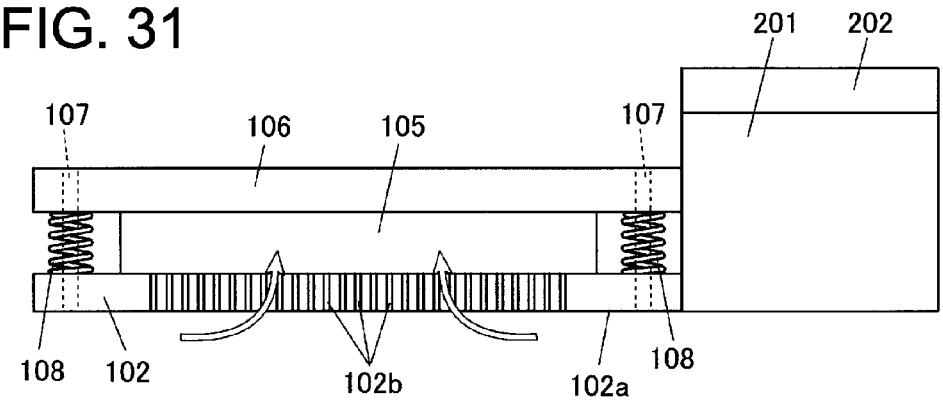
FIG. 31 is an elevation view illustrating the enlarged periphery of the cooling device of FIG. 30.
Figure 32:
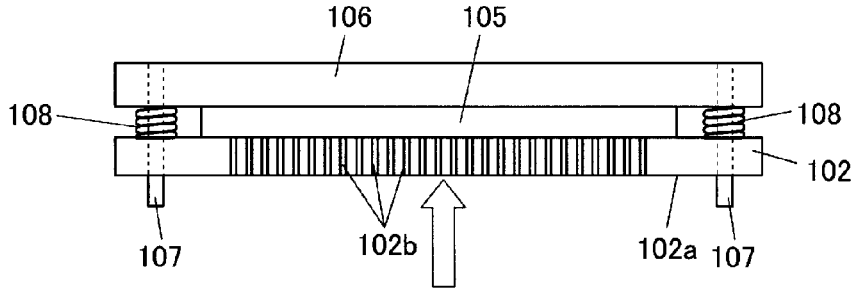
FIG. 32 is an elevation view illustrating a state of executing maintenance by squeezing the absorption member.

As shown in FIG. 31, the dew condensation generated on cooling surface 102*a* move along the holes 102*b* with capillary effect and is absorbed by absorption member 105 communicated with the holes 102*b*.

Figure 34:
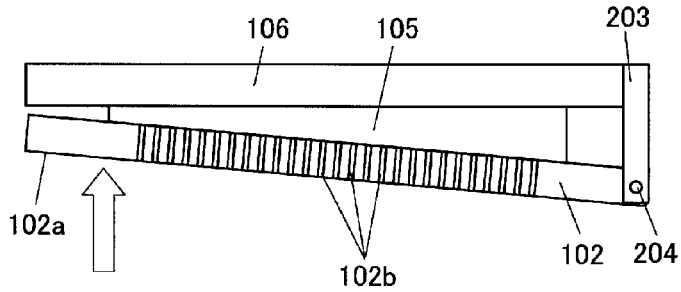
FIG. 34 is an elevation view illustrating a state of executing maintenance by squeezing the absorption member.

In case of conducting the maintenance operation by discharging the ink dew condensation absorbed in absorption member 105, as shown in FIGS. 27 and 34, when carriage 3 enters into maintenance region Z (see FIG. 1), maintenance cap 85 moves upward to push up cooling section 102. By this, absorption member 105 is squeezed by being sandwiched between holding member 106 and cooling section 102.

Therefore, after maintenance cap 85 moved upward and squeezed the ink from absorption member 105, by activating pump 87, the ink in ink receiver 85*b* can be sucked. By this, the maintenance of absorption member 105 can be performed.

<Function Effect>

As described above, according to inkjet recording device 1 of variant example 6, in addition to exerting the similar effect of variant example 5, since Peltier device 201 can cool both holding member 106 and cooling section 102, the temperature of cooling surface 102*a* can be easily lowered to improve the cooling efficiency.

Variant Example 7

In inkjet recording device 1, cooling device 7 is not restricted to the configuration of above mentioned first embodiment. For example, cooling device 7F shown in FIGS. 33-34 is also applicable.

Since the embodiment of variant example 7 is different from variant example 6 in a squeezing method of absorption member at the time of maintenance, therefore, the cooling device will be described hereinafter, the other parts of same structures are attached with same signs, and the explanation will be omitted.

Figure 33:
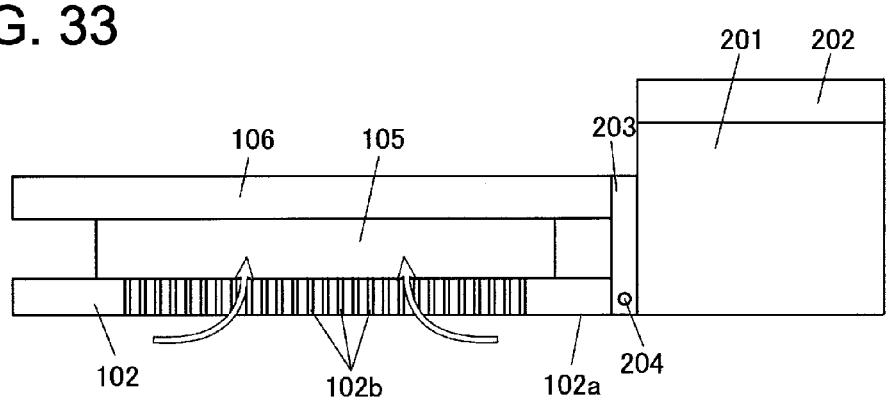
FIG. 33 is an elevation view illustrating the enlarged periphery of the cooling device.

As shown in FIGS. 33-34, in cooling device 7E, on the side surface of Peltier device 201, provided is connecting member 203 which connects cooling section 102 and holding member 106.

Connecting member 203 is provided alongside the Peltier device 201 in the scanning direction A of recording head 2. Connecting member 203 is formed of a material of relatively high thermal conductivity among thermo-conductive materials, such as metal plates of stainless steel (SUS), aluminum, and cupper, and is provided to contact Peltier device 201 with one side surface.

Connecting member 203 is arranged extending in vertical direction, and is connected with holding member 106 at the upper end, and connected with cooling section 102 at the lower end. Here, although holding member 106 is fixed to connecting member 203 at one end, one end of cooling section 102 is rotatably connected to connecting member 203 by hinge member 204.

<Dehumidification Operation by Cooling Device and Maintenance Operation>

Next, the operation of dehumidifying the periphery of recording head 2, and the maintenance operation will be described.

In case of conveying recording medium P to just under recording head 2, controller 10 controls power source 11 to supply power to heating device 5, and heats recording medium P being conveyed. Further, controller 10 controls power source 11 to supply power to Peltier device 201, and indirectly cools cooling section 102 and holding member 106 via connecting member 203.

When recording medium P is conveyed just under recording head 2, controller 10 allows ejecting ink droplet from recording head 2. Ink droplet ejected from nozzle surface 2*a* of recording head 2 lands on recording medium P to perform printing.

Here, since recording medium P has been heated, the volatile component of the ink vaporizes and drifts in vicinity of recording head 2. At this time, since cooling surface 102*a* of cooling section 102 has been cooled, the saturated vapor pressure is lower at cooling surface 102*a* of cooling section 102 than at nozzle surface 2*a* of recording head 2, the vapor of ink volatile component drifting near recording head 2 appears on cooling surface 102*a* as the dew condensation.

In this way, by allowing the vapor of ink volatile component drifting near recording head 2 to be dew condensed on cooling surface 102*a*, the air in vicinity of recording head 2 can be dehumidified. Further, since the temperature of cooling surface 102*a* is made lower than the temperature of nozzle surface 2*a* of recording head 2, the dew condensation is generated at cooling surface 102*a* of lower temperature, not being generated at nozzle surface 2*a* of recording head 2, which prevents clogging of nozzle surface 2*a* of recording head 2.

As shown in FIG. 31, the dew condensation generated on cooling surface 102*a* move along the holes 102*b* with capillary effect and is absorbed by absorption member 105 communicated with the holes 102*b*.

In case of conducting the maintenance operation by discharging the ink dew condensation absorbed in absorption member 105, as shown in FIG. 34, when carriage 3 enters into maintenance region Z (see FIG. 1), end part of cooling section 102 is pushed up. By this, absorption member 105 is squeezed by being sandwiched between holding member 106 and cooling section 102. Thus, the maintenance of absorption member 105 can be performed.

<Function Effect>

As described above, according to inkjet recording device 1 of variant example 7, in addition to exerting the similar effect of variant example 6, since absorption member 105 can be squeezed only by pushing up the end part of cooling section 102, the maintenance can be easily performed.

Variant Example 8

In inkjet recording device 1, cooling device 7 is not restricted to the configuration of above mentioned first embodiment. For example, cooling device 7G shown in FIG. 35 is also applicable.

Since the embodiment of variant example 8 is different from variant example 7 in the structure of radiation section, therefore, the cooling device will be described hereinafter, the other parts of same structures are attached with same signs, and the explanation will be omitted.

<Structure of Cooling Device>

Figure 35:
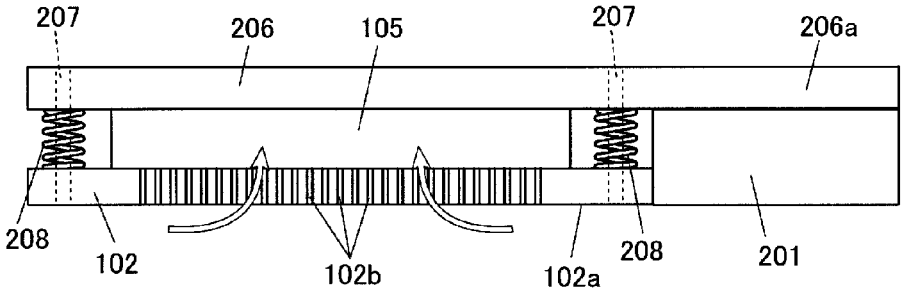
FIG. 35 is an elevation view illustrating an enlarged periphery of a variant example of the cooling device.

As shown in FIG. 35, Peltier device 201 is provided TO contact the cooling section 102. Peltier device 20 is arranged such that its upper end surface comes to the same height with the lower end surface of holding member 206.

Holding member 206 is formed such that its one end part extends to the upper surface of Peltier device 201, and the lower end surface of holding member 206 contacts the upper surface of Peltier device 201. Holding member 206 is formed of a thermo-conductive material, and the heat accumulated on the upper end surface of Peltier device 201 is radiated outside by conducting through holding member 206. Namely, the part of holding member 206 contacting Peltier device 201 functions as heat radiation section 206*a* for conducting the heat release of Peltier device 201.

Here, since holding member 201 becomes warm due to the heat radiation of Peltier device 201, in order to prevent the conduction of the heat to cooling section 102, supporting rod 207 and coil spring 208 are made of heat insulation material. Namely, supporting rod 207 and coil spring 208 thermally insulate between holding member 206 and cooling section 102.

<Dehumidification Operation by Cooling Device>

Next, the operation of dehumidifying the periphery of recording head 2 will be described.

In case of conveying recording medium P to just under recording head 2, controller 10 controls power source 11 to supply power to heating device 5, and heats recording medium P being conveyed. Further, controller 10 controls power source 11 to supply power to Peltier device 201, and directly cools cooling section 102.

When recording medium P is conveyed just under recording head 2, controller 10 allows ejecting ink droplet from recording head 2. Ink droplet ejected from nozzle surface 2*a* of recording head 2 lands on recording medium P to perform printing.

Here, since recording medium P has been heated, the volatile component of the ink vaporizes and drifts in vicinity of recording head 2. At this time, since cooling surface 102*a* of cooling section 102 has been cooled, the saturated vapor pressure is lower at cooling surface 102*a* of cooling section 102 than at nozzle surface 2*a* of recording head 2, the vapor of ink volatile component drifting near recording head 2 appears on cooling surface 102*a* as the dew condensation.

In this way, by allowing the vapor of ink volatile component drifting near recording head 2 to be dew condensed on cooling surface 102*a*, the air in vicinity of recording head 2 can be dehumidified. Further, since the temperature of cooling surface 102*a* is made lower than the temperature of nozzle surface 2*a* of recording head 2, the dew condensation is generated at cooling surface 102*a* of lower temperature, not being generated at nozzle surface 2*a* of recording head 2, which prevents clogging of nozzle surface 2*a* of recording head 2.

Although, by cooling the cooling section 102 with Peltier device 201, heat is accumulated at the upper end part of Peltier device 201, said heat is radiated outside from heat radiation section 206*a* of holding member 206.

Further, since the intermediate part between holding member 206 and cooling section 102 is thermally insulated, heat does not conduct from holding member 206 to cooling section 102.

As shown in FIG. 35, the dew condensation generated on cooling surface 102*a* move along the holes 102*b* with capillary effect and is absorbed by absorption member 105 communicated with the holes 102*b*.

<Function Effect>

As described above, according to inkjet recording device 1 of variant example 8, in addition to exerting the similar effect of variant example 6, since holding member 206 can radiate the heat accumulated on cooling body 102, an additional member for heat radiation needs not be provided, which enables to reduce a number of parts.

Further, since supporting rod 207 and coil spring 208 insulate the intermediate part between cooling section 102 and holding member 206, heat does not conduct from holding member warmed by the heat radiation to cooling section 102.

Figure 36:
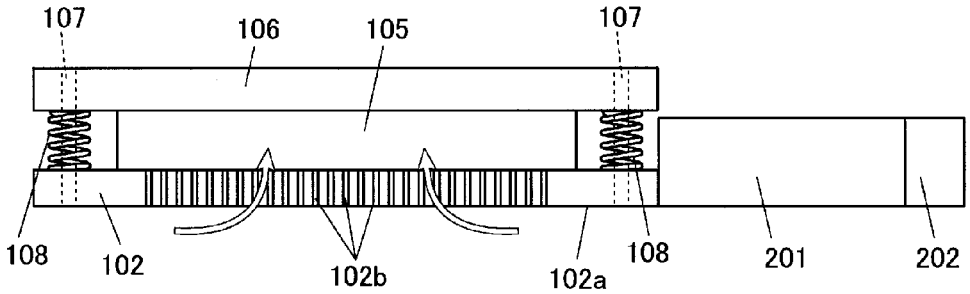
FIG. 36 is an elevation view illustrating an enlarged periphery of a variant example of the cooling device.

Further, as shown in FIG. 36 for example, by configuring Peltier device 201 to contact only to cooling section 102, holding member 106 may be used for holding the absorption member 105.

Figure 37:
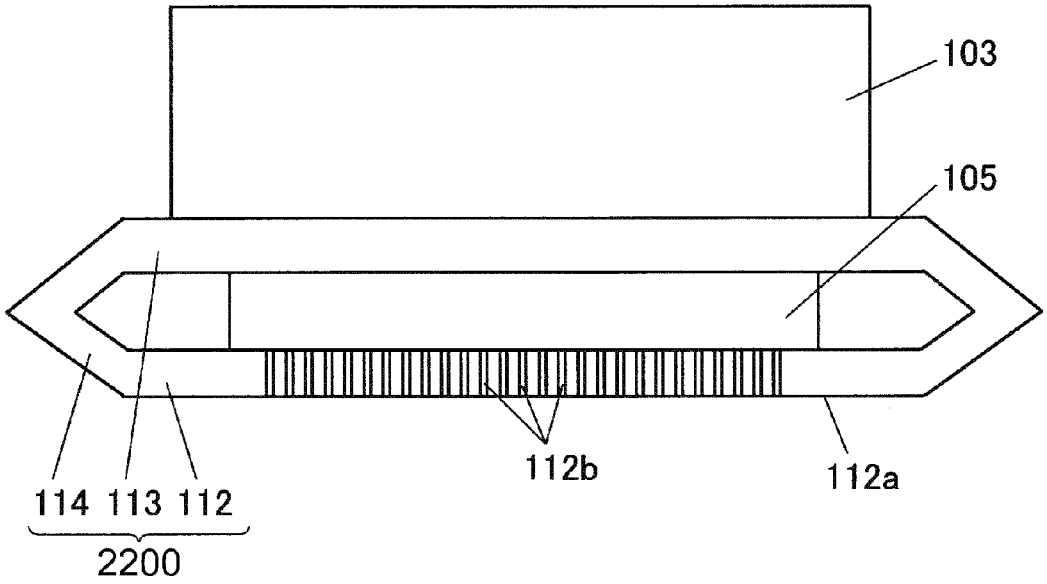
FIG. 37 is an elevation view illustrating an enlarged periphery of a variant example of the cooling device.

Further, as shown in FIG. 37, cooling section 112, holding section 113 and connecting section 114 can be formed in one body with a metal plate as cooling member 2200. Cooling member 2200 is formed with a relatively high thermal conductivity among thermo-conductive materials such as a metal plate of stainless steel (SUS), aluminum, cupper, and iron.

Cooling section 112 faces recording medium P, and provided with cooling surface 112*a* to attach the dew condensation and a plurality of holes 112*b* formed to penetrate from the bottom surface to the upper surface of cooling section 112. On the upper surface of holding section 113, Peltier device 103 is provided in contact. Between cooling section 112 and holding section 113, absorption member 105 is provided. Connecting section 114 is formed to be vent in the vicinity of its central part, and connecting section 114 is configured to be elastically deformable by centering this bent portion. By the elastic deformation of connecting section 114, the distance between cooling section 112 and holding section 113 is configured to be variable.

Thus, holding section 113 cooled by Peltier device 103 can indirectly cool the cooling section 112 via connecting section 114.

Second Embodiment

<Structure of Line Type Inkjet Recording Device>

Figure 38:
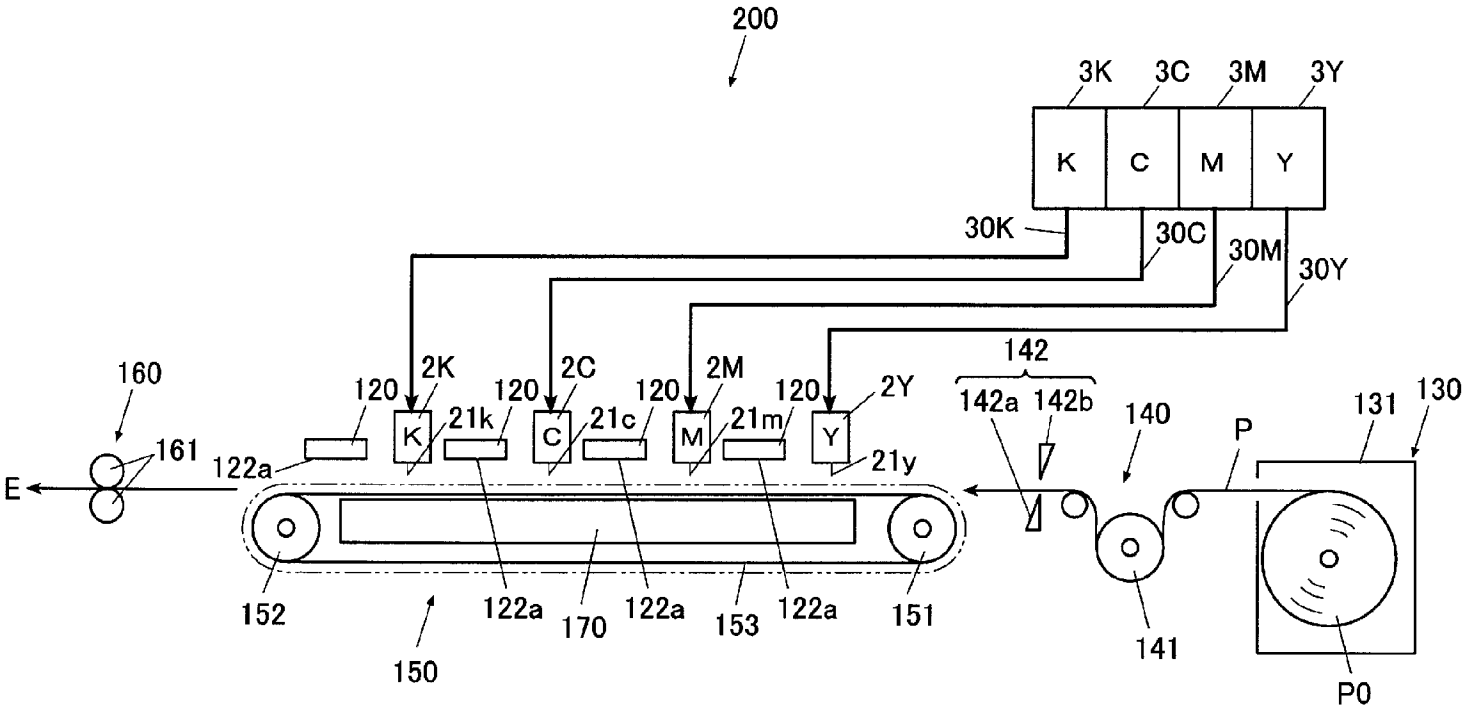
FIG. 38 is a schematic diagram illustrating an outline structure of a line type inkjet recording device.

As shown in FIG. 38, inkjet recording device 200 is a line type inkjet printer which ejects ink from a recording head onto a recording medium to form an image on the recording medium. In the line type inkjet recording device, in a state of fixing the recording head for ejecting the ink, by moving the recording medium with a conveyance device in a prescribed direction, the recording head ejects the ink toward the recording medium conveyed under the recording head to form an image on the recording medium.

Inkjet recording device 200 is configured with a plurality of recording head 2Y, 2M, 2C and 2K which eject ink to recording medium P, a head supporting member (for example, unillustrated structural frame or chassis of the inkjet recording device), ink tank 3Y, 3M, 3C, and 3K provided corresponding to each recording head to reserve the ink, cooling device 120 arranged at downstream side in conveyance direction E of recording medium P with respect to each recording head of 2Y, 2M, 2C and 2K, supply section 130 to supply recording medium P, decurling process section 140 to remove the curl of recording medium P, nozzle surface (ink ejection surface) 21*y*, 21*m*, 21*c*, and 21*k* of each recording head 2Y, 2M, 2C and 2K, suction belt conveyance section 150 to convey recording medium P while holding it not to float above, exit section 160 to discharge the recording medium on which an image has been formed, and heating device 170 provided at suction belt conveyance section 150 to heat the recording medium P.

(Recording Head)

As shown in FIG. 38, recording heads 2Y, 2M, 2C and 2K are provided with the number of ink types to be used. Recording head 2Y is a head for ejecting yellow ink, recording head 2M is a head for ejecting magenta ink, recording head 2C is a head for ejecting yellow ink, and recording head 2K is a head for ejecting black ink.

Each recording head 2Y, 2M, 2C and 2K is arranged along the conveyance direction of recording medium P in color order from upstream of yellow (Y), magenta (M), cyan (C), and black (K). Each recording head 2Y, 2M, 2C and 2K is arranged extending to the direction perpendicular to conveyance direction E of recording medium P.

By ejecting the ink toward recording medium P conveyed by suction belt conveyance section 150, each recording head 2Y, 2M, 2C and 2K is able to form a color image on recording medium P.

Length of each recording head 2Y, 2M, 2C and 2K in the direction perpendicular to the conveyance direction of recording medium P corresponds to the maximum width of recording medium P intended by the inkjet recording device 200. Each recording head 2Y, 2M, 2C and 2K is a full line type head on whose nozzle surface a plurality of ink ejecting nozzles are arranged extending to the width (width of the area capable of image formation) exceeding at least one side length of the maximum size recording medium P.

By structuring each recording head 2Y, 2M, 2C, and 2K as described above, only if recording medium P is relatively moved one time with respect to recording heads 2Y, 2M, 2C, and 2K, in the conveyance direction of recording medium P, namely only by a movement of a single path, an image is formed on entire face of recording medium P.

The alignment order of recording heads 2Y, 2M, 2C, and 2K is possible to be properly changed. Further, color of the ink to be used or number of the colors is not restricted as the above embodiment, but for example, the other colors such as light yellow (LY), light magenta (LM), light cyan (LC) and the like are possible to be used.

(Ink Tank)

As shown in FIG. 38, ink tanks 3Y, 3M, 3C, and 3K to reserve each color ink are provided with a corresponding number to the color of each head 2Y, 2M, 2C, and 2K. Ink tank 3Y is communicated with recording head 2Y via ink flow path 30Y. Ink tank 3M is communicated with recording head 2M via ink flow path 30M. Ink tank 3C is communicated with recording head 2C via ink flow path 30C. Ink tank 3K is communicated with recording head 2K via ink flow path 30K.

Ink tank 3Y, 3M, 3C, and 3K is provided with an informing device (display, warning tone generating device, etc,) for informing to the effect that the reserved ink amount comes to low, and is structured so as not to be loaded with incorrect color ink.

(Cooling Device)

Figure 39:
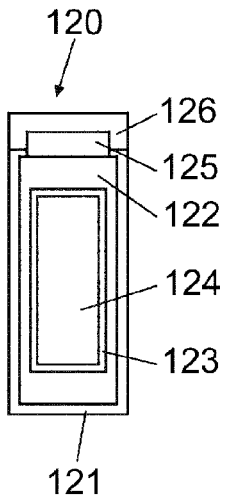
FIG. 39 is a plan view of the cooling device.
Figure 40:
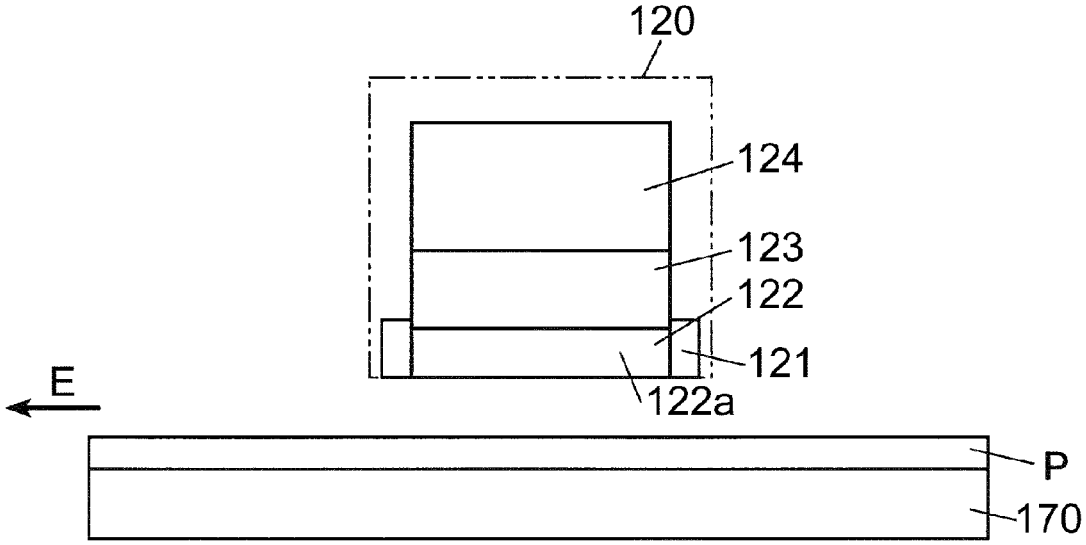
FIG. 40 is a plan view of the cooling device disposed above a recording media.
Figure 41:
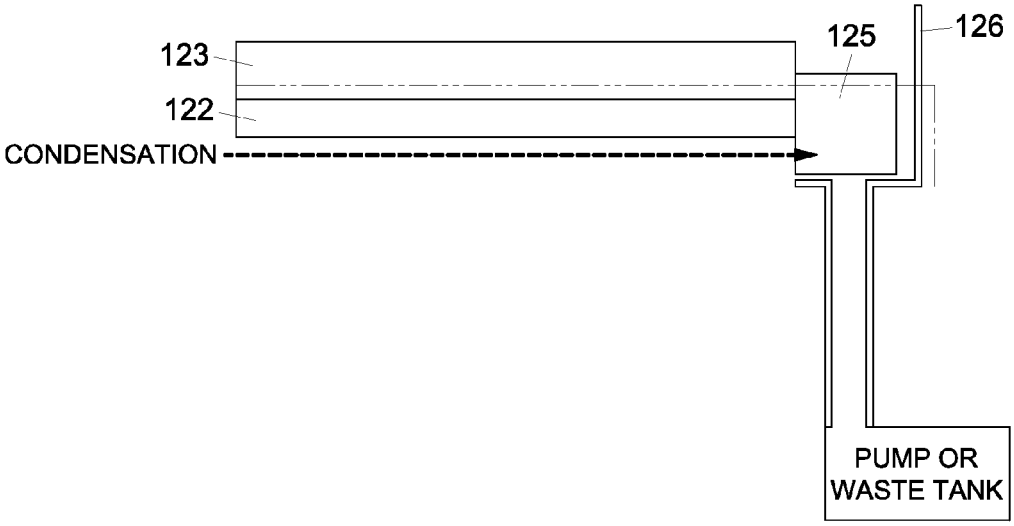
FIG. 41 is a side view of the cooling device viewing from the conveyance direction of the recording medium.

As shown in FIGS. 39-41, cooling device 120 is provided on a head supporting member (not illustrated) fixed on the inkjet recording device, and has supporting section 121 on which cooling section 122 is provided.

Cooling section 122 is, for example, formed with a metal plate. Specifically, by forming cooling section 122 with a high thermal conductivity metal plate such as stainless steel (SUS), aluminum, copper, iron and the like, cooling efficiency around recording head 2 can be enhanced. Further, by utilizing a compact and low-cost metal plate, cost reduction can be achieved.

Cooling section 122 is installed on supporting section 121 in the state of heat insulation from recording head 2Y, 2M, 2C, and 2K. Since cooling section 122 is installed on supporting section 121, only supporting section 121 is required to be a heat insulation material. As the heat insulation material, materials of inorganic fiber, foamed plastic, natural fiber and the like are preferable. Further it is preferable to dispose nozzle surface 21*y*, 21*m*, 21*c*, 21*k* and cooling surface 122*a* so as not be thermally affected with each other.

Cooling section 122 is disposed such that its bottom surface faces recording medium P. The bottom surface of cooling section 122 is made to be cooling surface 122*a* which cools the air containing vapor of ink component in the vicinity of recording head 2Y, 2M, 2C, and 2K.

Cooling section 122 is disposed such that said cooing surface 122*a* is arranged alongside at downstream side of each recording head 2Y, 2M, 2C, and 2K in the conveyance direction of recording medium P.

Cooing section 122 is provided on recording head 2Y, 2M, 2C, and 2K such that a height of the cooling surface 122*a* and a height of the nozzle surface 21*y*, 21*m*, 21*c*, 21*k* of the recording head 2Y, 2M, 2C, and 2K, each from the upper surface of recording medium P are made to be equal.

The cooling surface 122*a* is performed of a lyophilic processing. This is a measure to make the dew condensation on cooling surface 122*a* hardly drops on recording medium P. As the lyophilic processing, coating of commercially available organic or inorganic hydrophilic coating material, photocatalytic titanium-oxide coating material on cooling surface 122*a*, and application of plasma processing on cooling surface 122*a*, can be cited.

In the present embodiment, a stainless steel plate is used as cooling section 122, and a commercially available inorganic hydrophilic coating material is coated on its cooling surface 122*a*.

On an upper surface of the cooling section 122, Peltier device 123 is provided in contact state with cooling section 122 as a cooling body for cooling said cooling section 122. When Peltier device 123 is applied with electric current by power source 211 (see FIG. 52), bottom end part of Peltier device 123 contacting to cooling section 122 becomes low temperature and heat is radiated from the upper end.

On the upper surface of Peltier device 123, heat radiation section 124 to release heat accumulated at the upper end area of Peltier device 123 is provided in contact state with Peltier device 123. Heat radiation section 124 is configured with a metal heatsink. Further, the upper end portion of Peltier device 123 may be exposed to outer air for natural heat radiation, or may be enhanced of cooling by exposing the heat radiation section 124 (heatsink) to the wind of a radiator fan.

Cooling section 122 and Peltier device 123 may be formed in one body. Namely, the cooling surface of Peltier device 123 may be made as the surface for attaching the dew condensation. As the cooling body, a water-cooling system for cooling the cooling surface with cooled water, or an air-cooling system for cooling the cooling surface with cooled air may be applicable, however, the cooling system for cooling said cooling surface 122*a* with Peltier device 73 is preferable. By using Peltier device 123 as the cooling body, a compact inkjet recording device with reduced cost can be realized. By a control of voltage to be applied to Peltier device 123, temperature control of cooling surface 122*a* is possible, and further, by using a plurality of stacked Peltier device 123, the cooling ability can be remarkably enhanced.

At an end of cooling section 122 and Peltier device 123 absorption member 125 is provided for absorbing the dew condensation attached and accumulated on cooling surface 122*a*. As absorption member 125, a sponge material such as a porous material, a fiber material of felt and the like, or a material blended with high molecular polymer can be utilized.

Absorption member 125 is provided on liquid collection tray 126 fixed on recording head 2Y, 2M, 2C, and 2K, and the waste liquid, which being collection of the dew condensation absorbed by absorption member 125, can be collected from waste liquid collection tray 126.

In order to absorb the dew condensation accumulated on cooling surface 122*a*, absorption member 125 is disposed to protrude at lower side (the side of recording medium P) than cooling surface 122*a*. The dew condensation absorbed by absorption member 125 may be evaporated from absorption member 125 by natural drying, or may be sucked by a pump from waste liquid collection tray 126. Further, a waste ink tank may be provided at a lower side of waste liquid collection tray 126, and by squeezing the absorption member 125, the absorbed dew condensation may be made to flow down to the waste ink tank.

(Supply Section)

As shown in FIG. 38, supply section 130 is provided with supply source P0 which is rolled up with recording medium P into a roll, and magazine 131 to contain this roll-shaped supply source P0. Supply source P0 is pulled out with its one end from an opening of magazine 131.

Here, magazine 131 is not limited to one unit, but a plurality of magazines may be provided in parallel by each width or type of recording medium P. Further, supply source P0 is not limited to recording medium P rolled up into a roll, but may be recording medium P which is cut into a certain size and stacked in a cassette.

In cases where the plurality of types of recording medium P is configured to be usable, it is preferable to attach information recording member such as barcode or a wireless tag recorded with the information regarding the type of recording medium P on magazine 131, and by reading out the information of the information recording member with a prescribed reading device, to automatically determine the type of recording medium P to be used, and to control ink ejection so as to properly perform the ink ejection according to the type of recording medium P.

(Decurling Process Section)

Decurling process section 140 shown in FIG. 38 is provided for removing a curl formed while recording medium P has been rolled up into the roll as supply source P0 in magazine 131. Decurling process section 140 is provided with heating drum 141 for offsetting the curl by applying a reverse curl to the curl formed in magazine 131. By being applied with heat in heating drum, the curl of recording medium P formed in magazine 131 is removed after passing through heating drum 141. At this time, the heating temperature can be controlled so that the imaging surface of recording medium P is slightly curled outward.

At downstream side of heating drum 141, cutter 142 is provided for cutting the recording medium P. The recording medium P is cut to be a desired size by the cutter 142. Cutter 142 is provided with a fixed blade 142*a* having a length longer than the width of conveyance path of recording medium P, and a round blade 142*b* which moves along the fixed blade 142*a*.

Recording medium P, removed of the curl by decurling process section 140 and cut into the desired size by cutter 142, is conveyed to suction belt conveyance section 150.

(Suction Belt Conveyance Section)

As shown in FIG. 38, suction belt conveyance section 150 functions as a conveyance device, being configured with drive roller 151, driven roller 152, endless conveyance belt 153 extended around the drive roller 151 and driven roller 152, and motor 154 (see FIG. 52) to rotate the drive roller.

Drive roller 151 and driven roller 152 are arranged with a necessary interval such that at least an area of conveyance belt 153 facing to nozzle surface 21*y*, 21*m*, 21*c*, and 21*k* of recording head 2Y, 2M, 2C, and 2K becomes a flat surface.

Conveyance belt 153 has a width wider than the width of recording medium P, and on its belt surface, a plurality of sucking holes (not illustrated) are formed. Inside the conveyance belt 153, a suction chamber or the like is provided, and being sucked by a fan to make a negative pressure, adsorbs and keeps the recording medium P on conveyance belt 153. Further, inside the conveyance belt 153, heating device 170 is provided for heating the recording medium P on conveyance belt 153.

When drive roller 151 rotates by the drive of motor 154, conveyance belt 153 goes around the drive roller 151 and driven roller 152 in counterclockwise direction, and conveys the recording medium P placed on its upper surface along the conveyance direction (E direction in FIG. 38), and when drive roller 151 stops the rotation, conveyance belt 153 stops going around between both rollers 151 and 152 to stop the conveyance of recording medium P.

(Exit Section)

As shown in FIG. 38, exit section 160 is provided at downstream side of suction belt conveyance section 150 in the conveyance direction of recording medium P. Exit section 160 nips, by exit rollers 161, the recording medium P finished with image formation and conveyed by suction belt conveyance section 150, and conveys to accumulate in a sorter (not illustrated).

(Heating Device)

As shown in FIG. 38, heating device 170 is, for example, a heater to be heated by electric power supply, and provided on suction belt conveyance section 150. Heating device 170 is arranged just under recording medium P being conveyed, and heats the recording medium P having been conveyed by suction belt conveyance section 150. Due to previous heating of recording medium P, wetting property of the recording medium P is improved and a dot diameter of the ink is properly expanded by wetting, thus an image without uneven image quality can be obtained.

Heating device 170 is provided just under the recording head 2Y, 2M, 2C, and 2K or at upstream side of just under the recording head 2Y, 2M, 2C, and 2K in conveyance direction of recording medium P. Namely, heating device 170 is arranged at a position where recording medium P can be heated no later than it is conveyed to an ink ejecting position by recording head 2Y, 2M, 2C, and 2K. If recording medium P is heated at the time of ink landing, a volatile component in the ink is quickly evaporated to prevent an expansion of ink dot after the landing, which causes to improve the image quality. In the present embodiment heating device 170 is provided at just under the recording head 2Y, 2M, 2C, and 2K.

Recording medium P is preferably heated by heating device 170 to be not less than 40° C. and not more than 100° C. In case of lower than 40° C., wetting property is not sufficiently improved, and in case of higher than 100° C., recording medium P may be deformed by the heat to cause a failure of conveyance property of recording medium P.

Although the heating of recording medium P is performed before being printed with the ink, the heating may be subsequently conducted after the printing. Further, as heating device 170, not being restricted to the abovementioned plate heater, may be for example, a heater fan, a heat roller, a heat belt, a halogen heater, or a far-infrared heater, and these heater can be used by proper selection or in combination.

(Controller)

Figure 52:
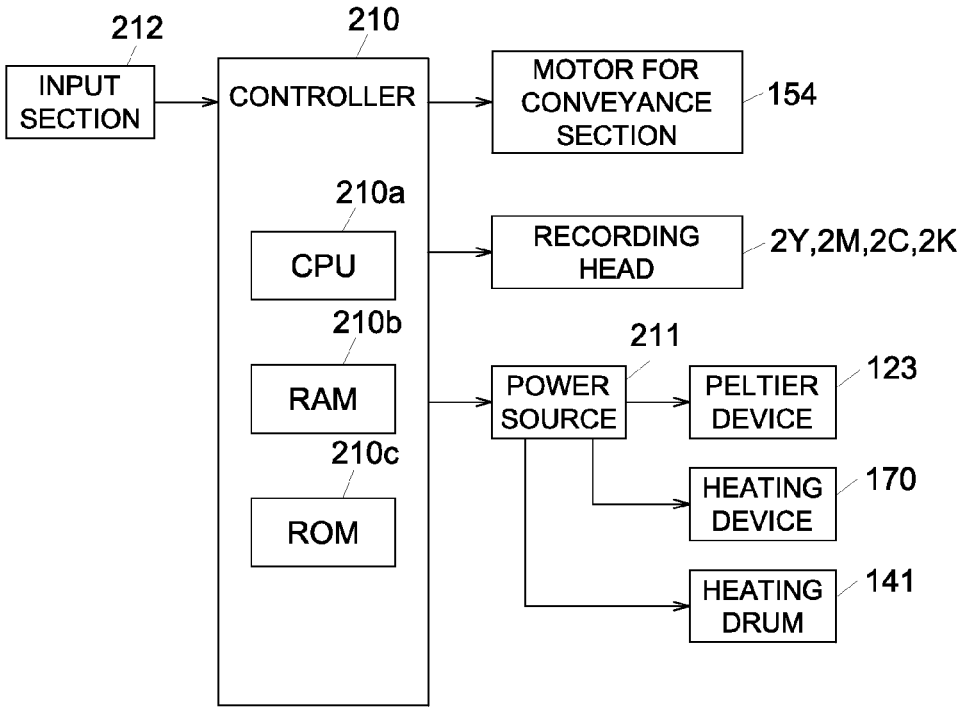
FIG. 52 is a block diagram showing a controller and each composition connected to the controller.
Figure 53:
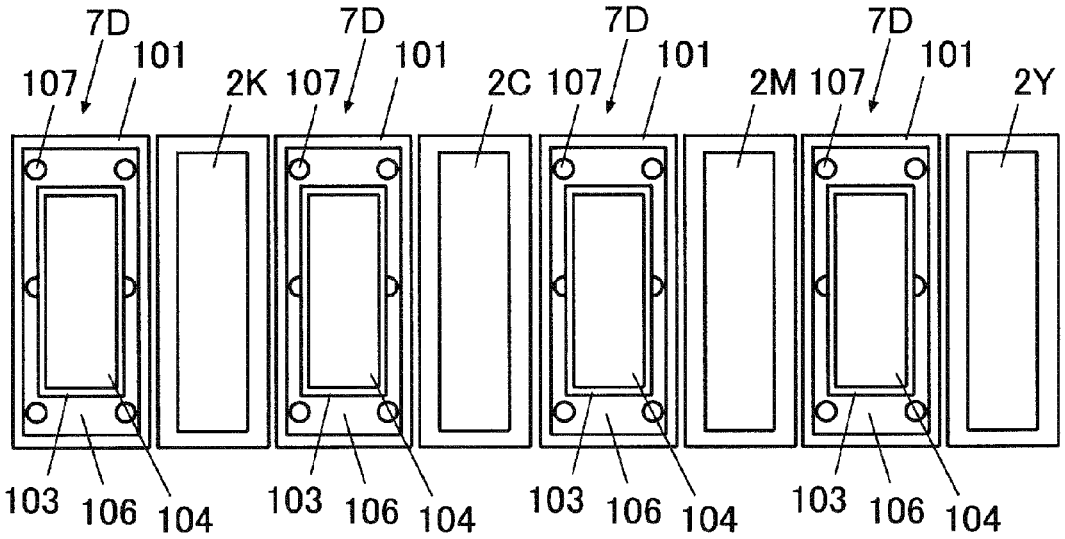
FIG. 53 is a plan view illustrating an arrangement of a recording head and a cooling device.
Figure 54:
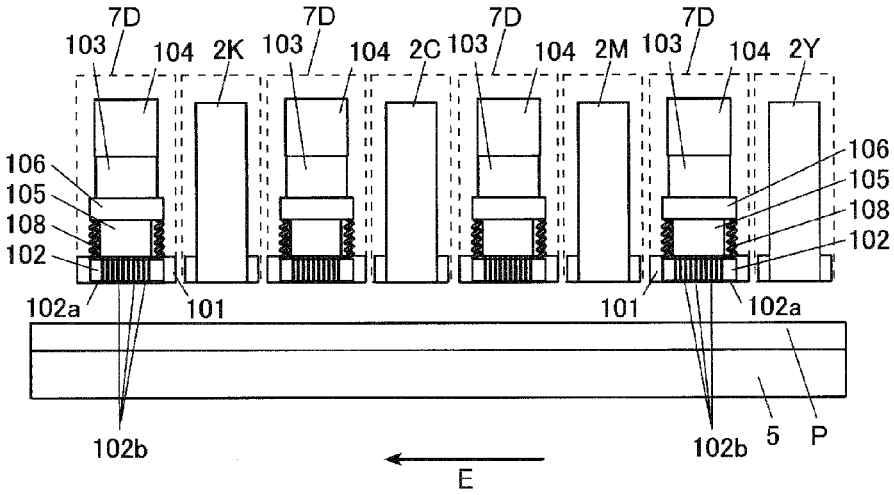
FIG. 54 is an elevation view illustrating an arrangement of a recording head and a cooling device.

As shown in FIG. 52, in inkjet recording device 1, controller 210 is provided which controls the movement of motor 154 of suction belt conveyance section 150, recording head 2Y, 2M, 2C, and 2K, power source 211, and the like.

Controller 210 is provided with CPU210*a*, RAM210*b*, and ROM210*c*, and is connected via an interface (not illustrated) with motor 154 of suction belt conveyance section 150, recording head 2Y, 2M, 2C, and 2K, power source 211, and the like.

Controller 210 controls the movement of motor 154 of suction belt conveyance section 150 to intermittently move recording medium P in the conveyance direction by repeating the conveyance and stoppage of recording medium P.

Controller 210 controls to supply power from power source 211 to heating drum 141, for heating the recording medium P to remove the curl.

Controller 210 controls to heat the recording medium P by controlling power supply from power source 211 to heating device 170.

Controller 10 controls to cool cooling surface 122*a* in cooling section 122 to be the temperature lower than nozzle surface 21*y*, 21*m*, 21*c*, and 21*k* of recording head 2Y, 2M, 2C, and 2K, by controlling the power supply from power source 211 to Peltier device 123. Although it is possible to control the temperature of cooling surface to be a prescribed temperature by providing a temperature sensor on cooling surface 122*a* and controlling the power supply from power source 211, since by simply cooling said cooling surface 122*a*, the temperature of cooling surface can be lowered to be lower than a room temperature or the temperature of nozzle surface 21*y*, 21*m*, 21*c*, and 21*k* of recording head 2Y, 2M, 2C, and 2K, the temperature control is not necessarily required, from the view point of dew condensation of ink volatile component. When cooling surface 122*a* is cooled to the lower temperature, the dew condensation becomes the easier as the saturated vapor pressure decreases, which causes a large effect.

Controller 210 is connected with a host computer and a scanner to input image information, input section 212 configured with a key board to input an image recording condition and the likes, and recording head 2Y, 2M, 2C, and 2K. Controller 210 operates recording head 2Y, 2M, 2C, and 2K based on prescribed signals inputted from input section 212, and allows ejecting ink on recording medium P to record a prescribed image.

<Dehumidifying Operation by Cooling Device>

Next, an operation will be described in a case where the air in vicinity of recording head 2Y, 2M, 2C, and 2K is dehumidified by the use of cooling device 120.

In case of conveying recording medium P to just under recording head 2Y, 2M, 2C, and 2K, controller 210 controls power source 211 to energize heating device 170 to heat recording medium P being conveyed. Further, controller 210 controls power source 211 to energize Peltier device 123 to cool the cooling section 122.

When recording medium P is conveyed to just under recording head 2Y, 2M, 2C, and 2K, controller 210 allows recording head 2Y, 2M, 2C, and 2K to eject an ink droplet. The ink droplet ejected from nozzle surface 21*y*, 21*m*, 21*c*, and 21*k* of recording head 2Y, 2M, 2C, and 2K, lands onto recording medium P to perform printing.

Here, since recording medium P has been heated, the volatile component of the ink vaporizes and drifts in vicinity of recording head 2Y, 2M, 2C, and 2K. At this time, since cooling surface 122*a* of cooling section 122 has been cooled, the saturated vapor pressure is lower at cooling surface 122*a* of cooling section 122 than at nozzle surface 21*y*, 21*m*, 21*c*, and 21*k* of recording head 2Y, 2M, 2C, and 2K, the vapor of ink volatile component drifting near recording head 2Y, 2M, 2C, and 2K, appears on cooling surface 122*a* as the dew condensation.

In this way, by allowing the vapor of ink volatile component drifting near recording head 2Y, 2M, 2C, and 2K, to be dew condensed on cooling surface 122*a*, the air in vicinity of recording head 2Y, 2M, 2C, and 2K can be dehumidified. Further, since the temperature of cooling surface 122*a* is made lower than the temperature of nozzle surface 21*y*, 21*m*, 21*c*, and 21*k* of recording head 2Y, 2M, 2C, and 2K, the dew condensation is generated at cooling surface 122*a* of lower temperature, not being generated at nozzle surface 21*y*, 21*m*, 21*c*, and 21*k* of recording head 2Y, 2M, 2C, and 2K, which prevents clogging of nozzle surface 21*y*, 21*m*, 21*e*, and 21*k* of recording head 2Y, 2M, 2C, and 2K.

The dew condensation generated on cooling surface 122*a* is absorbed by absorption member 125, and is dried naturally or is externally ejected by being sucked by a pump.

<Function Effect>

As described above, according to inkjet recording device 200, by cooling the cooling surface 122*a* of cooling section 122 to be lower temperature than nozzle surface 21*y*, 21*m*, 21*c*, and 21*k* of recording head 2Y, 2M, 2C, and 2K, since the ink vapor is dew condensed onto cooling surface 122*a* that being in lower temperature than nozzle surface 21*y*, 21*m*, 21*c*, and 21*k* of recording head 2Y, 2M, 2C, and 2K, the dew condensation is not generated on nozzle surface 21*y*, 21*m*, 21*c*, and 21*k* of recording head 2Y, 2M, 2C, and 2K.

Further, since cooling surface 122*a* is cooled not by natural heat release but by the effect of Peltier device 123, the dew generation on nozzle surface can be continuously prevented while Peltier device is energized.

Further, since the dehumidification near the recording head 2Y, 2M, 2C, and 2K can be performed without using a fan which has been conventionally used, disturbance of air flow is not generated, and degradation of print quality is not caused. Further, since cooling surface 122*a* is adjacent to recording head 2Y, 2M, 2C, and 2K, heating device can be provided just under recording head 2Y, 2M, 2C, and 2K, which makes the image quality degradation less likely to be caused. Furthermore, the drying of meniscus at nozzle surface 21*y*, 21*m*, 21*c*, and 21*k* of recording head 2Y, 2M, 2C, and 2K is not caused.

Further, since cooling surface 122*a* of cooling section 122 is provided side by side with recording head 2Y, 2M, 2C, and 2K along the conveyance direction E (relative movement direction) of recording medium P, ink vapor which moves along with the air flow generated by the conveyance of the recording medium P is condensed and collected in at least one of before and after the printing by recording head 2Y, 2M, 2C, and 2K, which enables effective dehumidification in the vicinity of the recording head 2Y, 2M, 2C, and 2K.

Further, although on the nozzle surface 21*y*, 21*m*, 21*c*, or 21*k* of recording head 2Y, 2M, 2C, or 2K, which is arranged at downstream side in the conveyance direction of recording medium P, the dew condensation is likely to be generated due to the vapor of ink ejected from the recording head 2Y, 2M, 2C, or 2K arranged at the upstream side, by providing the cooling surface 122*a* of cooling device 120 between the two heads, the dew condensation is generated on said cooling surface 122*a*, and generation of dew condensation on nozzle surface 21*y*, 21*m*, 21*c*, or 21*k* of recording head 2Y, 2M, 2C, or 2K can be prevented.

Further, by guiding the ink vapor being generated and dispersing near the each recording head 2Y, 2M, 2C, and 2K toward the downstream side with air flow caused by the conveyance of recording medium P, the ink vapor can be dew condensed and removed before it disperses to the periphery.

Further, in cases where the cooling surface 122*a* is disposed nearer to recording media P than the nozzle surface 21*y*, 21*m*, 21*c*, and 21*k* of recording head 2Y, 2M, 2C, and 2K, condensed dew may contact the recording media to pollute it, and in cases where the cooling surface 122*a* is disposed farther from the recording media P than the nozzle surface 21*y*, 21*m*, 21*c*, and 21*k* of recording head 2Y, 2M, 2C, and 2K, since the dehumidification effect in vicinity of the recording head 2Y, 2M, 2C, and 2K is decreased, and by configuring heights of the nozzle surface 21*y*, 21*m*, 21*c*, and 21*k* of recording head 2Y, 2M, 2C, and 2K, and the cooling surface 42*a* from the recording medium P to be equal, the dehumidification effect near the recording head 2Y, 2M, 2C, and 2K can be exerted while pollution of the recording media P is prevented.

Further, by applying the lyophilic processing on the cooling surface 122*a*, since the dew condensation becomes wet and easy to spread on cooling surface 122*a*, the dew condensation can be prevented from trailing down or dropping from the cooling surface 122*a*, which enables to make the distance short between the recording media P and the recording head 2Y, 2M, 2C, and 2K, to improve the image quality.

Further, by providing absorption member 125, since the dew condensation generated on the cooling surface 122*a* can be absorbed with the absorption member 125, a number of times of maintenance for the cooling surface 122*a* can be decreased. Further, since the dew condensation generated on the cooling surface 122*a* is absorbed by the absorption member 125 before dropping on the recording media P, pollution of the recording media P can be prevented.

Variant Example A

Alignment of the cooling device and a number of the provided cooling devices are not restricted to those of the above described embodiment.

Figure 42A:
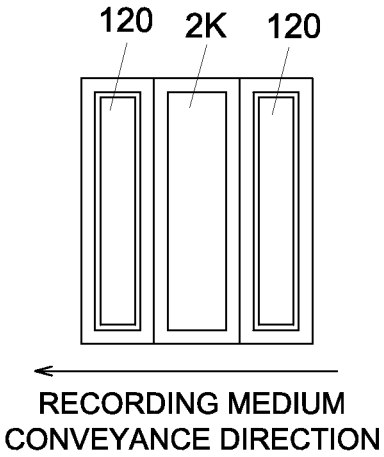
FIG. 42*a* is a plan view showing an example of arranging the cooling devices at downstream side and upstream side in the conveyance direction of a recording medium with respect to a single recording head.

As shown in FIG. 42*a*, in cases where the recording head is only for black, cooling device 120 may be arranged alongside the single recording head 2K at both sides of downstream and upstream in the scanning direction of recording medium P.

In this case, by disposing the cooling devices 120 at both sides of the recording head 2K, since the dew condensation can be generated on cooling surface 122*a* before and after the ink ejection, efficiency of humidification can be improved. Namely, cooling surface 122*a* at upstream side is capable of dehumidification of high humidity air before it reaches the recording head 2K in cases where high humidity air flows toward the recording head 2K, and cooling surface 122*a* at downstream side is capable of dehumidification before ink vapor scatters around the periphery, in cases where the ink vapor is generated by evaporation of the ink on recording medium P due to the heat of recording medium P heated after the landing of ink.

Figure 42B:
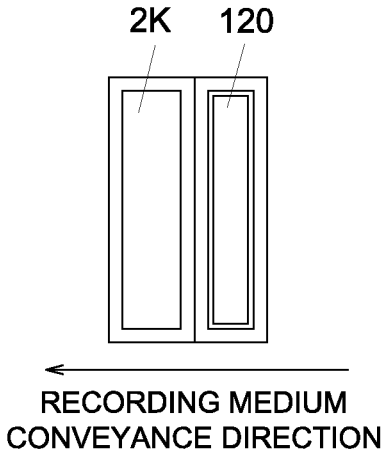
FIG. 42*b* is a plan view showing an example of arranging the cooling device at upstream side in the conveyance direction of the recording media with respect to a single recording head.

Further, as shown in FIG. 42*b*, in cases where the recording head is only for black, cooling device 120 may be arranged alongside the single recording head 2K only at upstream side in the scanning direction of recording medium P. In this case, dehumidification is possible before high humidity air reaches the recording head 2K, when high humidity air flows toward the recording head 2K by the conveyance of recording medium P.

Figure 43A:
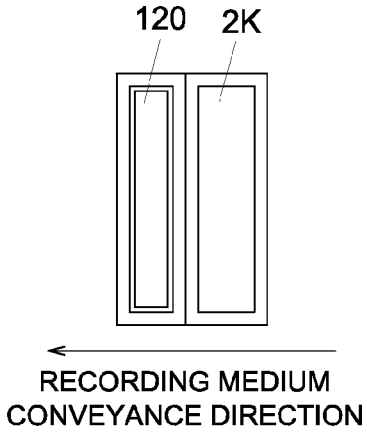
FIG. 43*a* is a plan view showing an example of arranging the cooling device at upstream side in the conveyance direction of the recording media with respect to a single recording head.

Further, as shown in FIG. 43*a*, in cases where the recording head is only for black, cooling device 120 may be arranged alongside the single recording head 2K only at downstream side in the scanning direction of recording medium P. In this case, dehumidification is possible before ink vapor scatters around the periphery, when the ink vapor is generated by evaporation of the ink on recording medium P due to the heat of recording medium P heated after the landing of ink.

Figure 43B:
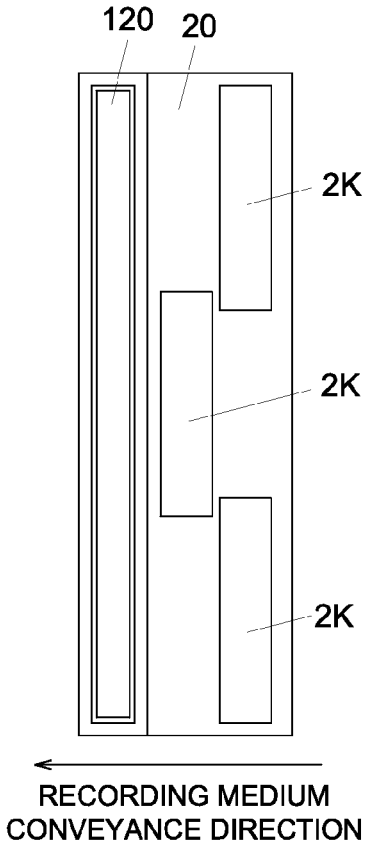
FIG. 43*b* is a plan view showing an example of arranging the cooling device at downstream side in the conveyance direction of the recording media with respect to a head unit arranged with a plurality of recording head in zigzag alignment.

Further, as shown in FIG. 43*b*, in cases where the recording head is only for black, and head unit 20 is arranged with a plurality of recording head in zigzag alignment, cooling device 120 may be provided at downstream side of head unit 20 in the conveyance direction of recording medium P. Similarly, cooling device 120 may be provided only at upstream side or at both sides of down stream and upstream of head unit 20 in the conveyance direction of recording medium P.

Further, in case of providing a plurality of recording heads 2M and 2K, the cooling devices 120 may be arranged between the recording heads 2M and 2K adjacent to each other.

In this case, although in the arranged recording heads 2M and 2K, nozzle surface 21*k* of recording head 2K tends to be dew-condensed due to ink vapor from nozzle surface 21*m* of recording head 2M, by disposing the cooling surface 122*a* of the cooling device 120 between the heads 2M and 2K, dew condensation is generated on said cooling surface 122*a*, which enables to prevent the generation of dew condensation on the nozzle surface 21*k* of recording head 2K provided at downstream side in the conveyance direction of recording head P.

Figure 44A:
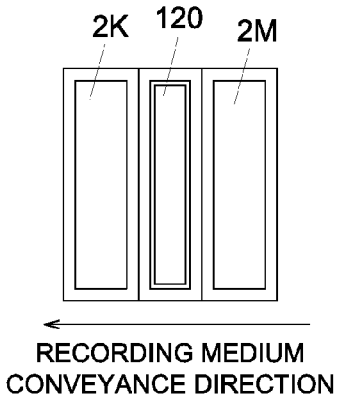
FIGS. 44*a* and 44*b* are plan views showing an example of arranging the cooling devices between adjacent recording heads with respect to a plurality of recording heads.
Figure 44B:
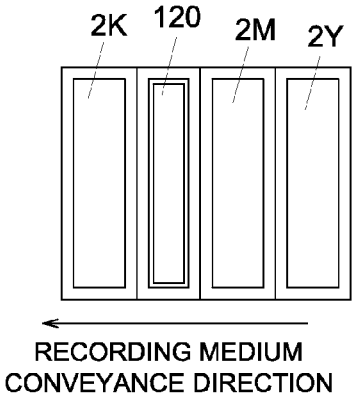

Further as shown in FIG. 44*b*, it is not necessary to arrange cooling device 120 at every space between two adjacent recording heads. Cooling device 120 may be arranged at every several recording heads.

Figure 44C:
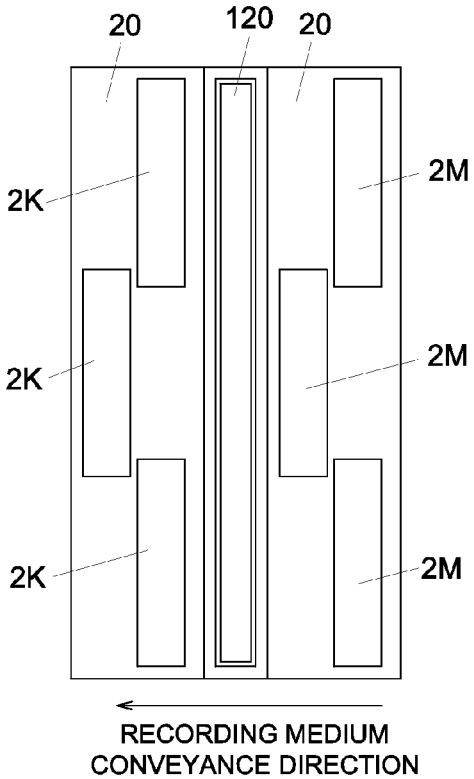
FIG. 44*c* is a plan view showing an example of arranging the cooling devices between adjacent head units with respect to a plurality of head units.

Further, as shown in FIG. 44*c*, even incases where head units 20, each arranged with a plurality of recording heads 2M and 2K in zigzag arrangement, are disposed in the conveyance direction of recording medium P, cooling device 120 may be arranged between the adjacent head units 20.

Figure 45:
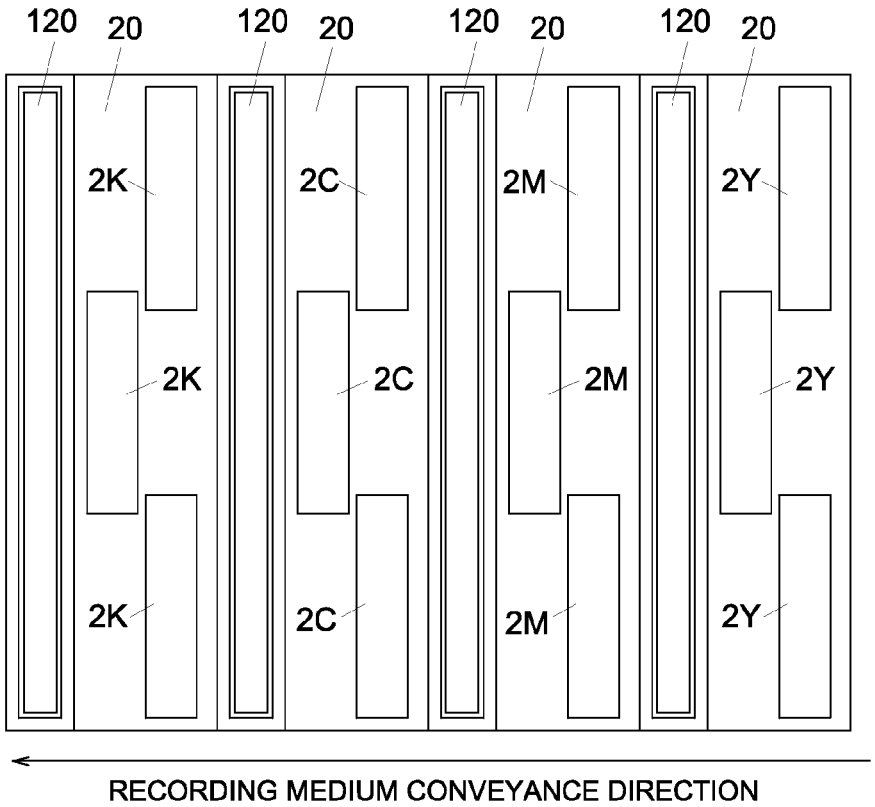
FIG. 45 is a plan view showing an example of arranging a cooling device at downstream side in the conveyance direction of a recording medium with respect to each of a plurality of head units arranged in zigzag alignment.
Figure 46:
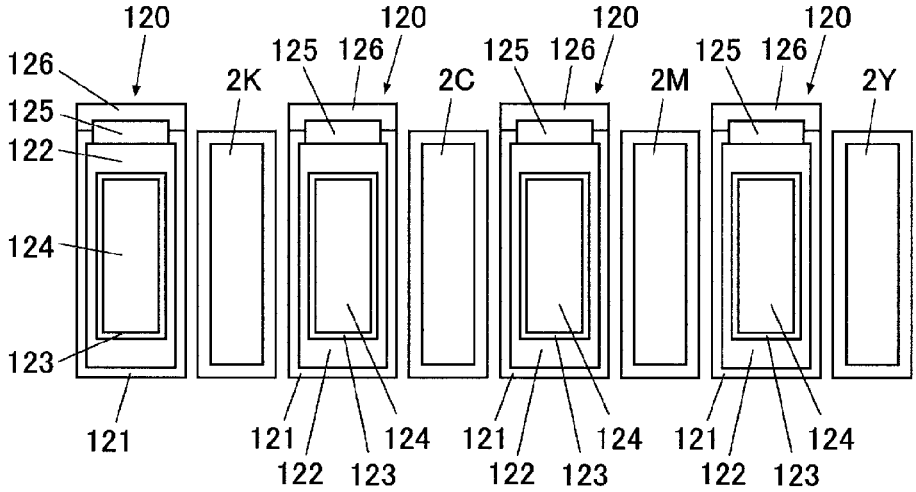
FIG. 46 is a plan view illustrating an arrangement of the recording head and the cooling device.
Figure 47:
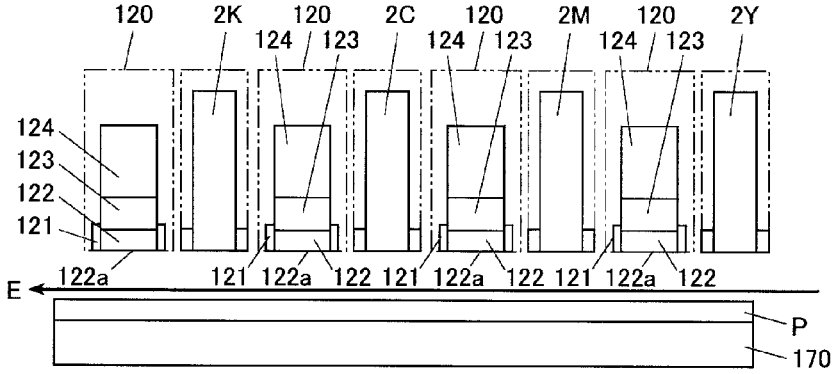
FIG. 47 is an elevation view illustrating an arrangement of the recording head and the cooling device.

Further, as shown in FIG. 45, even incases where a plurality of head units 20, each arranged with a plurality of recording heads 2Y, 2M, 2C, or 2K in zigzag arrangement, are disposed side by side in the conveyance direction of recording medium P, cooling device 120 may be arranged at downstream side of each head units 20 in the conveyance direction of recording medium P.

Variant Example B (Cooling Device)

As shown in FIGS. 38, and 46-48, cooling device 120 is installed on a head support member (not illustrated) fixed on the inkjet recording device, and is provided with supporting section 121 which is a basis of recording head 2Y, 2M, 2C, and 2K. And cooling section 122 is installed on said supporting section 121.

Cooling section 122 is, for example, made of a metal plate and the like. Specifically, by forming cooling section 122 with a high thermal conductivity metal plate such as stainless steel (SUS), aluminum, copper, iron and the like, cooling efficiency around recording head 2 can be enhanced. Further, by utilizing a compact and low-cost metal plate, cost reduction can be achieved.

Cooling section 122 is installed on supporting section 121 in the state of heat insulation from recording head 2Y, 2M, 2C, and 2K. Since cooling section 122 is installed on supporting section 121, only supporting section 121 is required to be a heat insulation material. As the heat insulation material, materials of inorganic fiber, foamed plastic, natural fiber and the like are preferable. Further it is preferable to dispose nozzle surface 21*y*, 21*m*, 21*c*, and 21*k* of recording head 2Y, 2M, 2C and 2K, and cooling surface 122*a* so as not be thermally affected with each other.

Cooling section 122 is disposed such that its bottom surface faces recording medium P. The bottom surface of cooling section 122 is made to be cooling surface 122*a* which cools the air containing vapor of ink component in the vicinity of recording head 2Y, 2M, 2C and 2K.

Cooling section 122 is disposed such that its cooing surface 122*a* is arranged at the downstream side, in the conveyance direction of recording medium P, of each recording head 2Y, 2M, 2C and 2K, side by side with recording head 2Y, 2M, 2C and 2K.

Figure 49:
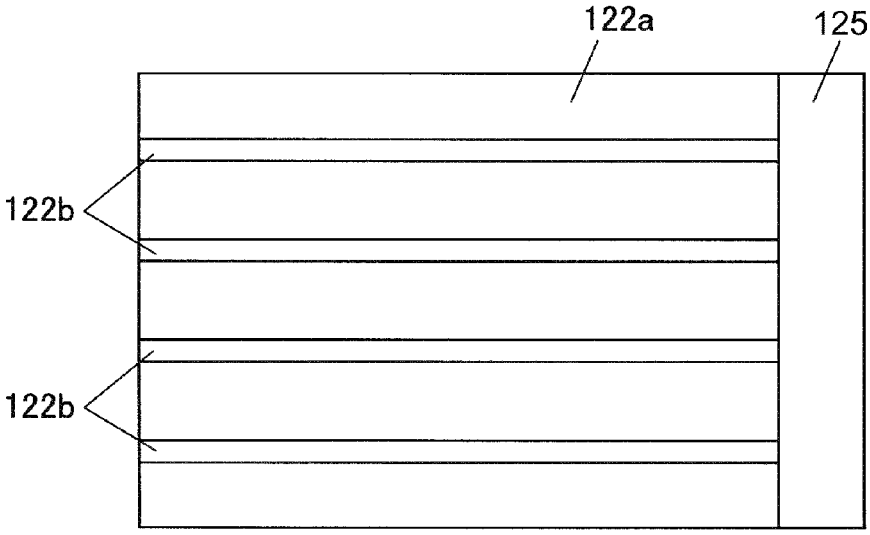
FIG. 49 is a bottom view of the cooling surface of the cooling device.

On cooling surface 122*a*, a groove 122*b* is formed extending from one end toward another end in the direction perpendicular to the conveyance direction E of recording medium P. As shown in FIG. 49, a plurality of grooves 122*b* is formed parallel with each other, and groove 122*b* having a semicircular shape in cross-section view The cooling surface 122*a* is performed of a lyophilic processing. This is a measure to make the dew condensation on cooling surface 122*a* hardly drops on recording medium P. As the lyophilic processing, coating of commercially available organic or inorganic hydrophilic coating material, photocatalytic titanium-oxide coating material on cooling surface 102*a*, and application of plasma processing on cooling surface 122*a* can be cited.

In the present embodiment, a stainless steel plate is used as cooling section 122, and a commercially available inorganic hydrophilic coating material is coated on its cooling surface 122*a*.

On an upper surface of the cooling section 122, Peltier device 123 is provided in contact state with cooling section 122 as a cooling body for cooling said cooling section 102. Here, Peltier device 123 is applied with electric current by power source 211 (see FIG. 52), bottom end part of Peltier device 123 contacting the cooling section 122 becomes low temperature and heat is radiated from the upper end portion.

Figure 48:
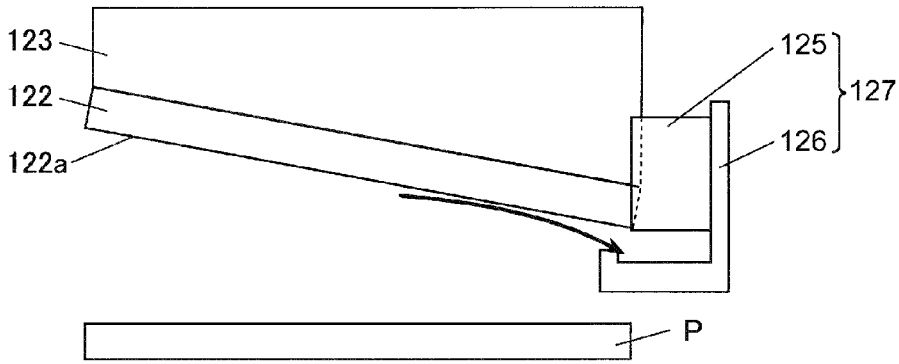
FIG. 48 is a side view of the cooling device viewing from the conveyance direction of the recording medium.

As shown in FIG. 48, Peltier device 123 is formed such that the surface contacting with cooling section 122 is slanted to be a slant surface to the horizontal surface. The slant surface is slanted downward (toward recording medium P) from one end of Peltier device 123 to another end in the conveyance direction of recording medium P.

Accordingly, cooling surface 122*a* of cooling section 122 contacting the lower end surface of Peltier device 123 is also slanted against the horizontal plane.

On the upper surface of Peltier device 123, heat radiation section 124 to release heat accumulated at the upper end area of Peltier device 123 is provided in contact state with Peltier device 123. Heat radiation section 124 is configured with a metal heatsink. Further, the upper end portion of Peltier device 123 may be exposed to outer air for natural heat radiation, or may be enhanced of cooling by exposing the heatsink 124 to the wind of a radiator fan.

Cooling section 122 and Peltier device 123 may be formed in one body. Namely, the cooling surface of Peltier device 123 may be made as the surface for attaching the dew condensation. As the cooling body, a water-cooling system for cooling the cooling surface with cooled water, or an air-cooling system for cooling the cooling surface with cooled air may be applicable, however, the cooling system for cooling said cooling surface 122*a* with Peltier device 123 is preferable. By using Peltier device 123 as the cooling body, a compact inkjet recording device with reduced cost can be realized. By a control of voltage to be applied to Peltier device 123, temperature control of cooling surface 122*a* is possible, and further, by using a plurality of stacked Peltier device 123, the cooling ability can be remarkably enhanced.

At one end of cooling section in the conveyance direction E of recording medium P, dew condensation collecting mechanism 127 is provided for collecting the dew condensation attached and accumulated on cooling surface 122*a*.

A dew condensation collecting mechanism 127 is disposed down below the lowest position of the slant cooling surface 122*a*. A dew condensation collecting mechanism 127 is provided with absorption member 125 to absorb the dew condensation accumulated on cooling surface 122*a*, and waste liquid collection tray 126 to reserve the dew condensation absorbed by absorption member 125.

As absorption member 125, a sponge material such as a porous material, a fiber material of felt and the like, or a material blended with high molecular polymer can be utilized. Absorption member 125 is provided on waste liquid collection tray 126 fixed on cooling section 122, and the waste liquid, which being collection of the dew condensation absorbed by absorption member 125, can be collected from waste liquid collection tray 76. Absorption member 125 is provided so as to contact the end portion of groove 122*b*. Namely, groove 122*b* is communicated with absorption member 125 of dew condensation collecting mechanism 127.

In order to be able to absorb the dew condensation accumulated on cooling surface 122*a*, absorption member 125 is disposed with protruding down below (to the side of recording medium P) the cooling surface 122*a*. Dew condensation absorbed by absorption member 125 may be dried with natural drying from absorption member 125, or by being dropped onto waste liquid collection tray 126 by squeezing and waste liquid collection tray 126 may be removed to be externally ejected.

<Function Effect>

As described above, according to inkjet recording device 200 of variant example B, since groove 122*b* is formed on cooling surface 122*a*, dew condensation generated on the cooling surface 122*a* moves with capillary action along the groove 122*b*, and is collected in the dew condensation collecting mechanism 127 communicated with said groove 122*b*.

Therefore, since the ink vapor floating in the vicinity of the recording head 2Y, 2M, 2C, and 2K is discharged to outside by the cooling device 120 having the cooling surface 122*a* formed with the groove 122*b* and dew condensation collecting mechanism 127, the dehumidification near the recording head can be effectively per formed. Further, since the dew condensation is collected through the groove 122*b* of cooling surface 122*a* into the dew condensation collecting mechanism 127, few dew condensation remains on the cooling surface 122*a*, and the maintenance (wiping and the like) of the cooling surface 122*a* can be made unnecessary, or the number of times of maintenance for the cooling surface 122*a* can be decreased compared to a case of not fanning the grove 122*b* on the cooling surface 122*a*.

Further, by forming the groove 122*b* on the cooling surface 122*a*, since the surface area of cooling surface 72*a* becomes large, the dehumidification efficiency near the recording head can be improved.

Further, since the cooling surface 122*a* is configured to be an slant surface, the dew condensation moves downward due to a gravity force, and is collected into the dew condensation mechanism 127 positioned below the lowest position of the cooling surface. Thus, the dew condensation can be quickly and easily collected.

Further, by applying the lyophilic processing on the cooling surface 122*a*, since the condensed dew becomes wet and easy to spread on cooling surface 122*a*, the condensed dew can be prevented from trailing down or dropping from the cooling surface 122*a*, which enables to make the distance from the recording media P and the recording head short to improve the image quality.

Further, since the dew condensation generated on the cooling surface 122*a* can be absorbed with the absorption member 125, a number of times of maintenance for the cooling surface 122*a* can be decreased. Further, since the dew condensation generated on the cooling surface 122*a* is absorbed by the absorption member 125 before dropping on the recording media P, pollution of the recording media P can be easily prevented.

Variant Example C

In line type inkjet recording device 200, the cooling device is not limited to the above described embodiment. For example, a shown in FIGS. 50 and 51, the cooling device may be provided with slant mechanism 300 for slanting the cooling surface 222*a* against a horizontal surface so that dew condensation collecting mechanism 225 comes to a lower position than cooling surface 222*a* of cooling section 222.

Figure 50:
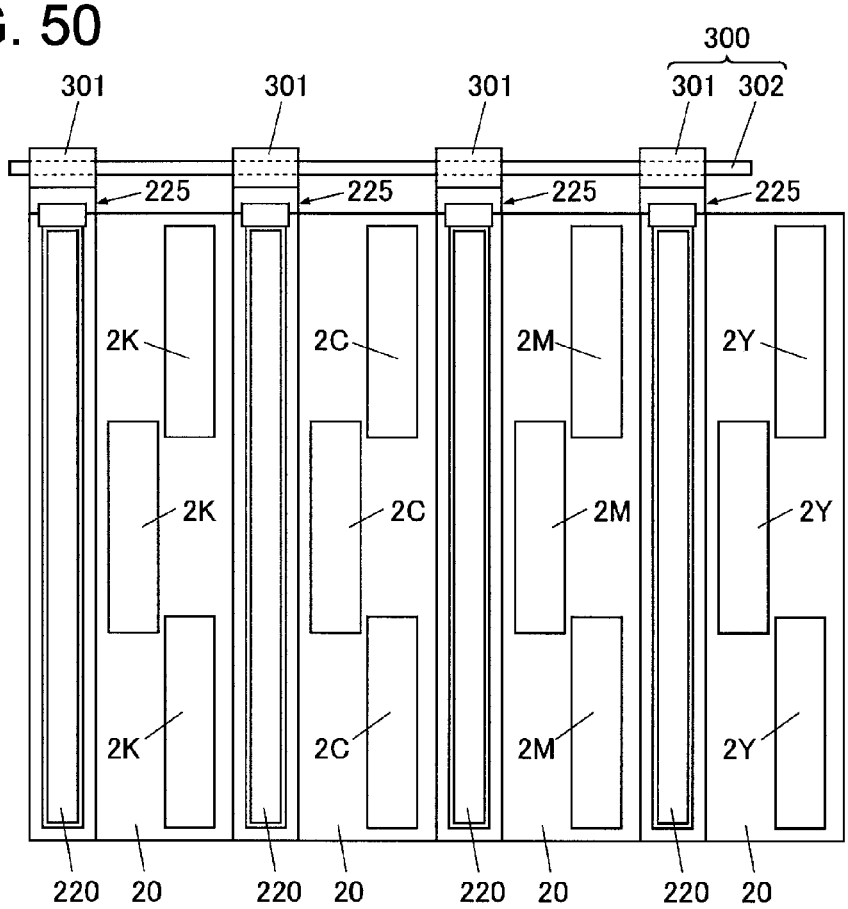
FIG. 50 is a plan view illustrating an alignment of a recording head, a cooling device, and a slanting mechanism.
Figure 51A:
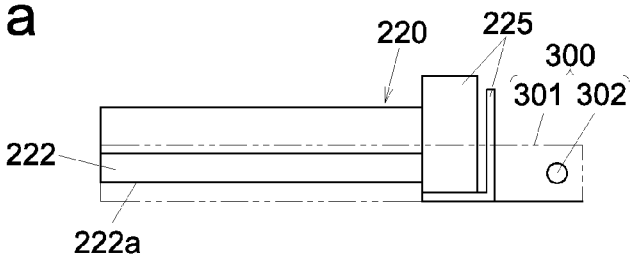
FIG. 51*a* is a side view illustrating a state before slanting the cooling surface by the slanting mechanism, viewing from the conveyance direction of the recording medium.
Figure 51B:
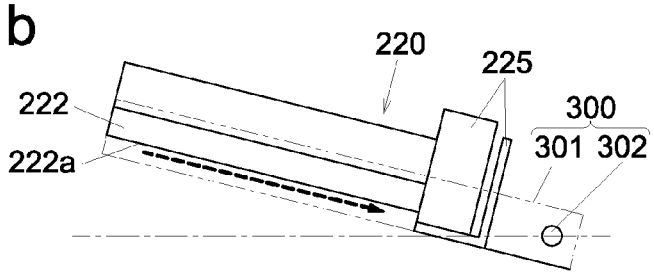
FIG. 51*b* is a side view illustrating a state after slanting the cooling surface by the slanting mechanism, viewing from the conveyance direction of the recording medium.

Specifically, as shown in FIG. 50, in cases where a plurality of head unit 20, each arranged with a plurality of recording head 2Y, 2M, 2C or 2K in zigzag alignment, are provided in the conveyance direction E of recording medium P, cooling device 220 is provided at downstream side of each head unit 20 in the conveyance direction E of recording medium P.

At one end of each cooling device 220 in the direction perpendicular to the conveyance direction E of recording medium P (end portion of the side where dew condensation collecting mechanism 225 is provided), slant mechanism 300 is provided. Slant mechanism 300 is provided with support member 301 attached on each dew condensation collecting mechanism 225, and shaft 302 inserted through each support member 301.

On each support member 301, an insertion hole of shaft 302 is formed, so that the center of the insertion hole comes to a position on a coaxial line along the conveyance direction E of recording medium P. And a single shaft 302 is inserted through each insertion hole, to enable each support member to turn about shaft 302.

On each cooling device 220, unillustrated handle is provided, and by lifting up the other end of cooling device 220 in the perpendicular direction to the conveyance direction of recording medium P, cooling surface 222*a* can be slanted. While, dew condensation collecting mechanism 225 is provided at one end of cooling device 220 in the perpendicular direction to the conveyance direction of recording medium P, when the other end of cooling device 220 is lifted up to slant the cooling surface 222*a* by use of the handle, dew condensation collecting mechanism 225 comes to a lower position than cooling surface 222*a*. Thus, the dew condensation on cooling surface 222*a* can be guided to dew condensation collecting mechanism 225.

By the structure described above, since cooling surface 222*a* can be slanted by slant mechanism 300, the dew condensation moves due to gravity force toward the lower position, and is collected by dew condensation collecting mechanism 225 which is positioned at lower site than the lowest part of cooling surface 222*a*. Thus, the dew condensation can be easily and quickly collected.

Further, by the degree of lifting up the handle, the inclination angle of cooling surface 222*a* can be freely adjusted, and the inclination can be adjusted according to the ink viscosity and the like.

Further, the slant mechanism is not limited to the manual type which a user operates its handle, but another configuration is possible where the support member is fixed on the shaft, and the cooling surface is slanted by axially rotating the shaft with an actuator.

<Others>

The present invention is not limited to the above embodiment, and can be freely design changed within the scope of not changing the essential part of invention.

Further, in the first embodiment, cooling devices 7A-7G of variant examples 2-8 are described as examples provided on the scanning type inkjet recording device 1, however, these cooling devices can be also provided on line type inkjet recording device 200.

For example in case of providing the cooling section 102 via the holding member 106 as shown in FIGS. 24 and 25, each cooling device 7D is provided at downstream side each recording head 2Y, 2M, 2C, and 2K in the conveyance direction E of recording media P. Meanwhile, since the configuration of cooling device 7D, the cooling operation and maintenance operation were described in the variant example 5 of the first embodiment, the explanation will be omitted.

Figure 55:
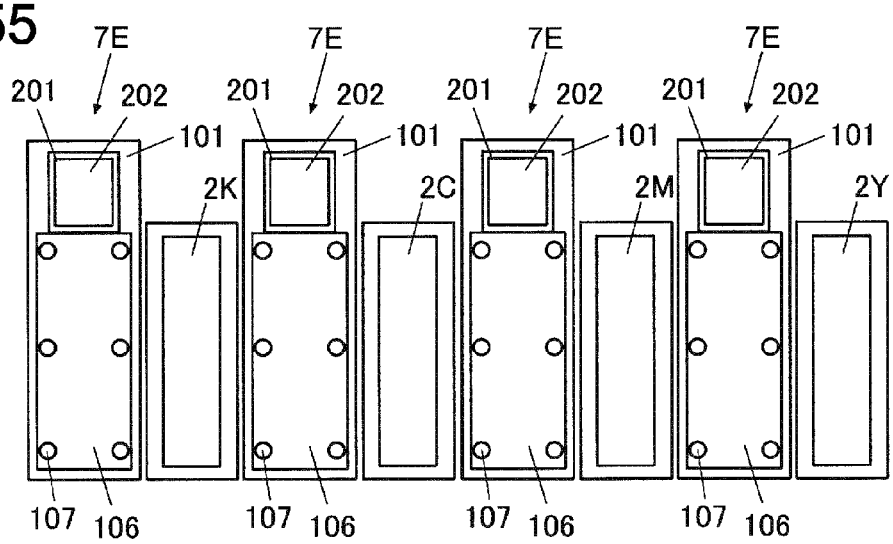
FIG. 55 is a plan view illustrating an arrangement of a recording head and a cooling device.
Figure 56:
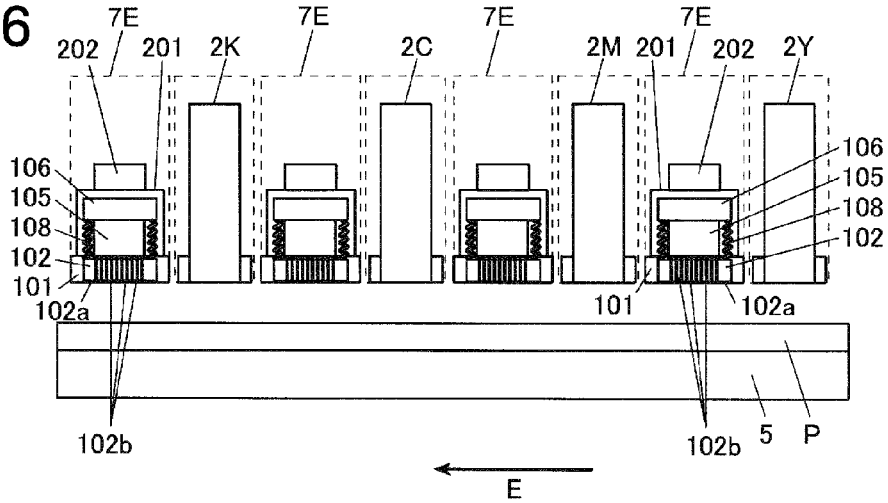
FIG. 56 is an elevation view illustrating an arrangement of a recording head and a cooling device.

Further, in case of providing the cooling device 7E, which directly cools the cooling section 102 and holding member 106 by Peltier device 201 on the line type inkjet recording device, Peltier device 201 is provided to contact the cooling section 102 at the end portion in the perpendicular direction to the conveyance direction E of recording medium P as shown in FIGS. 55 and 56, and the heat releasing section 202 is provided in contact state on the upper surface of Peltier device 201. As the cooling device is fixed on each recording head 2Y, 2M, 2C, and 2K, the occupied area of each recording head 2Y, 2M, 2C, and 2K can be reduced.

Further, in the second embodiment, cooling devices of variant examples B and C are described as examples provided on the line type inkjet recording device 200, however, these cooling devices can be also provided on scanning type inkjet recording device 1.

Further, for example, the absorption member is not essential. In case of not providing the absorption member, cleaning of the cooling surface may be set to be conducted with maintenance unit 8 at the time of maintenance of the nozzle surface of recording head or at every prescribed images of printing.

Figure 57:
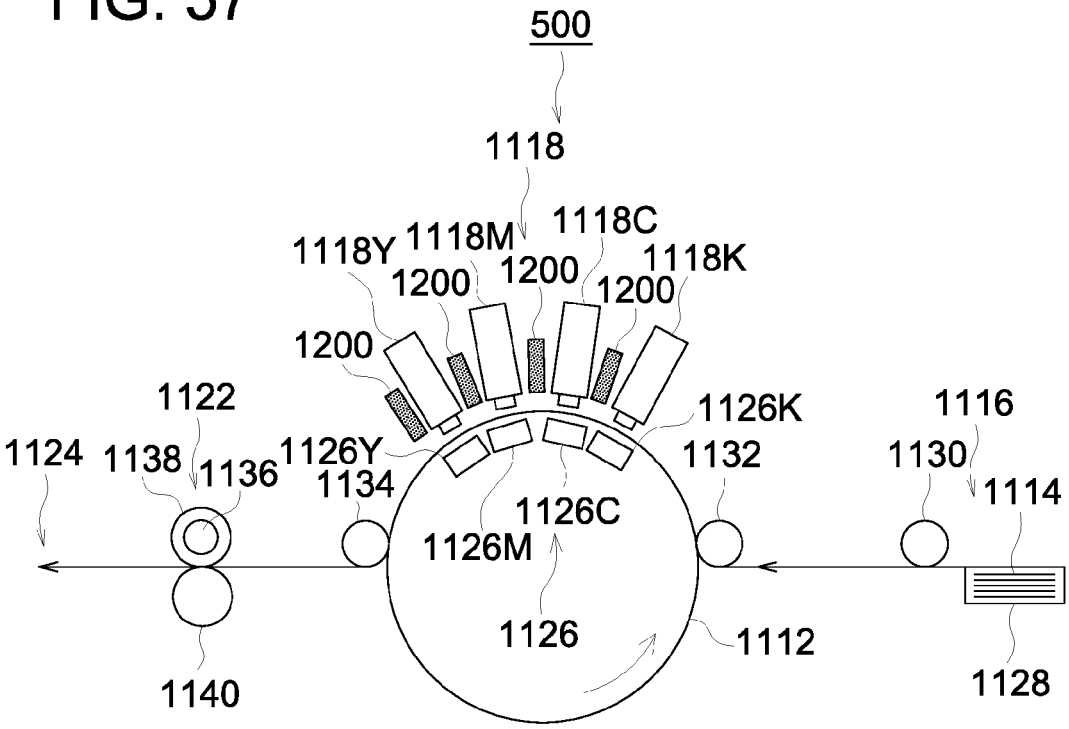
FIG. 57 is a drawing illustrating an outline structure of a drum scanning type inkjet recording device.

Further, in the above described embodiments, although the present invention was described as the examples applied on flatbed scanning type inkjet recording devices, the present invention can be applied onto drum scanning type inkjet recording devices as shown in FIG. 57.

As shown in FIG. 57, inkjet recording device 500 of the present embodiment is a drum scanning line type inkjet recording device which directly forms an image on a recording medium held on the periphery of drum 1112.

The inkjet recording device 500 is mainly configured with drum 1112 to convey recording medium 1114 by holding on its periphery, paper supply section 1116 to supply the recording medium 1114, printing section 1118 to form an image by applying a color ink on the recording medium 1114 being held by the drum 1112, fixing processing section 1122 to make the image durable, exit section 1124 to convey and discharge the recording medium formed with the image, heating device 1126K, 1126C, 1126M and 1126Y each provided to the position facing to each recording head 1118K, 1118C, 1118M, and 1118Y of printing section 1118, cooling device 1200 provided in parallel at downstream side of each recording head in the conveyance direction of the recording medium.

In paper supply section 1116, paper supply tray 1128 to supply cut sheet recording medium 1114. The recording medium 1114 fed out by paper supply roller 1130 from paper supply section 1116 is sent via guide roller 1132 to the periphery of drum 1112 to be held on the periphery of drum 1112.

Instead of the cut sheet type recording medium 1114, roll shaped recording medium of continuous sheet type is also possible to be used. In case of using the continuous sheet type recording medium, means for holding the roll and a cutter to cut the continuous recording medium into a prescribed size are provided.

Although an illustration is omitted, a plurality of suction holes are provided on the periphery of drum in a prescribed pattern of arrangement, and the area, where the plurality of suction holes are provide, functions as a recording medium holding area. The suction holes are communicated with a suction path provided in drum 1112, and connected to an external suction pump via the suction path. Meanwhile, instead of the above mentioned negative pressure suction system, an electrostatic adsorption system can be applied, which holds the recording medium 1114 by an electrostatic force at the recording medium holding area of drum 1112. Due to stable conveyance of the recording medium, conveyance failure can be reduced.

Printing section 1118 is provided at a position facing to the periphery of dram 1112, and configured with recording head 1118K, 1118C, 1118M, and 1118Y respectively corresponding to four colors of ink: black (K), cyan (C) magenta (M), and yellow (Y), and executes image recording by ejecting each color ink onto recording medium 1114 being held on the periphery of drum 1112 according to image data.

As shown in FIG. 57, each recording head 1118K, 1118C, 1118M, and 1118Y is arranged along the periphery of drum 1112, being slanted against the horizontal plane. To be more specific, the perpendicular direction to nozzle surface (bottom surface) of each recording head 1118K, 1118C, 1118M, and 1118Y coincides with a normal direction of the peripheral surface of drum 1112, and each distance between the nozzle surface of each recording head 1118K, 1118C, 1118M, and 1118Y and respective ink landing position on drum 1112 (on recording medium 1114) is configured to be equal. In particular, by arranging each recording head on the periphery of drum 1112 in circular arc, accuracy of ink landing position caused by a flying distance of ink droplet is secured, and high quality image formation is enabled.

Heating device 1126 includes each heating device 1126K, 1126C, 1126M, and 1126Y respectively corresponding to each recording head 1118K, 1118C, 1118M, and 1118Y. As shown in FIG. 57, each heating device 1126K, 1126C, 1126M, and 1126Y is arranged to be slanted to the horizontal plane so as to become parallel to respective recording head 1118K, 1118C, 1118M, and 1118Y.

Heating device 1226 is provided at a position distant from the printing position on drum 1112 in the perpendicular direction of recording medium surface.

Further, the cooling surface (bottom surface) of each cooling device 1200 and the nozzle surface of each recording head 1118K, 1118C, 1118M, and 1118Y are arranged along the conveyance direction (peripheral direction of the drum) of the recording medium, and the ink vapor moving with the air flow generated by the conveyance of recording medium can be collected at least at one of before or after the ink ejection by the recording head, which enables effective dehumidification in the vicinity of recording head.

In latter stage of printing section 1118, fixing processing section 1112 to execute fixing process on recording medium 1114 after printed is provided. Recording medium 1114 after printed is sent via guide roller 1134 to fixing processing section 1122, where solvent drying process is executed. Fixing processing section 1122 shown in FIG. 57 includes heat roller 1138 embedded with heater 1136 and support roller 1140 arranged in opposite side of heat roller 1138 with respect to the recording medium conveyance path.

Recording medium 1114 after printed is nipped between heat roller 1138 and support roller 1140 such that the image recorded surface of the recording medium comes to the side of heat roller 1138, and the image recorded surface of the recording medium 1114 is heated via heat roller 1138 with the heat radiated from heater 1136, and pressurized by the press of heat roller 1138 and support roller 1140. Thus durability of image area of the recording medium is improved.

After being applied with fixing process by fixing processing section 1122, recording medium 1114 is discharged from exit section 1124 to outside of the device.

EXPLANATION OF CODES

1: inkjet recording device
2: recording head
2*a*: nozzle surface
3: carriage (head support member)
5: heating device
6: conveyance device
7: cooling device
72: cooling section
72*a*: cooling surface
75: absorption member

What is claimed is:

1. An inkjet recording device for ejecting ink onto a recording medium to form an image on the recording medium while a recording head is moved with relative movement to the recording medium in a direction along an upper surface of the recording medium, comprising:

a recording head for ejecting ink onto a recording medium;

a heating device for heating the recording medium;

a conveyance device for conveying the recording medium having been heated by the heating device to under the recording head, and a cooling device which is provided in a state of insulation from the recording head, and has a cooling surface which is cooled to a temperature lower than a temperature of a nozzle surface of the recording head, wherein the cooling surface and the nozzle surface of the recording head are disposed along a direction of the relative movement and face the recording medium.

2. The inkjet recording device described in claim 1, wherein the direction of the relative movement is a scanning direction of the recording head, and the cooling surface and the nozzle surface are disposed along the scanning direction of the recording head.

3. The inkjet recording device described in claim 2, wherein the cooling surface is disposed at a downstream side with respect to the recording head in the scanning direction.

4. The inkjet recording device described in claim 2, further comprising an absorption member to absorb dew condensation attached on the cooling surface, wherein a groove communicated with a dew condensation collecting mechanism is formed on the cooling surface, and wherein the dew condensation collecting mechanism is disposed at an end portion of the recording head in the scanning direction.

5. The inkjet recording device described in claim 4, wherein the groove is formed to be extended along the scanning direction of the recording head.

6. The inkjet recording device described in claim 1, wherein the direction of the relative movement is a conveyance direction of the recording medium, and the cooling surface and the nozzle surface are disposed along the conveyance direction of the recording medium.

7. The inkjet recording device described in claim 6, wherein the cooling surface is disposed at a downstream side with respect to the recording head in the conveyance direction of the recording medium.

8. The inkjet recording device described in claim 7, wherein a plurality of recording heads are disposed side by side along the conveyance direction of the recording medium, and the cooling surface is disposed in parallel at the downstream side with respect to each of the plurality of recording heads in the conveyance direction of the recording medium.

9. The inkjet recording device described in claim 1, wherein a plurality of recording heads are disposed side by side along the direction of relative movement, and the cooling surface is disposed between adjacent recording heads.

10. The inkjet recording device described in claim 1, wherein a plurality of recording heads are disposed side by side along the direction of the relative movement, and the cooling surface is disposed adjacent to an end of the plurality of recording heads disposed on the line.

11. The inkjet recording device described in claim 1, wherein a height of the nozzle surface of the recording head and a height of the cooling surface each from the recording medium are configured to be equal.

12. The inkjet recording device described in claim 1, wherein the cooling surface is applied with a lyophilic processing.

13. The inkjet recording device described in claim 1, further comprising an absorption member to absorb the dew condensation attached on the cooling surface.

14. The inkjet recording device described in claim 13, wherein the cooling device comprises a cooling section on which the cooling surface is formed, and wherein the absorption member and a hole communicating from the cooling surface to the absorption member is formed on the cooling section.

15. The inkjet recording device described in claim 14, wherein the cooling device further comprises:

a holding member which holds the absorption member by sandwiching the absorption member between the holding member and the cooling section;

a connecting member which connects the cooling section with the holding member; and a cooling body which cools the cooling section to a lower temperature than a temperature of the nozzle surface of the recording head.

16. The inkjet recording device described in claim 15, wherein the absorption member is elastically deformable, and a distance between the cooling section and the holding member is configured to be variable.

17. The inkjet recording device described in claim 15, wherein the cooling body is provided to contact the holding member, and wherein at least one of the holding member and the connecting member, and the absorption member are thermally-conductive.

18. The inkjet recording device described in claim 15, wherein the cooling body is provided to contact the holding member, and wherein the holding member is thermally-conductive.

19. The inkjet recording device described in claim 15, wherein the cooling body is provided to contact the cooling section, and the connecting member thermally insulates between the cooling section and the holding member, and wherein, the holding member has a heat radiation section to contact the cooling body and release heat of the cooling body.

20. The inkjet recording device described in claim 1, further comprising a dew condensation collecting mechanism disposed on the cooling device, wherein a groove connected to a dew condensation collecting mechanism is formed on the cooling surface.

21. The inkjet recording device described in claim 20, wherein the cooling surface is a slant surface being slanted with respect to a horizontal plane, and wherein the dew condensation collecting mechanism is disposed below the lowest position of the cooling surface.

22. The inkjet recording device described in claim 20, further comprising a slanting mechanism which slants the cooling surface with respect to a horizontal plane such that the dew condensation mechanism is positioned below the cooling surface.

23. The inkjet recording device described in claim 20, wherein the dew condensation mechanism comprises an absorption member to absorb collected dew condensation.

* * * * *